US009745098B2

(12) United States Patent
Takyar et al.

(10) Patent No.: US 9,745,098 B2
(45) **Date of Patent: *Aug. 29, 2017**

(54) QUARTER PALLET WITH PRODUCT TAB RECEIVING AREAS FOR PRODUCTS CARRIED THEREON

(71) Applicant: CHEP Technology Pty Limited, Sydney (AU)

(72) Inventors: Sanjiv Takyar, Surrey (GB); Karl Michael Wesson, London (GB); Gert Stuve, PD Diepenheim (NL); Jean-Marc van Maren, Eemnes (NL)

(73) Assignee: CHEP Technology Pty Limited, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/177,683

(22) Filed: Jun. 9, 2016

(65) Prior Publication Data

US 2016/0318657 A1 Nov. 3, 2016

Related U.S. Application Data

(63) Continuation of application No. 14/415,253, filed as application No. PCT/GB2013/051854 on Jul. 12, 2013, now Pat. No. 9,387,953.

(30) Foreign Application Priority Data

Jul. 16, 2012 (GB) ..... 1212646.2
Jan. 4, 2013 (GB) ..... 1300129.2

(51) Int. Cl.
*B65D 19/00* (2006.01)
*B65D 19/38* (2006.01)
(Continued)

(52) U.S. Cl.
CPC ..... *B65D 19/385* (2013.01); *B65D 19/00* (2013.01); *B65D 19/004* (2013.01); *B65D 19/04* (2013.01);
(Continued)

(58) Field of Classification Search
CPC ..... B65D 19/38; B65D 19/00; B65D 19/385; B65D 19/0018; B65D 19/40; B65D 19/44
(Continued)

(56) References Cited

U.S. PATENT DOCUMENTS 3,199,469 A 8/1965 Sullivan
3,641,949 A 2/1972 Monk
(Continued)

FOREIGN PATENT DOCUMENTS

CN 201301027 9/2009
CN 2013385825 1/2010
(Continued)

*Primary Examiner* — Daniel Rohrhoff
(74) *Attorney, Agent, or Firm* — Allen, Dyer, Doppelt + Gilchrist, PA

(57) ABSTRACT

A pallet for transporting products thereon includes a top having a product support surface and an opposing underside, and with outer sides extending between the product support surface and the opposing underside. Four feet each extend away from the underside of the top. Each foot has a first opening facing out through the product supporting surface so that the feet allow stacking of such pallets. At least one product tab receiving area is adjacent an edge of the top and has a parent slot within the top with a partially closed bottom forming a shelf and an opening adjacent the shelf. An inner slot extends through the opening adjacent the shelf so as to be recessed below the parent slot. The inner slot has a pair of spaced apart sidewalls, a closed bottom, and with one of the sidewalls having a projection extending towards the other sidewall.

35 Claims, 43 Drawing Sheets

(51) Int. Cl.

| | |
|---|---|
| ***B65D 19/06*** | (2006.01) |
| ***B65D 19/04*** | (2006.01) |
| ***B65D 19/40*** | (2006.01) |
| ***B65D 19/44*** | (2006.01) |

(52) U.S. Cl.
CPC ..... *B65D 19/06* (2013.01); *B65D 19/40* (2013.01); *B65D 19/44* (2013.01); *B65D 2519/008* (2013.01); *B65D 2519/00034* (2013.01); *B65D 2519/00069* (2013.01); *B65D 2519/0082* (2013.01); *B65D 2519/0091* (2013.01); *B65D 2519/0094* (2013.01); *B65D 2519/0096* (2013.01); *B65D 2519/00159* (2013.01); *B65D 2519/00174* (2013.01); *B65D 2519/00268* (2013.01); *B65D 2519/00273* (2013.01); *B65D 2519/00288* (2013.01); *B65D 2519/00318* (2013.01); *B65D 2519/00338* (2013.01); *B65D 2519/00407* (2013.01); *B65D 2519/00497* (2013.01); *B65D 2519/00597* (2013.01); *B65D 2519/00641* (2013.01); *B65D 2519/00771* (2013.01); *B65D 2519/00791* (2013.01); *B65D 2519/00796* (2013.01); *B65D 2519/00815* (2013.01)

(58) Field of Classification Search
USPC ..... 108/53.1, 53.3, 53.5
See application file for complete search history.

(56) References Cited

U.S. PATENT DOCUMENTS

| | | | | |
|---|---|---|---|---|
| 5,046,434 | A | 9/1991 | Breezer et al. | |
| 5,664,934 | A | 9/1997 | Schaede et al. | |
| D400,682 | S | 11/1998 | Constantino et al. | |
| 5,921,188 | A * | 7/1999 | Kohlhaas | B65D 19/0075 108/52.1 |
| 6,234,087 | B1 | 5/2001 | Brown | |
| 6,752,285 | B1 | 6/2004 | Scalf | |
| 6,910,668 | B2 | 6/2005 | Henning | |
| 6,976,437 | B2 | 12/2005 | Fisch et al. | |
| 7,819,068 | B2 * | 10/2010 | Apps | B65D 19/004 108/53.1 |
| 9,387,953 | B2 * | 7/2016 | Takyar | B65D 19/0018 |
| 2001/0029874 | A1 | 10/2001 | Muirhead | |
| 2002/0017225 | A1 | 2/2002 | Koefelda et al. | |
| 2002/0148393 | A1 | 10/2002 | Milles | |
| 2004/0134390 | A1 | 7/2004 | Apps et al. | |
| 2007/0181045 | A1 | 8/2007 | Smyers | |
| 2007/0266910 | A1 | 11/2007 | Lux et al. | |
| 2008/0149005 | A1 * | 6/2008 | Stahl | B65D 19/004 108/53.3 |
| 2011/0132801 | A1 | 6/2011 | Elder | |
| 2011/0179977 | A1 | 7/2011 | Linares | |
| 2011/0179978 | A1 * | 7/2011 | Schmitt | B29C 45/2628 108/53.3 |
| 2011/0220544 | A1 | 9/2011 | De Alba | |
| 2013/0032507 | A1 * | 2/2013 | Du Toit | B65D 19/0012 206/599 |
| 2016/0167831 | A1 * | 6/2016 | Suiter | B65D 19/0018 108/53.1 |

FOREIGN PATENT DOCUMENTS

| | | |
|---|---|---|
| CN | 102133956 | 7/2011 |
| DE | 3806069 | 9/1988 |
| DE | 91 06 619 | 8/1991 |
| DE | 9106619 | 8/1991 |
| DE | 91 04 762 | 8/1992 |
| DE | 91 05 452 | 9/1992 |
| DE | 44 29 483 | 2/1996 |
| DE | 10167417 | 6/2003 |
| DE | 20 2007 004 603 | 6/2007 |
| DE | 20 2007 016 732 | 2/2008 |
| DE | 10 2008 058 238 | 5/2010 |
| EP | 0 071 467 | 2/1983 |
| EP | 0523737 | 1/1993 |
| EP | 0725010 | 8/1996 |
| EP | 2 028 117 | 2/2009 |
| EP | 2067708 | 6/2009 |
| EP | 2 108 594 | 10/2009 |
| EP | 2147865 | 1/2010 |
| FR | 2359037 | 2/1978 |
| FR | 2839701 | 11/2003 |
| NL | 9002386 | 6/1991 |
| WO | 0112509 | 2/2001 |
| WO | 2010/086 883 | 5/2010 |
| WO | 2010064986 | 6/2010 |
| WO | 2011/060794 | 5/2011 |

* cited by examiner

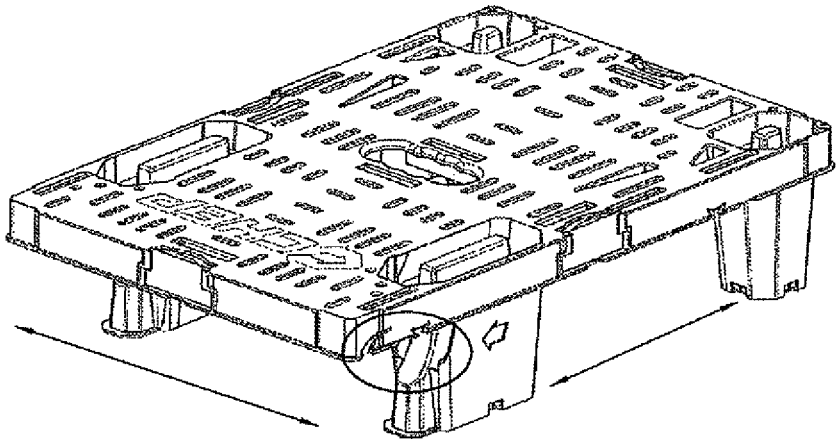
Fig. 11
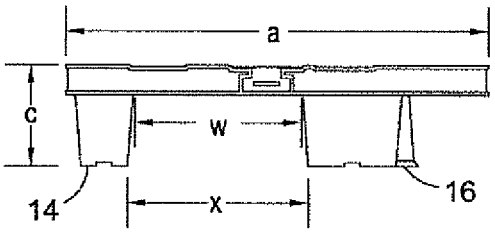
Fig. 12
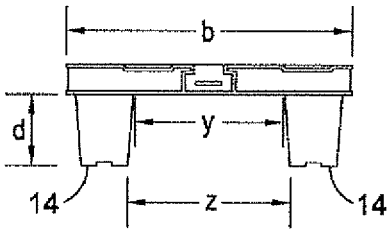
Fig. 13
| Pallet | w | x | y | z |
|---|---|---|---|---|
| Current | 240mm | 258mm | 204mm | 222mm |
| New | 245mm | 263mm | 250mm | 268mm |
Fig. 14

Fig. 23
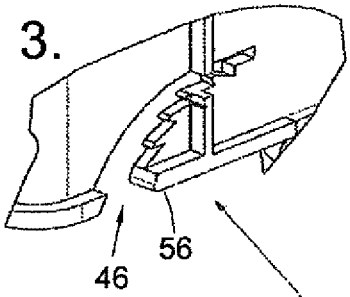
Fig. 24
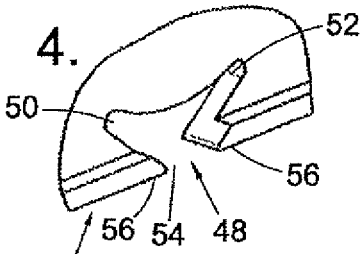
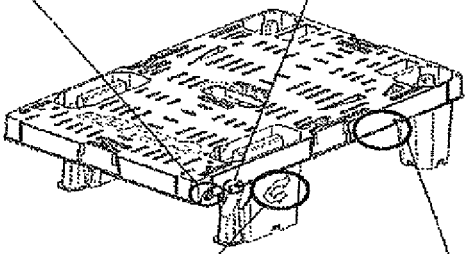
Fig. 25
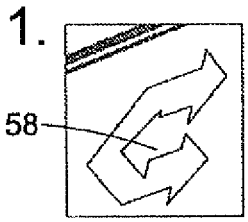
Fig. 26
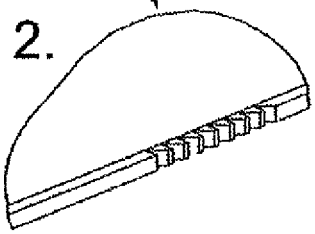
Fig. 27

SECTION D-D

Section A-A

Section B-B

Section C-C

QUARTER PALLET WITH PRODUCT TAB RECEIVING AREAS FOR PRODUCTS CARRIED THEREON

FIELD OF THE INVENTION

The present application is a continuation of U.S. application Ser. No. 14/415,215 filed Jan. 16, 2016 which is U.S. National Phase of International Application No. PCT/GB2013/051854, filed on Jul. 12, 2013, designating the United States of America and claiming priority to United Kingdom Patent Application No. 1212646.2, filed Jul. 16, 2012 and United Kingdom Patent Application No. 1300129.2, filed Jan. 4, 2013. The present application claims priority to and the benefit of the above-identified applications, each of which is incorporated by reference herein in its entirety.

BACKGROUND OF THE INVENTION

Pallets for distributing products from one location to another are well known and they can be provided in a number of different sizes, including a "full" size, typically having a standard size of about 1200 by 1000 mm, a "Euro" size, typically having a standard size of about 800 by 1200 mm, a "half" size, typically having a standard size of about 800 by 600 mm and a "quarter" size, typically having a standard size of about 600 by 400 mm. Other standard or bespoke sizes are also provided in the art. However, it is preferred for the standardization of loading and unloading procedures to provide pallets to the manufacturing or distribution industry in generally standardized sizes doing so allows better automation of these loading or distribution processes, especially where the pallets are used not just for the initial loading and distribution, but are also recycled for reuse in further loading and distribution processes.

Many pallets in existence today are made out of timber, and these pallets are typically designed for a single use, or infrequent re-use, and as such are considered to be disposable items. Other pallets are made of a plastic and these are more typically recognized to be recyclable in the sense that they can be reused numerous times, and over a long period of time, e.g., years. Such pallets have allowed networks of pallets to be created wherein many thousands if not millions of pallets can be in circulation around a company's manufacture, loading, distribution, storage and supply networks. Logistics firms monitor or manage those pallets, and often hire the pallets out to these other companies.

The pallets forming these networks are typically highly standardized, i.e. they are generally fabricated to close tolerances, and potentially with features that cannot be provided in a cost effective manner in a wooden form of pallet due to the need for the features to be durable enough to survive long-term usage and reuse of the pallets so as to allow them to be incorporated into automated loading and unloading systems. As a result, these standardized pallets are typically formed of plastic or resin based materials.

It has been recognized by the present inventors, however, that various improvements could be made to the pallets currently in use. The present invention relates to such improvements.

SUMMARY OF THE INVENTION

According to the present invention there is provided a pallet for transporting products thereon, the pallet comprising:

a top with a product supporting surface and an opposing underside, four feet and at least four sides, wherein the four feet each extend away from the underside of the top, have a first opening facing out through the product supporting surface, and have an inner member extending from a further opening in the sole of the foot, the part of the sole surrounding the further opening connecting the inner member to an outer wall of the foot, and the inner member extending away from the sole towards the product supporting surface, the feet thus allowing stacking of a plurality of such pallets with the feet of a first such pallet extending into the first openings of a second such pallet, and with the inner member of the second such pallet extending into the second openings of the first such pallet.

The inner member extends away from the sole towards its distal end. Preferably, that distal end is a substantially closed distal end. Preferably, the distal end lies in the plane of the product supporting surface to increase the surface area of the product supporting surface.

There is also provided a pallet for transporting products thereon, the pallet comprising:

a top with a product supporting surface and an opposing underside, four feet and at least four sides, wherein the four feet each extend away from the underside of the top, have a first opening facing out through the product supporting surface, he feet thus allowing stacking of a plurality of such pallets with the feet of a first such pallet extending into the first openings of a second such pallet.

Preferably, this pallet has an inner member extending from a further opening in the sole of the foot, the part of the sole surrounding the further opening connecting the inner member to an outer wall of the foot, like with the previous aspect of the invention. Preferably, the inner member extends away from the sole towards the product supporting surface, like with the previous aspect of the invention. Preferably upon stacking two such pallets, the inner member of a second such pallet extends into the second openings of the first such pallet, like with the first aspect of the invention. These features, however, are only preferred, i.e. they are non essential for pallets to be in accordance with the invention. The pallets of the present invention may thus be differentiated from pallets of the art through other features.

Preferably the pallet comprises a hand access hole. Preferably the hand access hole is located at or towards the center of gravity of the pallet or near the center of the support surface. It may have a length (long dimension) of at least 100 mm. It may have a width (short dimension) of at least 40 mm. Preferably finger grips are provided on one or both of the long side of the hand access hole. A rounded end wall can be provided at one or both of the short sides thereof.

The hole may be chamfered or rounded at its top surface to offer a smoother contact surface to the user. The above dimensions preferably are the internal dimension, rather than the outer dimension provided by the chamfer.

Preferably the feet of the pallet are provided such that the short side window width is greater than 210 mm when measured at the underside of the top. More preferably the short side window width is about 250 mm, or between 230 mm and 260 mm.

Preferably the pallet is a quarter pallet. Preferably it has only four feet.

Preferably the top has length and width dimensions of about 600 by 400 mm, or more specifically about 598 mm by 398 mm. Typically the length will be between 597 mm and 603 mm and the width will be between 397 mm and 403 mm.

The feet may have a length as measured from the underside of the top to the soles of the feet not exceeding 85 mm. For example, that length may be about 83.5 mm. However, in preferred embodiments that length is longer, e.g. about 103 mm, as in the prior art.

Preferably the feet extend downwards from the underside of the top by no more than 110 mm.

Preferably the width of the feet measured across the short length of the pallet, when measured at the underside of the top, does not exceed 80 mm. More preferably it is about 70.4 mm, about 68.9 mm or between 65 and 75 mm. It can have other widths too, e.g. about 92 mm, as in the prior art.

Preferably the spacing to the sides of the pallet from the uppermost side of the feet as measured at the underside of the top is about 4 mm or between 6 and 7 mm. It can be longer or shorter than that. In preferred arrangements, however, it is between 2 and 7 mm. Most preferably it does not exceed 9 mm.

Preferably the distance from the rear of the rear leg measured at the intersection thereof with the underside of the top to the rearmost edge of the pallet is between 2 and 10 mm, and most preferably it is about 7 mm, or between 6 and 8 mm. Most preferably it does not exceed 12 mm.

Preferably the front feet have a scooped-out portion towards their front, top, regions, and thus each front foot has a recessed top front relative to the front base region (or the toes of the foot). Preferably this scoop is a radiused scoop. Preferably the radius is a radius of about 80 mm. Alternatively it is an angular scoop. This scoop or recess provides an increased surface area for engagement by a tine or fork of a fork lift or tray in front of the leg at the underside of the top, thus increasing handleability using automated or mechanical machinery.

Preferably the scoop or recess recedes relative to the front wall of the front foot at its base by a distance of at least 25 mm, and more preferably by a distance of up to 50 mm. Other arrangements may have the recess receding relative to that front-most part of the foot, as found at the sole of the foot, by at least 12 mm at the underside of the top, potentially with an increasing degree of recessing between the underside of the top and the sole of the foot, usually at the area to be found relatively adjacent the underside of the top, i.e. at or before the $1^{st}$ third of the length of the leg. For example, that additional recessing may be an additional 5 to 20 mm of recessing, thus providing a total recess of at least 17 mm, and preferably at least 19 mm. This recessing can be created through curves or angular elements of the feet, preferably that extend to either the top or bottom of the leg, or to the underside of the top, so as to provide a load resistant structure.

In typical arrangements, the front of the front feet have an aperture for receiving, or for allowing passage therethrough, of the toe of a foot of a pallet being stacked thereon.

Preferably the depth of the top of the pallet is no more than 40 mm. In a preferred arrangement it is about 37 mm deep. Dimples or gripping elements may extend above the upper plane of the top, i.e. the support surface, e.g. by 1 or 2 mm, thus extending the upper surface to about 39 mm above the underside.

Preferably the underside is ribbed with crossing reinforcements. Those reinforcements preferably define a lower plane that defines the location of the underside. The ribs can also define further planes, e.g. above the underside but below the support surface. Preferably these planes are parallel, although one or more such plane may be angled relative to the underside or topside thereof. Preferably they are parallel to the support surface, with further planes being defined which are angled relative to the support surface or the underside, or preferably both.

Preferably the sides of the feet are tapered. Preferably the two sides of the feet define an included angle of about 10°. Preferably the sides of the feet, or perhaps just one of the pairs of front or rear feet, additionally define planar members that are parallel to one another. Preferably they extend generally parallel to the sides of the top of the pallet. For example they may be on the front part of the sides of the front feet. More preferably, however, the sides of the feet are predominantly tapering to encourage stackability.

The combination of the angle and the length of the legs can be chosen to alter stacking height arrangements for pallets of like form such that when two or more such pallets are nested together, the stacking height can be increased or reduced. A longer leg would potentially induce a higher stacking height. Likewise, a narrower angle would potentially induce a higher stacking height.

Preferably the angle is no less than 9°. Preferably a stack of 10 such pallets has a height between 580 mm and 670 mm, although it could be higher or lower. Preferably it is no more than 734 mm, which is the height of stacked prior art pallets according to FIGS. 1 to 4.

The present invention also provides a stack of pallets as defined above, wherein ten such stacked pallets have a nested height not exceeding 700 mm. More preferably the height does not exceed 670 mm. Preferably the nested height of ten such pallets is between 580 mm and 670 mm. This stacked height is usually measured as the height of the lowest 10 pallets in a stack of 20 pallets to minimize variance due to compressing depths. Alternatively the measurement might be taken after loading the uppermost pallet in a stack of 10 pallets with a uniform mass of 50 kg or a loading of 500N so as to compress the legs into one another with a predetermined loading.

Preferably the pallet or pallets are each provided with grooves along an edge thereof for defining banding locations. These banding locations will be of benefit when the pallet is loaded with a product, which product is then secured onto the pallet using one or more banding strap. Products may be goods themselves, or packaged goods or containers therefor. They can also be boxes or shells for receiving such goods or packages and containers.

The grooves are preferably approximately 20 mm wide, or at least 20 mm wide, and preferably no more than 40 mm wide. They may have rounded ends, or tapered sides. The grooves may have preferred widths of between 24 and 37 mm. The grooves are preferably about 2.5 mm deep. Preferably they have a radiused surface against which the banding will lie. Preferably that radiused surface has a radius of about 2.5 mm.

Preferably the groove is provided at a lower edge of the top. Preferably at least one groove is provided on each of the sides. Preferably at least one groove is provided on each of the front and rear edges of the pallet. Preferably two or three such grooves are provided along each side. Preferably just one is provided on each of the front and rear edges of the pallet. Preferably three grooves are provided on each of the sides.

One or more groove may be provided on or within an edge recess of the pallet, such as an edge recess for receiving a tab of a product stacked thereon. Preferably the edge recess is T-shaped to receive a T-shaped tab. Tabs are often provided on products that get stacked onto these pallets, which tabs descend from a bottom side or edge of the product for engaging into or onto the edge recesses. The product may thus be secured to the pallet using the tabs.

Preferably the grooves are located in a position that lies out of alignment with the feet such that a banding strap using the groove will not foul against the feet, i.e. the strap will pass to the side of the foot. Preferably at least some of them are located close to such an alignment, but still out of alignment such that the strap or straps will pass close to one or more of the feet. For example, the strap should desirably pass within 1 to 10 mm of the foot, or no more than 30 mm therefrom, if located against the nearer edge of the groove to the respective closest foot.

Preferably the areas featuring the grooves are reinforced side portions, or reinforced end portions, such as by having reinforcement ribs extending from adjacent parts of the edges of the top within the underside part of the top. These assist with resisting any edge compression that might be imparted on the sides or ends when the banding strap is tightened.

Preferably a pair of grooves is located on the pallet such that there is one groove on either side of the pallet in the front half of the pallet in a location located in front of the front legs.

Preferably a pair of grooves is located on the pallet such that there is one groove on either side of the pallet in the rear half of the pallet in a location located in front of the rear legs.

Preferably a pair of grooves is located on the pallet such that there is one groove on either side of the pallet in the approximate center of the sides of the pallet Preferably a pair of grooves is located on the pallet such that there is one groove on either end of the pallet in the approximate center of the ends of the pallet.

Preferably one or more of the pairs of grooves is arranged in a lower edge of that side or end, in an edge reinforcement flange.

Preferably one or more of the pairs of grooves is arranged in a lower edge of that side or end, that lower edge having an edge reinforcement flange, and that side or end additionally having a second reinforcement flange above the first.

Preferably the pallet comprises one or more overwrap gripping members. Overwraps typically take the form of shrink wrap, cellophane or cling film and are usually of a very thin web material and they wrap around the product and the pallet so as to hold the product on the pallet. This may be in addition to, or instead of, webbing straps.

Preferably the pallet comprises more than one type of overwrap gripping member.

A first type of overwrap gripping member may be in the form of a hole provided in a foot, e.g. in the side of the foot, or in a side or in a front or rear edge of the pallet. The hole would be for receiving a free end of an overwrap web, or for tucking a portion adjacent such a free end therein so as to facilitate the threading of the free end through the hole.

A second type of overwrap gripping member may take the form of a slot or cut out in a wall of the pallet. It may likewise be provided in a side of a foot, but more preferably it is in a side or front or rear edge of the top of the pallet, e.g. in a lower edge of such a side or front or rear edge.

The slot or cut out may be serrated along an edge thereof, or along all edges thereof. It may be double or multi-ended, e.g. with two or more overhangs. Most preferably it is either a single overhanging slot with a single serrated edge, or a double overhanging slot without a serrated edge.

The slot may take the shape of a serrated sickle or hook. In another embodiment it may take the shape of an anvil or a wide swallow-tail or dove tail.

The slot may be edged with a reinforcement flange.

Additional reinforcement may be incorporated into the sides or edges of the top, or within the underside of the top, to provide additional strength to any cantilevered elements formed by the slot.

Preferably the slot has a tapering, or narrowing depth, or serrations, such that an overwrap, as it is pulled into the slot, will be gripped or secured. If bifurcated, one or both of the tines of that fork may be tapering or narrowing, or serrated.

The gripping member may comprise a part of a logo, such as an arrow shape within an outer arrow shape. With the gripping member being a part of a logo, the presence of the hole, slot or cut-out may be less obvious, i.e. it might be partially concealed or less apparent by virtue of the presence of the rest of the logo around it.

The gripping member may comprise an array of teeth formed in or on a wall of the pallet. For example, there may be a plurality of serrations formed in a part of the side, ort a part of the front edge or a part of the rear edge of the pallet. Preferably the teeth are in a section of ribbing provided on the pallet.

The present invention also provides a method of wrapping a pallet with a product thereon, comprising providing a pallet as described above, wrapping the product onto the pallet using a shrink wrap, cellophane wrap or cling film wrap with the wrap overwrapping the product and wrapping around the underneath of the top of the pallet, an end of the overwrap being gripped by using one or more wrap gripping member provided on the pallet.

The wrap gripping member may be any one or more of the above described overwrap gripping members.

Preferably the end of the wrap is a free end thereof, such as the final end used during the wrapping process.

The present invention also provides a pallet as described above wherein the feet are provided with their centers spaced at least 315 mm apart along a short edge of the pallet. Preferably they are spaced approximately 321 mm apart or approximately 317 mm apart.

Preferably the centers of the rear feet are approximately 38.5 mm, or approximately 41 mm, from the sides of the pallet. In preferred arrangements they will not be further than 41.5 mm from the sides of the pallet. These distances are measured parallel to the plane of the support surface, as shown in the drawings.

Along the sides (i.e. the long sides), preferably the centers of the rear legs are approximately 48 mm, or approximately 50 mm, from the rear edge of the pallet. Preferably it is no further than 52 mm from that rear edge.

Preferably the forward-most ground-bearing part of the feet, in a preferred arrangement a front lip or toe at the base of the front legs, is approximately 90 mm, or approximately 94 mm, from the front edge of the top of the pallet. Again this is a measurement taken in a plane parallel to the support surface. Preferably it is no further forward than 80 mm therefrom and no further backward than 100 mm therefrom. The foot-print relative to the top, along with the spacing therefrom in the vertical direction, governs the stability of the pallet assuming that the feet are substantially rigid. Preferably the feet are substantially rigid, and by manufacturing them from polypropylene they generally will be.

Preferably the whole pallet is made of polypropylene. Other materials are also useable, however.

Preferably the whole pallet weighs less than 2 kg. Preferably the weight is about 1.79 kg, about 1.8 kg, about 1.85 kg, or between 1.7 and 2 kg.

Preferably to provide rigidity to the top, e.g. along the long sides or short edges, or both, a plurality of reinforcement flanges are provided, for example a lowest flange at the bottom edge of those sides or edges, and a second flange spaced above that first flange. The flanges may be internal—extending inwardly within the underside—or external—extending outwardly from a planar member of the sidewalls. They may be continuous or selectively located around those sidewalls. Further, they may be supplemented with additional flanges at points or areas of stress concentration, such as at the slots or grooves, or near where the feet extend therefrom. In a preferred arrangement, one or more, preferably two, short flanges are arranged in the sides of the top above or in front of the line of intersection of the front of the rear feet with the top's underside. These add to the stiffness of the top to allow the pallet to carry a greater weight in its center without excessive flexure of the top.

Preferably the base or sole of each foot has a width, measured parallel to the short ends (front or rear edges) of the pallet's top, that is about 57 mm. Preferably the widths are no wider than 60 mm and no less than 55 mm.

Preferably the front and rear feet have a corresponding width dimension at their bases.

These measurements differ from those of the prior art pallet of FIGS. 1 to 4. The changed dimensions provide a more stable base, whereby products loaded onto the pallet can withstand greater angle inclinations without falling over than that achievable with the prior art pallet.

Preferably the height of the feet and top combined, i.e. the height of the pallet, does not exceed 145 mm, and more preferably it is about 140 mm. Preferably the pallet is no shorter than 130 mm. The prior art pallet of FIGS. 1 to 4 has a height of 145 mm. A reduction in that height to say 140 mm improves the stability the pallet when loaded with a given product.

Preferably the sides and/or the front and rear edges of the pallet have recessed grooves or recessed corners extending upwardly from a point or line on the walls thereof and up through to the support surface. Such recessed grooves or corners allow product support members (or posts) extending below the underside of a product on the pallet to be accommodated at the sides, corners, or front and rear edges of the pallet for allowing a maximized area of the pallet to be utilized. Preferably the recessed grooves or recessed corners take the form of a recessed corner arrangement in each of the four corners of the pallet, each one wrapping around one of the four corners of the top of the pallet. Additional recessed grooves may be provided in the sides or front and rear edges of the pallet.

The recessed corners may be formed by extending reinforcement flanges of the sidewalls around the top edges of the support surface, but excluding such flanges in the areas of the corners. They may also be excluded elsewhere around the top edges, such as in the middle parts, e.g. if edge recesses are provided.

Preferably the recessed groove or recessed corner arrangements have flanged or shouldered bottoms. This is to provide a lower stop for a product support member or post to bear against. Preferably the flanged or shouldered bottoms are ribs, or continuations of ribs, provided at the bottom edge of the top.

Preferably the recessed grooves or corners are recessed between 2 and 5 mm from the outside surface of the sides or front and rear edges of the top. In a preferred arrangement they are recessed a depth of about 3 mm. Alternatively they may be flush with the planar member of the sidewalls, but recessed relative to at least one of reinforcement ribs or flanges that extend outwardly from that planar member.

Preferably the recessed grooves or corners extend up to 40 mm along a side or along a front or rear edge of the pallet. More preferably they extend about 35 mm, or about 38 mm, along the sides or edges. They may be bounded by tapering edges or tapering flange members, thus being wider than that at their outermost part, but being no wider than 4 mm at their receiving surfaces for the product support members (or posts). For the recessed corner arrangements, they preferably extend about 35 mm, or about 38 mm, along both a side and an edge of the top of the pallet.

For the recessed corner arrangements, preferably the recess is rounded around the corner of the top, e.g. with a 2 to 6 mm radius, or preferably a radius not exceeding 10 mm. This rounding allows a folded cardboard support member or post to be accommodated within the recessed corner arrangements even if the inside part of the cardboard is bunched in a bulging manner as a result of its fold.

The present invention also provides a method of stacking a product on a pallet comprising providing a pallet as defined above and loading a product thereon, wherein the product has posts or support members extending below a base thereof that sits on the support surface of the pallet, and wherein the pallet has recessed grooves or corners sized to accommodate those posts or support members, the method comprising the step of stacking the product onto the pallet such that the posts or support members are engaged into the support grooves or corners.

Preferably the posts or support members engage against both the recessed grooves and end formations provided thereon, such as flanged or shouldered bottoms.

Preferably the recessed grooves are provided at the corners of the pallet.

The pallet of the invention may comprise five pairs of slots in the support surface, wherein the five pairs comprise two slots in a first pair that extend parallel to the short sides of the pallet, and which are located centrally relative to its adjacent short side, and spaced inwardly therefrom, and four further pairs of slots extending parallel to the long sides of the pallet, three of those four pairs being co-aligned in their respective pairs so as to define two lines of slots, each line of slots being spaced inwardly from that long side by a first distance, and the fourth of those pairs being spaced apart in opposing positions also near those long sides, but spaced further from those long edges than the other three pairs.

Preferably that fourth pair are located centrally relative to the long sides.

Preferably these five pairs of slots have chamfered or rounded upper edges at the interface with the support surface. These chamfers or roundings make the insertion of tabs, as may be formed on products for stacking onto the pallet, more straightforward.

Preferably the chamfer is at an angle of about 45°.

Preferably the chamfer or rounding extends to a depth of between 1 and 4 mm, and most preferably it extends to a depth of about 2 mm.

The slots are preferably approximately 60 mm long and approximately 6 or 9 mm wide. They may be between 40 and 90 mm long and between 5 and 12 mm wide. Preferably the slots are generally rectangular. They may have rounded internal corners.

Preferably additional slots are also provided. Alternatively the additional slots may replace one or more of the pairs of other slots.

Preferably the pallet comprises a set of four first additional slots, or a set of curved or non-rectangular slots, one adjacent to each edge or side of the top. Preferably they are spaced between 5 and 12 mm from that respective edge, and most preferably about 8.2 mm therefrom. Preferably they are centrally located relative to those sides or edges. These slots or holes or apertures typically are provided to accommodate tabs descending from the base of a product, and are preferably adapted such that they lock or hold such tabs within the slots, holes or apertures.

Preferably they take the form of a skewed generally rectangular shape—skewed by having a middle portion of the rectangle displaced sideways, e.g. by an arcuately displaced central portion. The resulting shape may be described as a humpback bridge type shape, or a flattened capital omega shape (.OMEGA.). Other shapes are possible too. For example, the shape may have a flat bottom and a humped top, rather than having long sides that are generally parallel to one another.

It is preferred that these first additional slots define a tongue portion in a long side thereof. That tongue portion extending laterally relative to the ends so as to restrict linear entry of long and wide tab therein. Instead the tab would preferably have to bend to be slotted into the slot. The tongue can then grip against the tab.

In place of the tongue, an alternative projection and preferably a recessed projection, may be provided. The recessed projection may be a similarly shaped tongue, or another shape, such as a rounded member, preferably a part spherical member, preferably a quarter sphere, preferably having its rounded surface pointing upwards and its flat bottom facing downwards. The recessed projection is preferably recessed below the product receiving surface of the pallet by at least 5 mm, and more preferably by about 9 mm.

Preferably the projection has an outermost tip, or an underside surface (e.g. the flat bottom), or both, located more than 15 mm, and preferably about 17 mm, below the product receiving surface of the pallet.

For the quarter sphere, it is preferred that its other flat face faces (or is formed integrally with) the sidewall of the pallet.

The nose of the projection or tongue may be associated with a further member formed in the opposite wall of the slot. In a preferred arrangement the further member is a tapered or angled leg. The further member may have a free end that extends to a plane that is in a vertical alignment with the nose of the projection or tongue, but which is located at a level lying below that nose.

With this additional or curved slot, a tab on an underside of a box—a box for stacking onto the pallet—can be encouraged to extend into this slot such that it will flex both around the projection or tongue, and against the further member, thus being held in place therein.

If the tab has an appropriately positioned hole, that hole can engage and lock onto the projection or tongue, or the further member.

Preferably the further member has a downwards taper that draws closer to the adjacent sidewall of the pallet as the further member descends from the product receiving surface of the pallet towards the underside of that top.

Preferably the further member has a flat underside arranged in the horizontal plane, i.e. parallel to that product receiving surface of the top of the pallet. Then, if the tab's hole is longer than that of the above option, it might instead engage under that flat underside. Two different tab hole arrangements are thus supported. Bear in mind though that just one of these projecting members might instead be provided, thus offering dedicated support for just one of the tab designs, although either design of tab would fit into the slot, and thus provide a degree of support for a box on the pallet.

Preferably the further member has an underside that is spaced from the plane of the underside of the top. Preferably it is spaced upwardly therefrom by about 5 mm Preferably the further member has a free end, e.g. at the end of the tapering surface. Preferably that free end is flat in the vertical plane. Preferably it is spaced from the inside of the sidewall of the pallet by about 7 mm. Preferably the spacing gives it a spacing of no more than about 1 mm from the vertical plane that is incidental with the tip of the projection. This allows the thickness of any tab to be accommodated with some, but not an excessive amount of, compression of the structure (e.g. corrugation) of that tab. This is preferred to maintain a reasonable amount of resilience in the tab.

Preferably the projection has an upper surface that is radiused in the vertical transverse (relative to the slot) direction. Preferably the radius is about 6 mm.

Preferably the projection aligns generally with a recessed shelf of the slot, which shelf is preferably recessed by about 9 mm relative to the product receiving surface of the pallet.

Preferably that shelf has a thickness below it, which thickness is integral with the further member.

The further member preferably extends perpendicular to a leading edge of the shelf—towards, yet downwards relative to, the projection.

Preferably the leading edge is curved, so as to define the curved shape of the slot.

Preferably the shelf is supported by reinforcement flanges. Preferably there are at least four such reinforcement flanges. Preferably they are each tapered such that the top of the slot is wider at the product receiving surface of the pallet than at the plane of the leading edge of the shelf.

Preferably the plurality of flanges take the form of vanes and they each preferably extend perpendicularly from a vertical long-side wall of an adjacent slot. Preferably such adjacent slots have four vertical walls surrounding the perimeter of the slot, so as to form a generally rectangular shape. Preferably these vertical walls each have chamfered tops, which tops are preferably angularly chamfered, e.g., at a 45° angle or rounded. The vertical walls may extend the full depth of the top of the pallet, or only part of that depth, or combinations thereof—each slot need not have the same depth for each of their vertical walls, and those depths do not need to be constant depths around all parts or sides of the slots.

Preferably these additional slots are located in the middle of the sides (and ends) of the top of the pallet, such that there are two pairs of them each pair on different opposing sides of the pallet.

Preferably they also align with sidewall tab receiving slots, e.g. T shaped slots, thus being part of a two or three slot arrangement (e.g. if provided just with the T shaped slots or just with the inwardly spaces slots, or for the three slot arrangement—both of those other slots).

The present invention also provides a combination of a pallet as defined above with a product for stacking, or having been stacked, thereon, the product having a tab descending therefrom for passing, or having been passed, into a slot in the support surface of the pallet, the slot having a tongue and the tab having a slot, the tongue and slot being such that either the tongue can extend into the slot upon the tab being passed into the slot, or the tongue is extending through the slot if the tab is already so passed.

Preferably these first additional slots are each aligned to one of four other paired slots. Preferably they are positioned closer to the edges or sides of the top than those other paired slots. Preferably those other paired slots are about 30 mm from the edges or sides, as it may be, of the top of the pallet.

Preferably the pallet comprises a further pair of slots located adjacent the center of the support surface. Preferably they are located either side of long sides of a hand access hole positioned at the middle of the support surface.

Preferably the edges of the various slots or holes are all chamfered or rounded.

Preferably the support surface additionally comprises a plurality of additional holes or slots of different lengths and shapes. Preferably these have at least three different lengths and/or shapes, and preferably they are not provided for a specific product engaging function. These additional holes more preferably are provided to lighten the weight of the pallet, without reducing the load bearing capacity of the pallet below its target load capacity, that being 250 kg in a preferred embodiment. The target load capacity may in another embodiment be higher or lower. One preferred load capacity is 300 kg.

The support surface may additionally include dimples or spots on its upper surface for improving the grippiness of the support surface. Preferably these spots or dimples extend above the support surface by between 0.5 and 2 mm. Preferably the majority of them are each individually no longer, or wider, than 3 mm. They can be provided in one or more arrays across a substantial part of the support surface, for example between the holes or slots. The arrays may be comprised of multiple arrays of similar or common dot-spacing, e.g. with spot center distances of around 9 to 12 mm or may include arrays of mixed density spotting, including smaller areas of higher-density spotting, e.g. areas of spots with spot center distances of around 3 to 5 mm.

Preferably the holes and slots are located in the support surface or top such that they avoid overlying the ribbing structures provided in the underside of the top. The holes and slots thus provide an uninterrupted hole through the top of the pallet. This may allow the holes to be used by loading apparatus at the underside of the pallet-loading apparatus in the form of prongs or fingers that can retract through the holes or slots to lower a package or product onto the pallet.

Preferably the ribbing structures in the underside of the top provide stiffness to the top structure. This can be achieved through a crossing webs or ribbing, potentially also with diagonal webs or ribs to inherently stiffen the overall structure.

In preferred arrangements, the pallet can support a 250 kg load while the pallet is sitting on the ground, and also while the pallet is being lifted by one or more tine or fork of a trolley or forklift.

Preferably the ribbing structures comprise a plurality of different heights of ribbing such that certain areas are reinforced with deeper webbing than other parts. This can provide the defining of multiple underside planes.

Preferably the webbing criss-crosses the underside of the top in a manner such that no repeating array design within the webbing is presented on the underside of the pallet across more than 50% of the available area of the underside of the pallet. The areas occupied by the feet are areas that are not available.

Preferably at least one of the feet or legs, and preferably at least one of the pairs of feet or legs, comprises one or more groove down one or more of its side walls. This groove preferably extends the full length of the leg to increase the rigidity of the leg.

Preferably there are two such grooves down one or more of the side walls.

Preferably the or each groove is generally V shaped in section.

Preferably the or each groove extends substantially over the full length of the leg, i.e. if not over the full length of the leg. For example, it may extend up to the toe, but not beyond.

Preferably the or each groove defines an additional area for the support surface, i.e. at the top of the pallet. The or each additional support surface may have a generally V shaped profile, and preferably the point of the V extends inwardly relative to the most adjacent edge of the support surface. Preferably, therefore, the grooves are in an outer wall, or an outer side wall of the respective leg, i.e. relative to the set of legs.

Preferably the or each groove, or the or each point or additional area, extends to a position within the support surface that lies approximately 15 mm from the most adjacent edge of the support surface. Other arrangements may have it extending a distance of between 11 and 20 mm from that respective most adjacent edge.

By the provision of these grooves, not only is the leg stiffened; additionally, the additional area provided in the support surface will be able to support an edge of a package located on top of the pallet, whereby that edge can be supported over a greater extent of its perimeter, for example by being able to sit on the additional area as a ledge within the support surface.

Such grooves may be provided on all legs, but are preferably just provided on the front pair of legs.

Preferably the support surface around its general perimeter region—e.g. within a margin lying within the last 15 mm of its edge, or a region lying between 11 and 20 mm from that edge, for example, has no circumferential length providing an unsupported length therealong, e.g. spaced greater than 6 mm from the extreme edge of the support surface, that is longer than 100 mm, or more preferably longer than 80 mm or 70 mm. Thus, a perimeter edge of a package located on the pallet will always be substantially supported, i.e. it will not be having an unsupported length therealong that exceeds 70, 80 or 100 mm. This is even though the apertures formed in the top of the support surface of the pallet, e.g. by virtue of the elongated front legs, has an overall length of maybe 150 mm—the additional ledges provided by the top or tops of the groove or grooves split that aperture length at least into two, and more preferably at least into three—there may be, for example, two additional support surfaces along that length formed by two grooves, as per the illustrated embodiment of FIGS. 43 to 64.

Preferably the pallet's top has a display or box attachment feature on one or more of its sides (front or back, or left or right sides), comprising a vertically arranged, inwardly recessed, sidewall slot with an open top for receiving a descending tab from a display package for locating on the pallet, the sidewall slot further having one or more engagement tooth or member extending laterally across the short width of the slot, i.e. perpendicular to the respective side. Preferably the tooth or member has a tapered side and a flat bottom, thus resembling a saw-tooth in vertical plan parallel to the longitudinal length of the slot. The tooth or member can thus grip the descending tab, or engage in a hole thereof if such a hole is provided. The sidewall slot is preferably open to the sidewall save for its recessed ends.

Preferably pairs of these sidewall slots are provided, e.g. one on the left side and one on the right side, or one at the front and one at the back. More preferably two are provided on each of the left and right sides (long sides) of the pallet.

Preferably the sidewall slot, or each sidewall slot, is closed at its bottom by the pallet's reinforcement rib (or the upper one of said ribs, e.g. where two such ribs are provided).

Preferably the recessed part of the sidewall slots have a width of about 4 mm, thus accommodating a tab made from a sheet material (e.g. corrugated cardboard) having a thickness of up to 4 mm, without crushing the corrugations in those edge portions.

Preferably there is a plurality of engagement teeth or members, preferably in an array—e.g. 5 of them. Preferably they each extend further than the width of the edge portions of the sidewall slots, e.g. 5.2 mm or more than 5 mm, although preferably they extend less far than the reinforcement ribs.

Preferably each pallet accommodates an RFID tag (radio frequency identification tag), and preferably each RFID tag is unique, whereby pallets can be recognized individually via their RFID tags.

BRIEF DESCRIPTION OF THE DRAWINGS

These and other features of the present invention will now be described in greater detail with reference to the accompanying drawings in which:

FIGS. 10 to 42 show various details and features of the pallet of the present invention, and uses therefor;

FIGS. 70 to 82 show various details and features of that further alternative embodiment of pallet, with FIGS. 80 to 82 being sections through the pallet and being scalable with respect to a standardized quarter pallet having a width of 399 mm and a height of 140 mm.

DETAILED DESCRIPTION OF THE PREFERRED EMBODIMENTS

Figure 1:
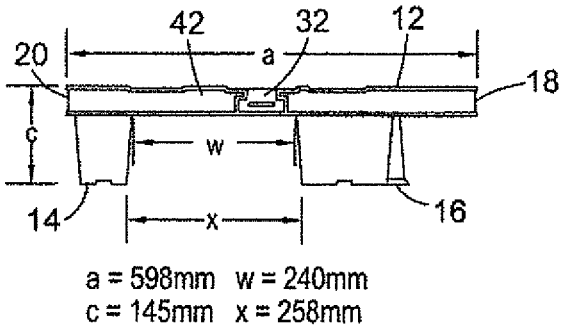
Fig. 1 (Prior Art)
FIGS. 1 to 4 show a prior art quarter pallet.
Figure 2:
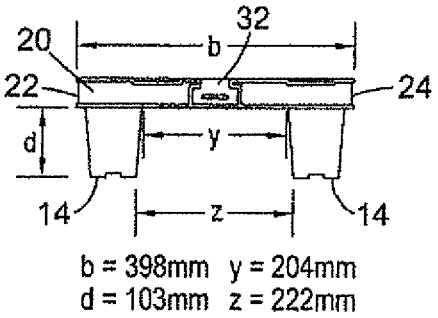
Fig. 2 (Prior Art)
Figure 3:
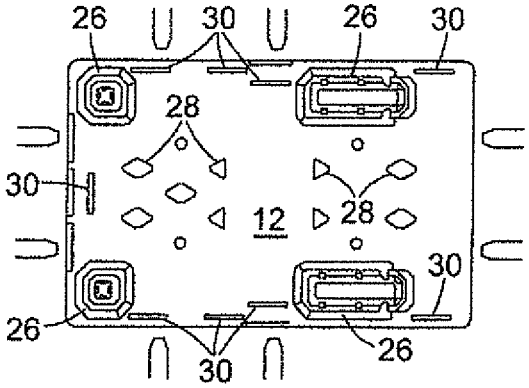
Fig. 3 (Prior Art)

Referring first of all to FIGS. 1 to 4, a prior art pallet is shown. As can be seen, the pallet 10 has a top 42 with a product support surface 12 for receiving products thereon and four feet 14, 16 which for convenience can be referred to as a pair of rear feet 4 and a pair of front feet 16. The feet 14, 16 are for supporting the pallet on the ground, or for use during stacking. The pallet 10 also has a front edge 18, a rear edge 20, two sides 22, 24 and four first apertures 26 in the support surface 12 for receiving feet 14, 16 of a similar pallet 10 when one is stacked thereupon. See FIG. 16. As can be seen therein, this arrangement for the pallet allows multiple pallets 10 to be stacked in a nesting arrangement.

Still referring to FIGS. 1 to 4, additional details of the prior art pallet can also be seen. They include holes 28 and slots 30 in the support surface 12, and T-shaped edge recesses 32 in each of the front edge 18, the rear edge 20 and the two sides 22, the latter being for receiving T shaped tabs that selectively can descend from the base of a product tray or package that gets loaded onto the pallet 10. Such tabs allow a product tray or package to lock onto the pallet, or at least to be held more securely, thus increasing stability of the pallet/product tray structure.

The feet 14, 16 in this prior art pallet are each different, with the two front feet 16 and the two rear feet 14 being symmetrical within their pairing about the longitudinal axis of the pallet. The front feet, however, differ from the rear feet in that the rear feet are smaller than the front feet—they have similar widths and lengths (heights) to one another, but they have different depths—the front feet are deeper than the rear feet in that they extend across a longer length of the support surface than the rear feet.

Figure 4:
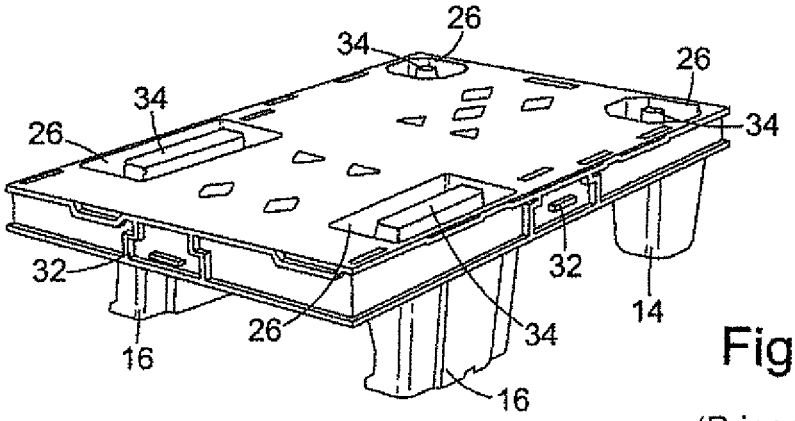
Fig. 4 (Prior Art)
Figure 5:
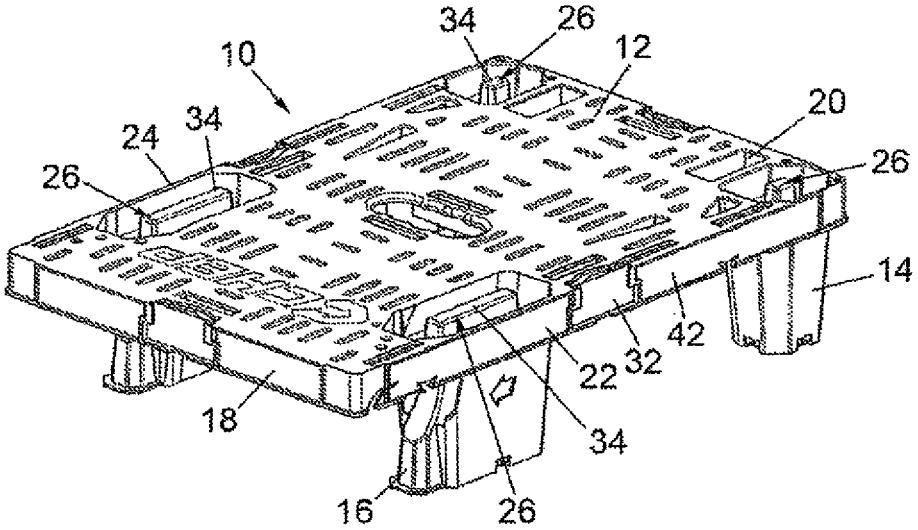
FIGS. 5 to 9 show a quarter pallet of the present invention.

The feet all have an ascending portion 34—an inner member (see FIG. 4). That ascending portion 34 is roughly centered relative to the respective first aperture 26, that aperture 26 being at the top of the respective foot 14, 16. The feet 14, 16 also have second apertures in their bases—i.e. at the soles of the feet—for receiving ascending portions of another pallet when the pallets are stacked together. This feature is further described in earlier applications, such as EP0523737, EP0669258 and DE59206159.0, the entire contents of which are each incorporated herein by reference.

The tops of the ascending portions align with the plane of the support surface so as to increase the support area of that support surface across a useful proportion of the area occupied by the first apertures.

These features of the feet, and many other features of the prior art pallets, are of beneficial use to both the prior art pallets and the pallets of the present invention. The present invention, however, includes modifications and improvements that offer additional functionality or improved functional characteristics, or other benefits.

Features common to both the prior art and the present invention, or corresponding or similar features between the two, will be marked with corresponding reference signs.

Figure 6:
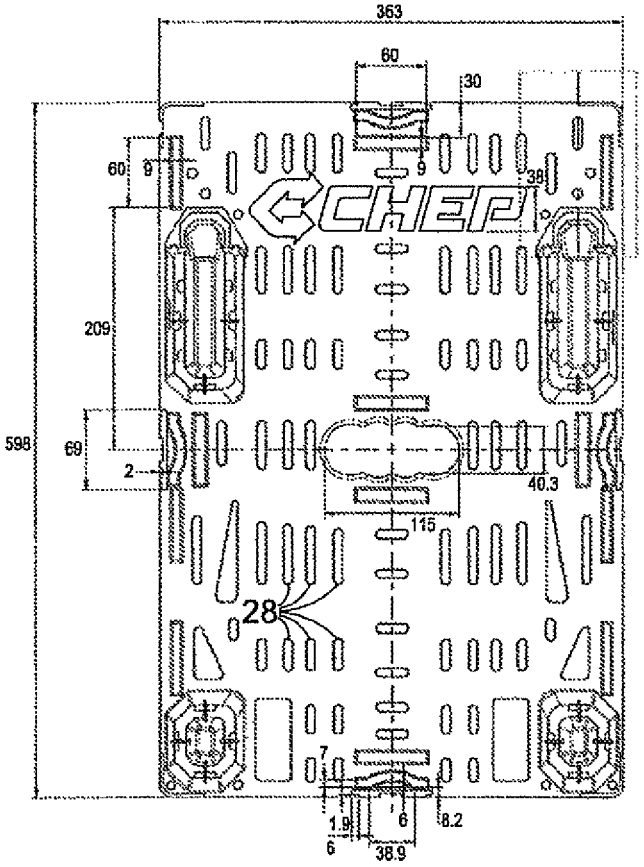
Figure 7:
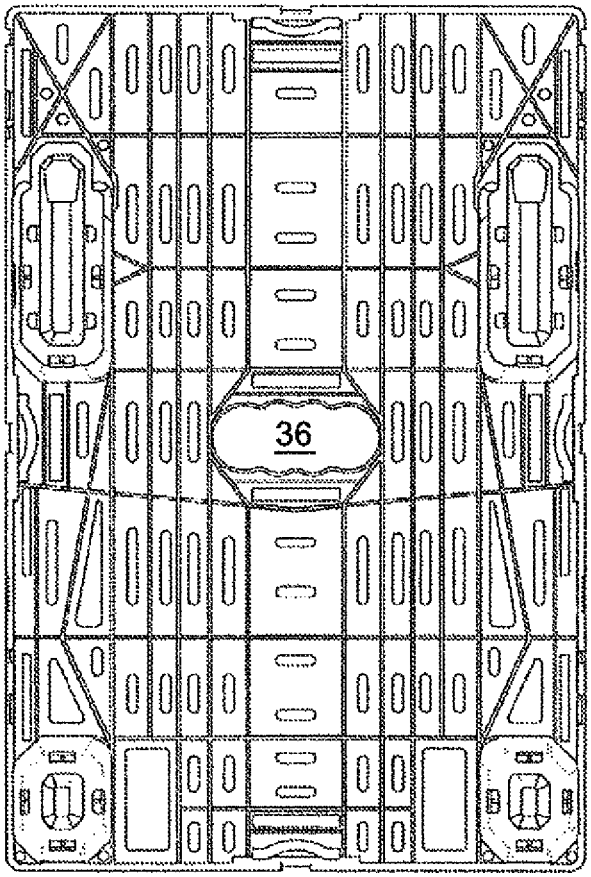

Referring first of all to FIGS. 5 to 8, a preferred arrangement for the pallet of the present invention is shown. This pallet 10 has a support surface 12, four feet 14, 16, a front edge 18, a rear edge 20, two sides 22, 24, four first apertures 26 in the support surface 12, each in registration with a foot 14, 16, and various other holes and slots also in the support surface. These other holes and slots will be discussed further below. Yet further there are edge recesses 32 (herein shown as T-shaped edge recesses) in each of the sides 22, 24 and each of the front and rear edges 18, 20. There is also an ascending portion 34 in each of the apertures 26. In many respects, therefore, there are significant similarities between this new pallet and the prior art pallet of FIGS. 1 to 4. However, the size and positions of the first apertures and the ascending portions contained therein have changed. Further, the number of (or the positions of or the designs of) the holes, the slots and the edge recesses either differ or are supplemented, or both, compared to the prior art arrangement. For example, as can be seen in FIG. 6 there are a multitude of additional slots and holes 28. Further, the apertures 26 are narrower across the width of the pallet 10. These changes or additions will be described in greater detail below.

The pallet illustrated in FIGS. 5 to 8 has a length of 598 mm, a width of 398 mm and a height of 140 mm. The length and width conforms to the prior art size, but the height is shorter. Additionally, the feet are moved compared to the prior art and as a result the pallet will not nest with the prior art pallet. In particular, as described below, the legs are narrower, they are spaced farther apart and closer to the sides/edges of the top, and the top is thinner. This makes the pallets lighter. They also stack lower, and have additional wrap gripping members and tab holding members to increase functionality.

In addition, to ensure adequate strength, despite the thinner top, the design of the ribbing is changed. In particular, although a criss-crossing structure is still provided, it now has areas of irregular shapes whereby regular arrays of ribbing are no longer provided across the underside of the top. Instead the ribbing is designed to offer adequate stiffness and strength and yet improved lightness, and while still offering improved flexibility at the support surface by having the various holes and slots for engaging with tabs of products stacked thereon.

Figure 10:
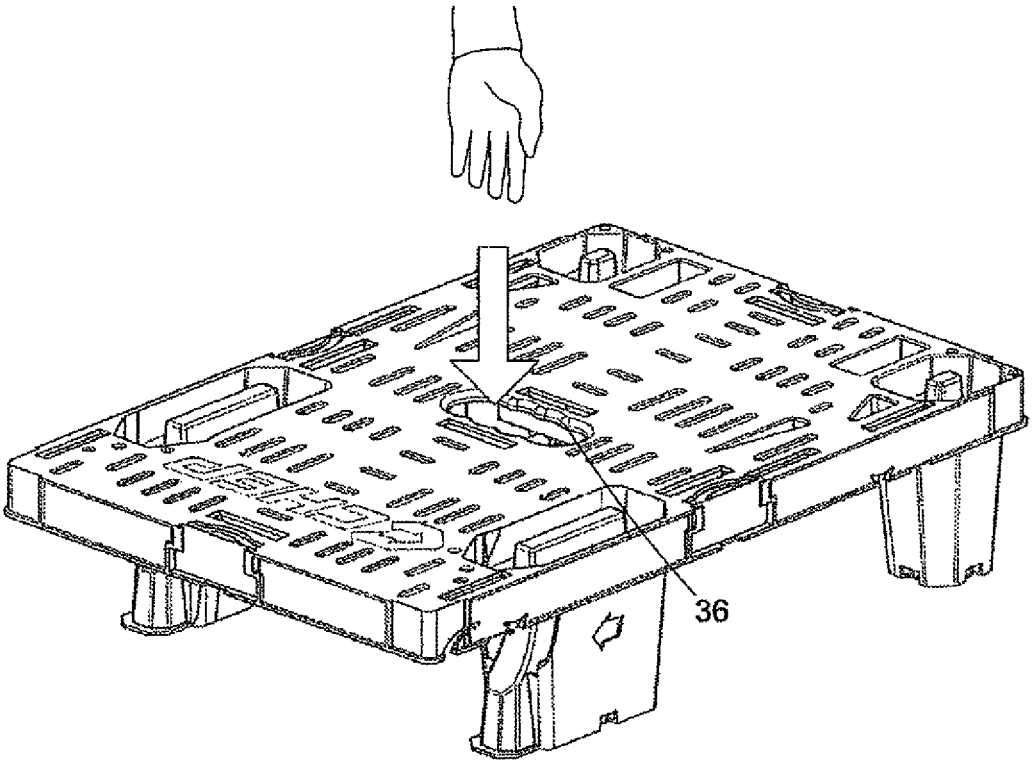

Referring next to FIG. 10, a change compared to the prior art pallets is the addition of a hand access hole 36. In this embodiment it is located at or towards the center of gravity of the pallet, or at or near the center of the support surface 12. As shown in FIG. 10, this hand access hole 36 provides an easy means for an operator to handle the pallet 10. In previous quarter pallets, especially those made of an injection molded plastic, holes may have been provided at or near the central portion of the pallet, but they were never large enough for a user to insert all four fingers of his hand therethrough. By providing the central hand access hole towards the center of the pallet, or at or near the balance point of the pallet, the pallet can very easily be grasped by the user for carrying it or for unloading it from a stack of pallets. Before now, in the absence of such a hole, pallets were handled by their edges—a typically two-handed operation. Given that a user may have to handle or maneuver hundreds of pallets in a shift, the increased ease of handling provided by this hand access hole is of significant benefit.

It can be observed that the prior art arrangement shown in FIGS. 1 to 4 has no equivalently useable hand access hole.

The size of the hole is preferably no smaller than 100 mm long by 40 mm wide, and is more preferably about 115 mm long and about 40.3 mm wide, as shown in FIG. 6. Such hole sizes are able to accommodate approximately 99% of hand sizes according to recognized standards.

The width at the finger grips is preferably about 45 mm.

The hole is preferably positioned at or near the center of gravity to improve balance upon handling the single pallet therewith. The optional finger grip details can be provided on one or both long sides of this hole, or neither.

A rounded end wall can be provided at one or both short ends thereof, or at neither end.

A rounding of the finger grips or ends of the hole can remove or reduce stress concentrations, thus prolonging the life of the pallet, and can make the product more comfortable to use.

The edge of the hole is preferably chamfered or rounded to offer a smother engagement surface to the user. This also can make the product more comfortable to use.

The hand access hole also can provide a conveniently large hole through the middle of a stack of pallets to allow them to be secured together when stacked.

Referring next to FIGS. 8, 9, 11 and 14, preferred arrangements for the feet 14, 16 are disclosed. FIGS. 12 and 13 show a prior art foot arrangement and the locations at which the measurements for the dimensions of FIG. 14 are taken. FIG. 14 illustrates in a table preferred dimensions both for the prior art pallet of FIGS. 1 to 4 and for the preferred embodiment of the present invention.

Figure 8:
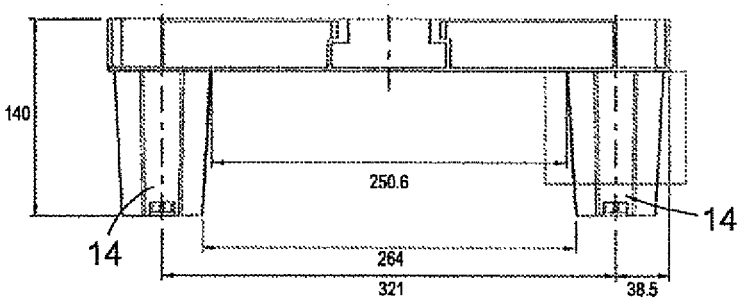

As can be seen from the table of FIG. 14, a short side window width (dimension Y)—measured between the bases of the two feet at the underside of the top of the pallet, has been increased in the new pallet arrangement from 204 mm more than 230 mm, and preferably to about 250 mm (250.6 mm in FIG. 8). This increased dimension facilitates the mechanized handling of pallets of the present invention compared to those of the prior art, such as when using a trolley featuring one or more tine or fork. Due to the wider gap (a wider window) a wider tine or fork (or wider spaced tines or forks) can be fitted into that gap without causing the tine(s) or fork(s) to engage or press against the feet (which would cause an instability, especially if it results in the pallet not sitting down tight against the tine(s) or fork(s)). This alteration improves the potential stability of the pallet on that or those tines or forks, e.g. during maneuvering of the pallet around a store such as a supermarket, or when loading or unloading pallets from a lorry.

This widening of the window is even achieved without increasing the overall width (measured side to side) of the pallet. This is done by making the feet 14, 16 narrower.

The feet's displacement from the sides of the pallet may remain the same, although preferably the displacement from the sides 22, 24 is reduced perhaps by between 1 and 5 mm.

Figure 9:
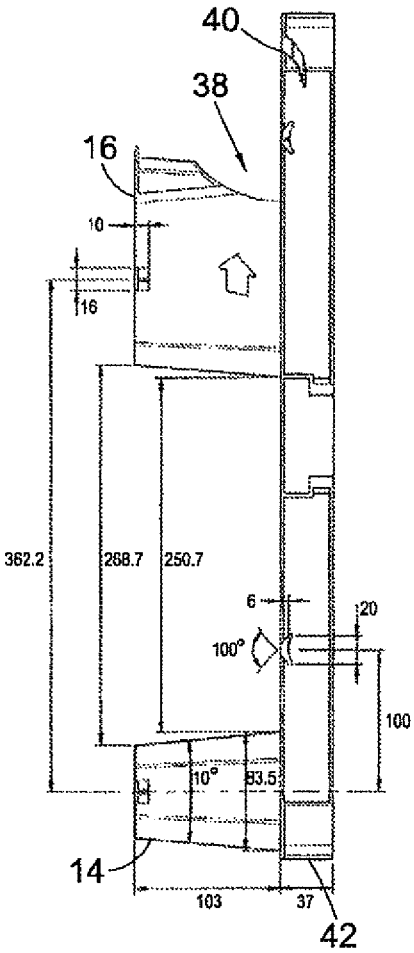

In addition, the long side window is also increased, in the preferred case from 240 mm to 245 mm or more, and preferably to about 250 mm (250.7 in FIG. 9). This can likewise improve handleability of the pallet when using a tined or forked trolley. This is preferably achieved by moving the rear legs slightly rearwards, i.e. perhaps by between 1 and 5 mm. The rear leg may also be made thinner. Preferably the front leg is not moved forwards compared to the prior art of FIGS. 1 to 4.

From the side view of FIG. 9, it can also be seen that the front foot 16 is also now slightly L shaped in that it has a cut out 38 in its front face, towards the top thereof. This cut out 38 improves the ability for the front of the pallet to be lifted with a fork or tine of a trolley in conjunction with the space provided more rearwardly between the two feet 14, 16 shown in FIG. 9. With a longer forward surface 40 on the underside of the top compared to that of the prior art, the front fork is less prone to slip off the pallet, whereby increased stability is provided in transportation and maneuverability of the pallet 10.

The present invention therefore provides easier handling and positioning of tines, forks of pallet maneuvering devices such as trolleys or forklift trucks. Further, due to the increased space between the legs, and at the front of the front foot, there is a reduced chance of impact of those tines or forks against the feet, thus reducing product damage to the pallet and accidental disturbance of the pallet and the goods loaded thereon. Yet further, these increased spaces for the tines or forks allow the use of a wider variety of single fork or double fork arrangements—ones with wider forks or wider fork spacings, both on the short side and on the long side, something that was previously difficult without making the pallet uncomfortably unstable thereon.

Figure 15:
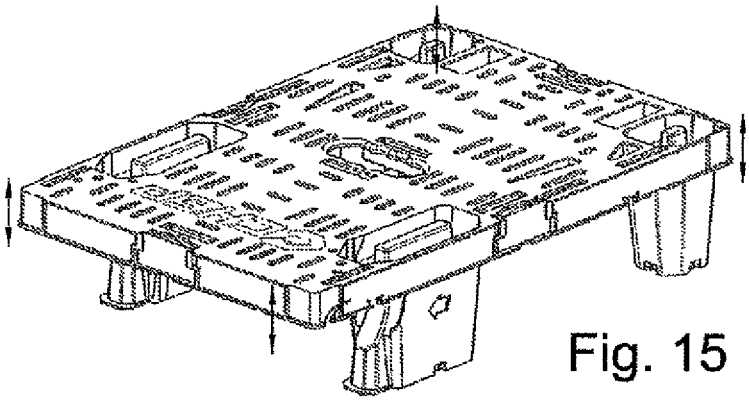
Figure 16:
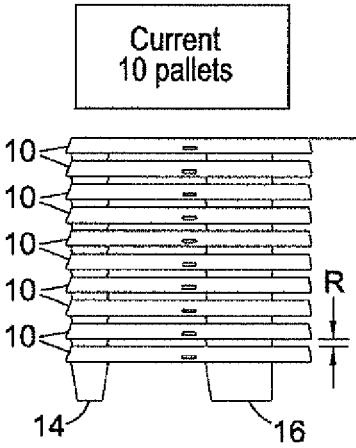
Figure 17:
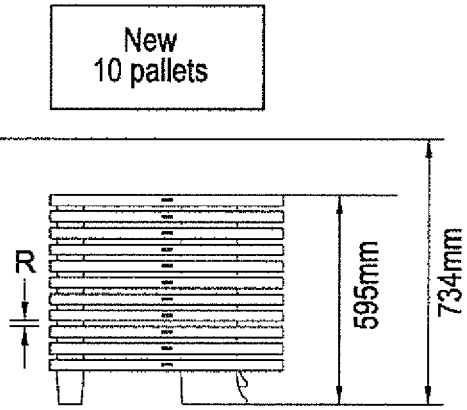

The height of the feet or the depth of the top 42 of the pallet 10 (as shown) or the height of the two combined have also been shortened. The pallet is now about 140 mm high rather than 145 mm high. This shorter arrangement, as shown in FIGS. 15 to 17, allows a reduced stacking height to be achieved upon nesting multiple pallets together. The angle of the walls of the feet also achieve an advantageous reduction of stacking height. In this preferred arrangement, a nested stacking height is reduced by perhaps 20% compared to the prior art pallets of FIGS. 1 to 4. As shown in FIGS. 16 and 17, the stacking gap between adjacent pallet tops is reduced from 23.5 mm (in the prior art) to 13.5 mm. See measurement R. In accordance with the invention, it is preferred that measurement R is no more than 20 mm.

Figure 17B:
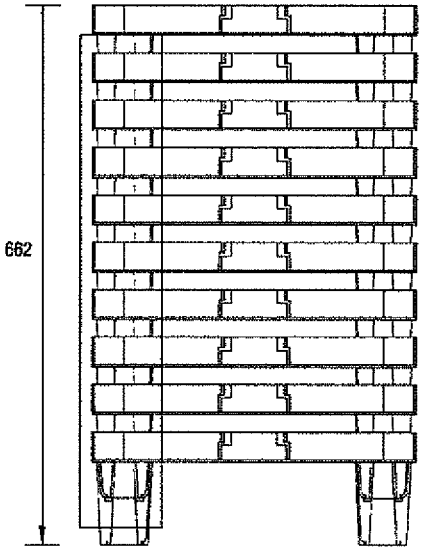
Figure 18:
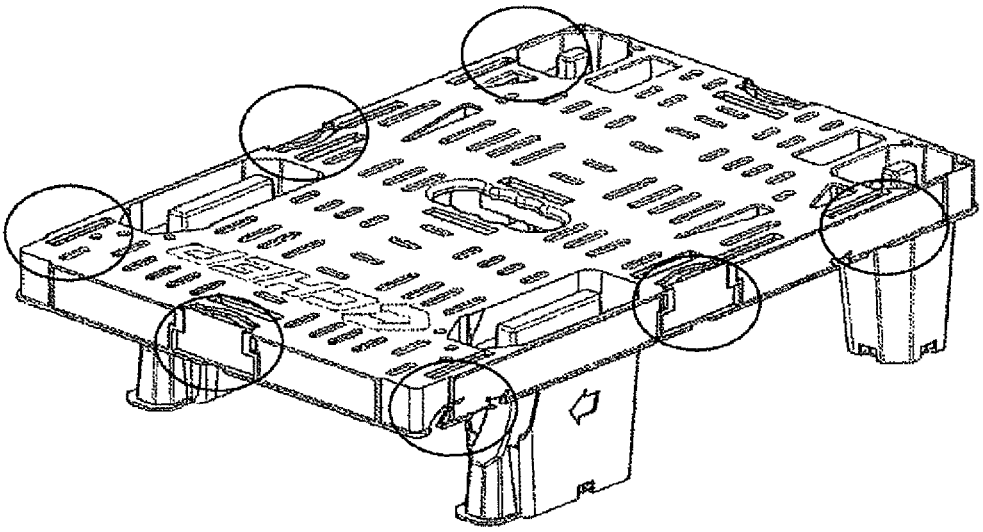
Figure 19:
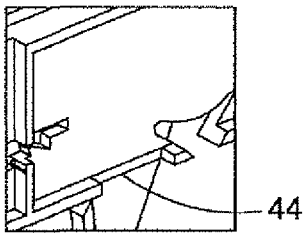
Figure 20:
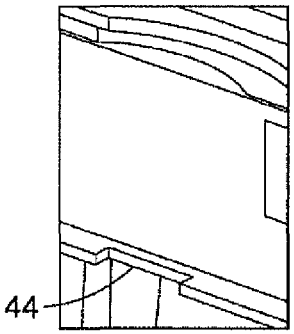
Figure 21:
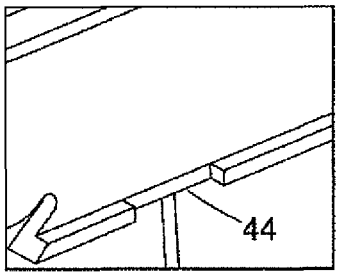
Figure 22:
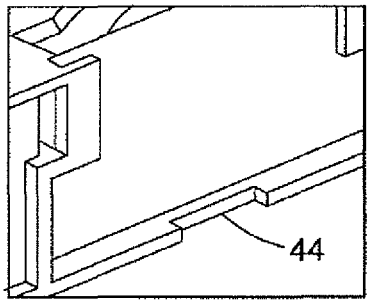

With the pallets of the present invention, whereas ten prior art pallets would stack to an approximate height of 734 mm, pallets of the present invention will stack to a height of between 700 and 550 mm. FIG. 17 shows a height of 595 mm when ten are stacked on top of each other, whereas FIG. 17B shows a stack height of 662 mm. This reduced stacking height allows safer maneuvers by a user since the user for the same number of pallets would not have the same height of pallets. In particular, when destacking pallets, the user would not need to reach so high. Further, there is a reduced storage space requirement for both storage of the pallets, and during transportation of the pallets, e.g. when they are being collected, stored or transported back to base.

Referring next to FIGS. 18 to 22, a further advantageous feature of the present invention is shown. In these Figures, it can be seen that in many positions around the front and rear edges, and the sides of the support surface structure, banding locations are incorporated into the edge of the pallet 10. These features take the form of grooves 44. In this embodiment there are eight banding locations in total. There are three on each long side and one on each short side. Although they might have different sizes, in this embodiment they are all the same. They each have a length dimension of about 20 mm and a depth dimension of about 2.5 mm. The band-receiving surface is also shown to be radiused, which is a preferred feature to help to prevent the band from being damaged by the groove. In this embodiment the radius is about 2.5 mm, and the radiused portion underwraps the top 42.

These banding locations can be provided in alternative sizes, such as larger or smaller grooves, and with different radiuses and depths to width ratios.

The banding locations are provided to allow product on the pallet to be banded or strapped thereonto using strapping bands, such as those known in the art. Such strapping bands have been commonly used in the past with the prior art pallets. However, since there was no banding locations provided on the pallet for locking those banding straps in position, they had a tendency to slip on the pallet if not secured tightly thereon, thus potentially allowing the product on the pallet to become loose, or worse it could cause the pallet or products to be damaged. With the grooves discussed above, the banding cannot slip laterally off the pallet and thus the banding strap and the product to be retained securely in place.

It is preferred that banding locations be provided out of alignment relative to the feet, as per the illustrated embodiment. For example, banding locations may be provided on the long sides 22, 24 near each corner of the pallet 10, in opposing pairs, but with one pair just forward of the rear feet 14 and the other pair just forwards of the front feet 16. Further banding locations may also be provided. For example, as shown, an opposing pair can be provided roughly at the center portions of the two sides 22, 24, front edge 18 and the rear edge 20. Preferably these co-align with other product retention mechanisms, such as slots in the support surface, or edge recesses, which may be for receiving tabs that descend from the packaging of the products.

Preferably there are 8 banding locations in total as illustrated.

Many banding machines are automated and the specific locations of the banding locations can assist or hinder the operations of these automated machines. By locating the banding locations away from alignment with the feet the automated banding machines can carry out their banding operation more easily. Manual banding is also made easier. The banding is often an important step since the banding prevents the product from moving on the pallet during transportation, thus reducing product damage. Allowing this to be done unhindered is thus advantageous.

Likewise, since the banding can be located in the banding locations, incorrect banding is unlikely to occur due to slippage of the banding during the application or transport thereof, thus minimizing product damage from incorrect or moving banding.

Additionally, having a certainty of where the banding will be applied allows the packaging designers, or the product loading designers, to appropriately design the loading or packaging so as to have appropriate strengths or reinforcements in the right positions to withstand the banding upon the packaging or the product being banded onto the pallet.

Referring next to FIGS. 23 to 27, further features of the present invention are disclosed, each of which concerns the assistance with the application and retention of shrink wrap over the product and pallet—such shrink wrap is commonly used to secure the product to the pallet. This is often an alternative to banding, although both can be applied if desired. These figures illustrate web retention features that are added to a pallet. These help to solve a commonly encountered problem, namely the securement of the end(s) of the wrap. This problem is encountered both at the start and the finish of that wrapping process since the wrap might not want to adhere to the product or the pallet, or may fail to retain itself against the wrap at the end. To assist with this, the present invention provides mechanisms for facilitating the gripping of the start or finish of the length of wrapping material.

Referring to the example of FIG. 23, which Figure is a detail of a circled part of FIG. 25, and a first form of web gripping member is shown. This gripping member is shown in one corner, but the feature may be provided in a single position, or in more than one position on the pallet, such as the two front corners, or two opposing corners, or all four corners of the pallet 10, or elsewhere along the sides or edges of the pallet 10, or even in the feet thereof. This first gripping member comprises a cut out with a curving, convex, serrated edge and a curving concave, non-serrated, opposing edge, with a tapering from its mouth to a narrowed throat. The serrated edge has a generally convex curve whereas the facing edge has a generally concave curve. The curves may be removed, or they may be varied. This cut out allows wrapping material to be located in it either at the start or the end of the wrapping process such that the material of the wrap bears against the serrations. The wrap thus is gripped by the serrations, although the wrap may equally grip against the taper or the edge of the cut out. This gripping member thus facilitates the commencement of the wrapping process, or it can be used for the end of the wrapping process to tie down the end of the wrap by passing the wrap into the slot instead at the end of the wrapping process. The serrations are non essential. Likewise the non serrated surface could instead be serrated.

Referring next to FIG. 24, an alternative or second gripping member 48 is provided. This gripping member can be positioned also along the side or front or rear edge of the pallet, and there can be one of them or more than one of them. In this example there are two of them on the side 24, and one is provided in a position that is spaced rearwardly from the first gripping member of FIG. 23. The other is provided in front of the rear foot. As with the grooves 44, this and the other gripping members are preferably non-aligned with the feet 14, 16 since usually the wrap is applied to the pallet in a manner to avoid overwrapping the feet.

This second gripping member 48 takes the form of a two-sided groove—it is shown to be anvil shaped. It may be a widened swallow tail or a dovetail instead. The groove 48 has a front recess 50 and a rear recess 52 and an narrowed opening 54. The narrowed opening 54 allows the shrink wrap to be located into the groove, but makes it harder for it to come out again. The wrap can be pulled into either the front or rear recess 50, 52, and it can secure an end of the wrap either at the start or at the end of the wrapping process, subject of course to it not being covered during the wrapping process! It provides an alternative gripping member for gripping an end of the wrap and can be in addition to the gripping member of FIG. 23, or it may be instead of it. For some people it may be the preferred form.

Referring next to FIG. 26, another alternative or additional gripping member 58 is shown. This third gripping member 58 takes the form of a hole, here an arrow shaped hole, cut into the side of one of the feet, in this case a front foot. It is arrow shaped since it is part of the logo of the applicant. Other shapes can be provided such as round, square and other shapes, although it is preferred for there to be a convex point within the hole to grip a web that may be pushed therein. The arrow shape provides two such convex points.

This hole 58 is a hole into which the end of the wrap can be pushed, thus securing it.

Next, referring to FIG. 27, a fourth gripping member 60 is shown. This gripping member 60 is shown to be provided near, but forward of one of the rear legs and takes the form of a serrated surface. It is shown to be formed in an edge rim of the top 42—an edge reinforcement gives better rigidity to the side of the pallet 10. This is preferred, but it might equally be in an underside of the side, or in a front or rear edge. More than one of these can be provided, e.g. on opposing sides, or on each of the sides and edges of the pallet, or even in one or more of the feet. Its serrations can grip a wrap and thus provides an additional gripping member therefor, either for a start of the wrap or for an end of the wrap.

As shown there are seven teeth, although more or less can equally be provided. Preferably the length of the group of serrations is more than 20 mm but less than 50 mm.

Figure 28:
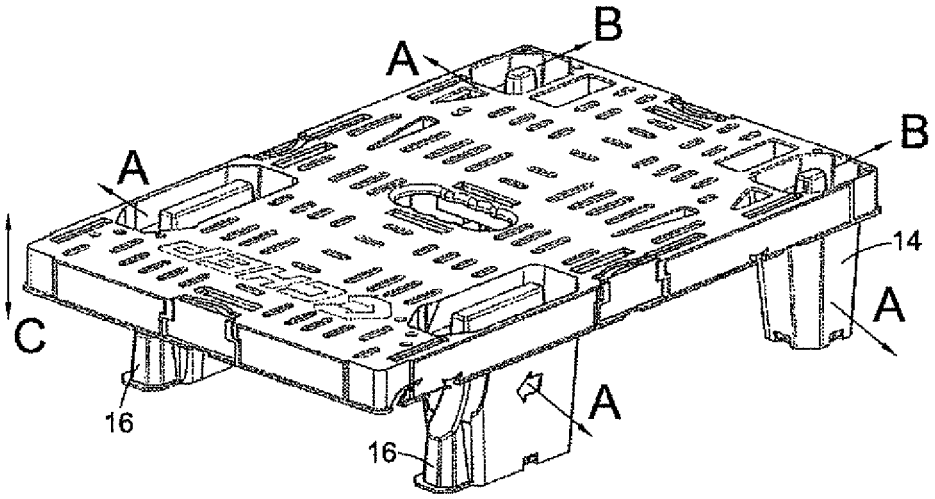
Figure 29:
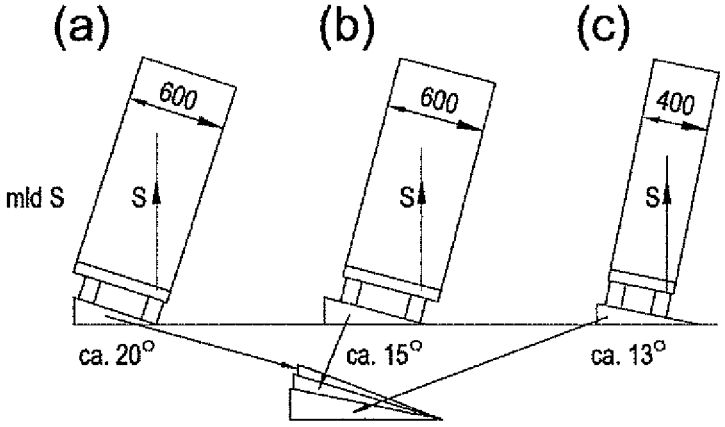

Referring next to FIGS. 28 and 29, a further differentiated feature of the present invention over the prior art is that the four feet 14, 16 are arranged in a manner such that their bases are spaced more outwardly relative to the sides 22, 24 and rear edge 20. No change is indicated relative to the front edge since to do that would interfere with interactions with tines of a forklift. These changes are to improve the overall stability of the pallet when bearing a large load on the top thereof. As shown in FIGS. 29A through C, the stability of the pallet is such that the pallet loaded with a product having a central center of gravity and a 400 by 600 by 1200 mm dimension, and a mass of 250 kg, will remain stable through a rearward elevation of 20°, a frontward elevation of 15° (as in the prior art) and a sideways elevation of 13°. Lower loads with a central center of gravity will have better stability angles and higher loads with a central center of gravity will have a less stable capability, but the above preferred minimum stability is desired to be achieved by pallets according to this aspect of the present invention.

In addition to moving the external edges of the feet outwardly relative to the side and rear edges, the overall height of the pallet 10 has been reduced. This further helps to achieve the above desired characteristics since the lowering of the load will also improve the stability of the pallet/load combination.

Referring back to FIGS. 12 and 13, in the prior art pallets the size of the top, like that of the preferred embodiments of the present invention is a length (dimension a) of approximately 598 mm and a width (dimension b) of approximately 398 mm. The overall height (dimension c) of the pallet in the prior art has been is approximately 145 mm, with the length of the feet (dimension d) being approximately 103 mm. This gave the top a height of about 42 mm—the difference between dimensions c and d. In the pallets of the present invention, however, that top height (or depth) will be preferably less than 42 mm, and as shown in FIG. 9 it is preferably about 37 mm. The height of the feet, however, is still preferably about 103 mm to ensure compatibility with existing lifting equipment.

One additional advantage of the lower top 42 is a weight reduction in the pallet. For example, a pallet of the present invention may have an overall mass as low as 1.6 kg, although typically it will have a mass of about 1.8 kg, whereas the prior art pallets had an overall mass of about 2.2 kg. This represents a 27% reduction in weight. Additional holes and improved reinforcement members in the underside of the support surface, and the reduced dimensions of the legs in section further contribute towards the weight reduction. It is preferred that the pallet weighs less than 2 kg.

It has also been observed that it is very unusual for the prior art pallets to be loaded up to their full maximum load capacity of 300 kg. Accordingly, a weight reduction is achievable by producing the pallet of the present invention with a maximum load rating of 250 kg rather than 300 kg. 250 kg still meets all known user requirements in terms of maximum loading capacity, and the reduced mass of the pallet will be seen to be of benefit to those clients, who inevitably need to maneuver them in their depots. Therefore a weight saving, and improved stability is of benefit to users. Further, this is achieved without losing the recognized advantages of the prior art pallets, namely the display attachment features of the prior art, the nestable feature of the prior art for storage, the four way entry arrangement (since the four sides are open), the single piece injection molding arrangement—which reduces the likelihood of failure and damage through use, and the use of polypropylene in the pallet's manufacture, which is a strong durable and fatigue resistant material ideal for the reusable pallets of the present invention, and compatible with RFID systems frequently used in the transport logistics industry. Metal pallets, or pallets with metal in them can interfere with such RFID systems.

With regard to the movement of the feet relative to the top, it is preferred that the short side has the four feet moving outward (i.e. towards the sides 22, 24) by up to 10 mm compared to the prior art product disclosed in FIGS. 1 to 4 and along the long sides the two smaller rear feet are moved outwards by up to 5 mm, i.e. towards the rear edge 20. The front feet, however, preferably do not move outward relative to the long side (i.e. they do not move towards the front edge 18).

In addition, the overall pallet height as a result of the reduction in the depth of the top and potentially also the length of the feet) is preferably about 5 mm.

The above mentioned and discussed changes lower the overall center of gravity of the pallet, and thus the load thereon. Further, that when combined with the repositioning of the feet improves the overall unit load stability and thus increases the tipping angle of the pallet when loaded compared to the prior art of FIGS. 1 to 4, and thus reduces the risk of loads falling over during handling thereof.

The various gripping members or grooves or slots or cut outs are all preferably integrated into the top as part of the molding progress. Likewise the feet are preferably integrally formed. It is understood, however, that the various gripping members or grooves or slots or cut outs could alternatively be cut into an existing pallet as a retrofit. Further the feet could be formed separately and bonded thereto.

Figure 30:
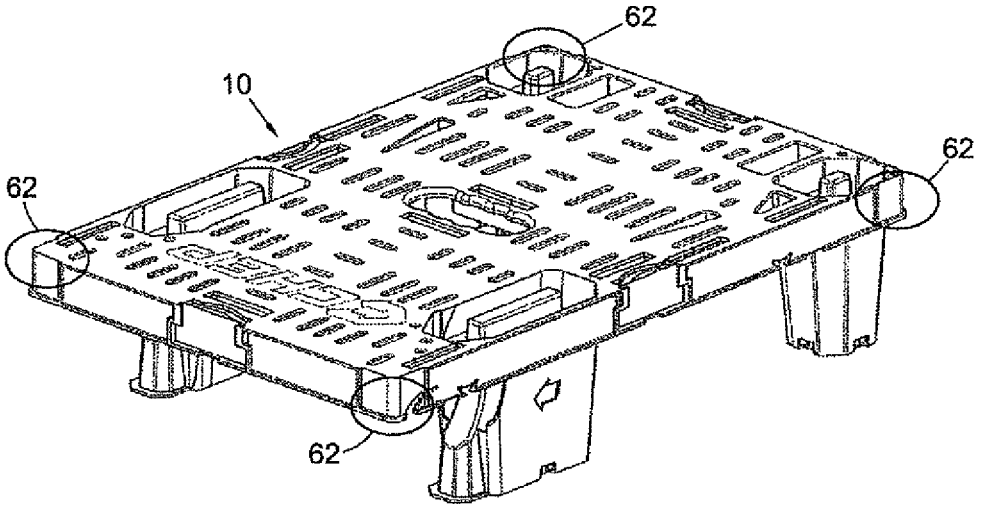
Figure 31:
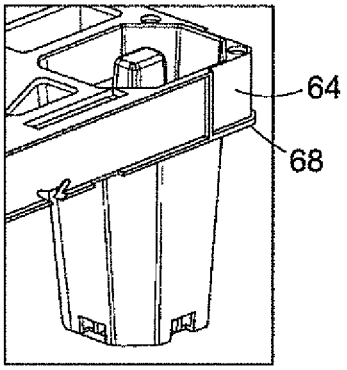
Figure 32:
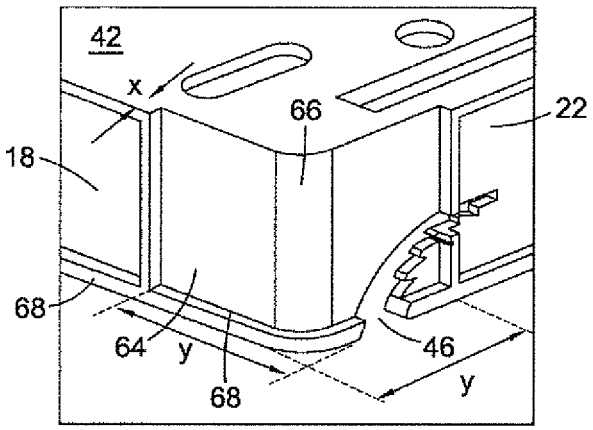

Referring next to FIGS. 30, 31 and 32, a further aspect of the present invention is illustrated. As can be seen in FIG. 30, each of the four corners 62 of the pallet 10 are provided with recessed corner arrangements 64. Two such recessed corner arrangements are shown in greater detail in FIGS. 31 and 32. FIG. 31 represents a rear corner, whereas FIG. 32 represents a front corner. The front corner 32 is shown to be interrupted by the first gripping member 46. However, it is plausible that a pallet may be provided with just the recessed corner arrangement 64 rather than additionally the gripping member 46, or vice versa.

The recessed corner arrangement 64 is shown to have a rounding 66 at its corner. Further, it is recessed relative to the front edge 18 and side 22. This recess is preferably approximately 3 mm deep and the sides extend perhaps between 25 and 40 mm away from the corner of the pallet—see dimensions x and y in FIG. 32. A preferred distance is about 35 mm or about 38 mm.

A reinforcement ribbing is also provided at the bottom edge of the top 42. This ribbing 68 is to provide added strength to the top 42 and in this preferred embodiment that ribbing 68 continues past the recess so as to define a bottom wall for the recessed corner arrangement 64. Although optional, this preferred continuance of the ribbing, or when no ribbing is provided on the outer side of the top, a step or shoulder provided at the bottom of the recessed corner arrangement, is preferred since it provides a shoulder or surface onto which corner posts or other retention means used for certain product packaging can rest. Such corner posts and the like are typically made of folded cardboard and may extend below the primary underside surface of the product or package (i.e. the surface that rests on the support surface 12 of the top 42 of the pallet 10). As a result, the recessed corner arrangement provides guidance and support for such corner posts. These posts may be a preferred option for heavy and complex displays where they are to be transported on these pallets.

The rounding 66 of the recessed corner arrangement is also preferred in view of the fact that the corner post is typically made of folded cardboard. Such folding can produce a degree of rounding or bunching of the material of the cardboard at the inside corner thereof, and the rounding 66 allows such bunching to be accommodated.

FIG. 31 shows an equivalent recessed corner arrangement 64 as provided towards the rear of the pallet 10. It likewise has ribbing 68 to form a shoulder onto which a corner post can rest or bear. It again preferably has an approximately 3 mm recess depth and sides extending approximately 35 or 38 mm from the corner of the top of the pallet 10.

Referring next to FIGS. 33 to 35 and FIGS. 36 to 40, the various attachment features for products to be carried on the pallet 10 are highlighted. These attachment features typically take the form of slots or grooves in the top 42 or such arrangements in the sides or edges of the pallet. Many of these are common to those found on the prior art pallets shown in FIGS. 1 to 4. However, a number of additional slots and other attachment features are provided in the present invention to increase the versatility of the pallet compared to that of the prior art.

The provision of the old slots are important to retain compatibility with the existing product or packaging platforms and displays. These were provided to improve the attachment of the product or packaging to the pallet for improving display retention and to reduce the risk of damage during transportation or display. The additional attachment features, however, increase the versatility of the pallet compared to that of the prior art by providing attachment features for alternative and new product or package arrangements.

Figure 33:
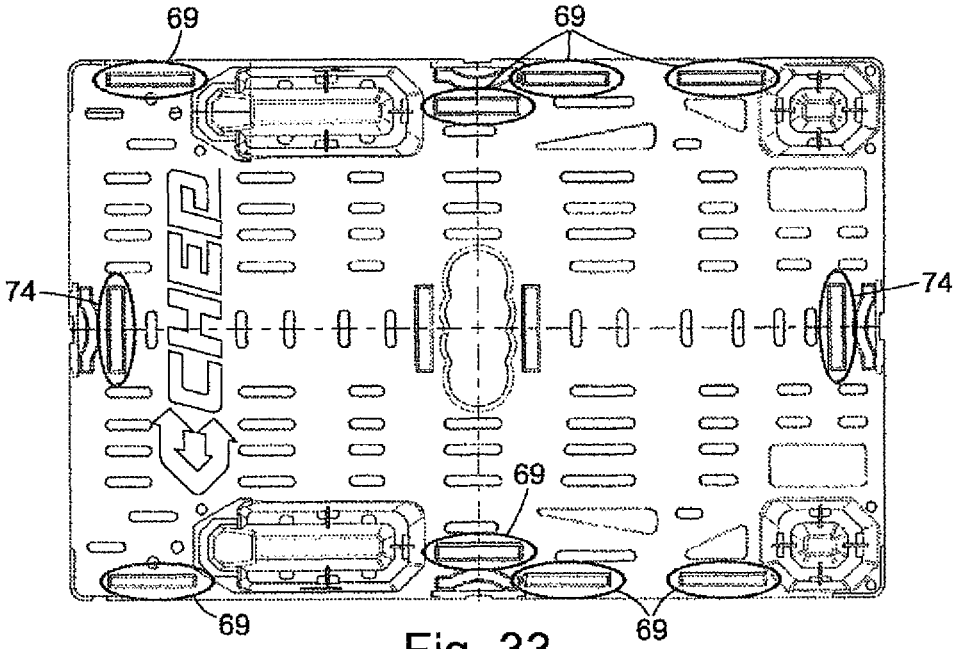
Figure 34:
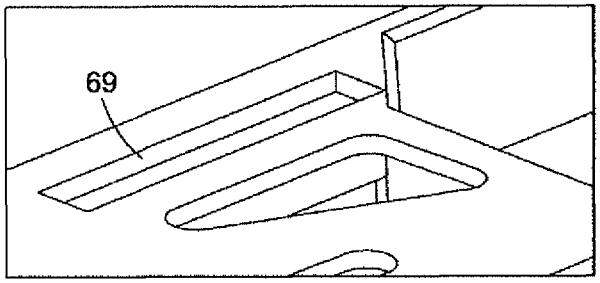
Figure 35:
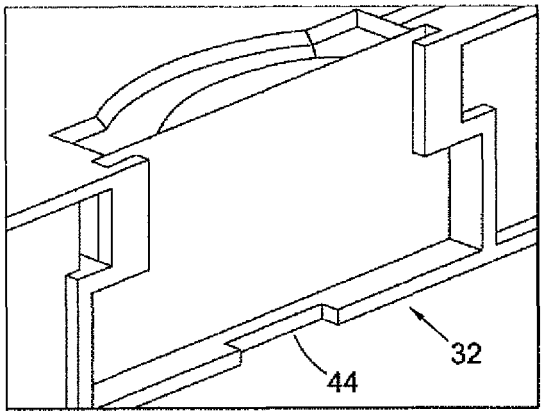
Figure 36:
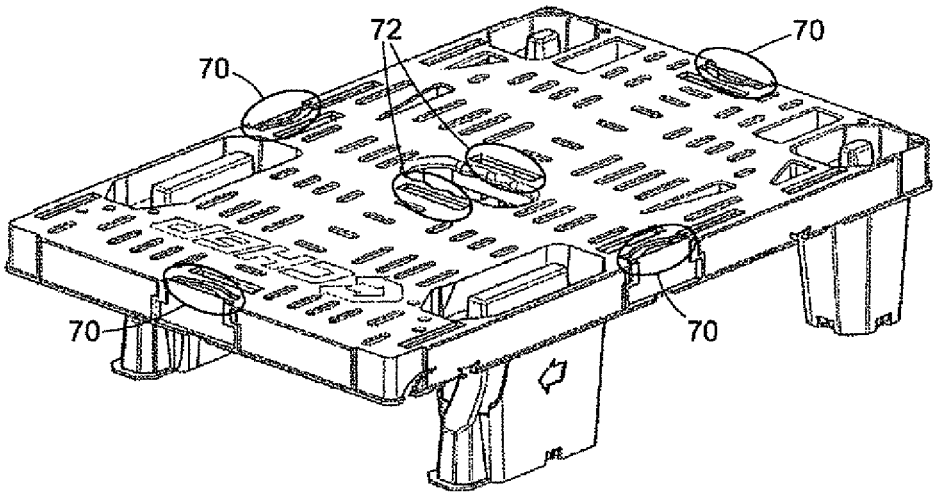

Referring first to FIG. 33, the ten highlighted slots are all comparable to the slots found on the prior art pallet shown in FIGS. 1 to 4. The pallet shown in FIG. 33 is rotated 180° relative to the pallet of FIG. 3, and thus it can be recognized that the positions of the various slots correspond. However, as shown in FIG. 34, a 45° chamfer is added to the top openings of the various slots. This improvement is to ease the installation of tabs on packaging into those slots. Preferably the angle is about 45°, and the depth of the chamfer is about 2 mm.

In addition the T slot or edge recess 32 provided in the sides 22, 24 and front and rear edges 18, 20 of the top 42 of the prior art are retained in the pallet 10 of the present invention—it can be seen that they generally correspond to those that can be seen in FIG. 4, although optimized radii have been added to improve its functionality or ease of use. A groove 44 has also been put at the bottom edge for use as a banding strap locator.

These features therefore still allow the pallet of the present invention to fully work with all the existing platforms and displays in use with the pallets of FIGS. 1 to 4, but improve the ease of attachment, improve the display retention and reduce the risk of damage during assembly.

Referring then next to FIGS. 36 to 40, various new attachment features are shown and highlighted. These new attachment features include four new slots 70 near the sides and edges of the top 42 and two display slots 72 provided either side of the hand access hole 36. The two display slots 72 are provided to cooperate with opposing slots 74 as found in the prior art and are for locating and holding one eighth size displays. Such one eighth size displays are sized such that two of them can be fitted onto the pallet since the pallet is a quarter pallet. Thus the one eighth size displays occupy approximately half the support surface of the pallet. They typically have dimensions of about 300 by 400 mm. These eighth display products are becoming increasingly popular and thus providing the additional display slot 72—one for each half of the pallet—allows one eighth displays to be retained on the pallet more securely than that which has been previously achievable in the past due to the lack of the additional display slots 72. Instead such displays were only ever able to be secured by a single display slot 74.

Figure 38:
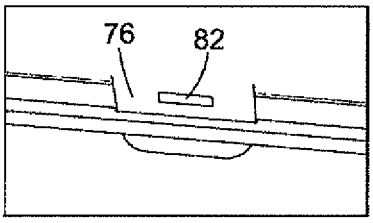

The mechanism for use of these slots is shown more clearly in FIG. 38. There it can be seen that a tab will descend from the base of the display, that tab 76 extending through the display slot 72, 74 so as to allow the display product to be located precisely on the pallet.

The display slots are preferably approximately 9 mm wide and have a length of approximately 60 mm. Some slots are about 6 mm wide instead. Slot widths may range from 5 to 12 mm, or more preferably between 5 and 9 mm, and the length can range from 40 to 80 mm.

Figure 39:
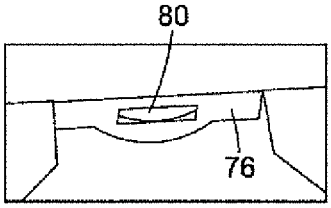
Figure 40:
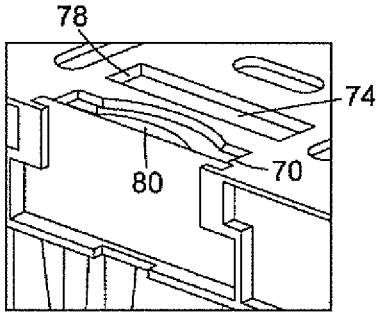

In addition to those new display slots 72, the new slots 70 are also provided. These new slots 70 are formed near the sides 22, 24 and edges 18, 20 of the pallet's top 42, and one is shown in greater detail in FIG. 40. The new slots 70 have a length and width generally corresponding to that of the display slots 72, 74. Further, in common with those other slots they have chamfered ends 78 and sides. However, whereas the other slots are straight, these new slots 70 have a central part that is curved so as to extend out of the line of the slot in an arcuate middle. That arcuate, displaced or curved middle is provided while still maintaining a generally constant width for the slot, i.e. about 9 mm, but the slot, rather than being straight, extends sideways relative to the longitudinal length of the slot by approximately 6 mm at its maximum. This forms a tongue 80 that can serve to lock a tab 76 within the slot 70, as shown in FIG. 39.

Other dimensions and shapes are possible too, although the provision of a tongue is useful even for other shapes, as will be explained below.

Figure 37:
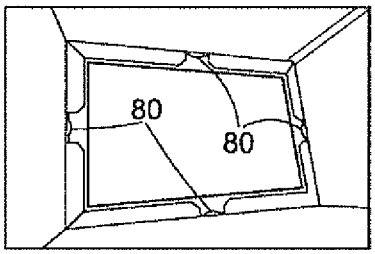
Figure 41:
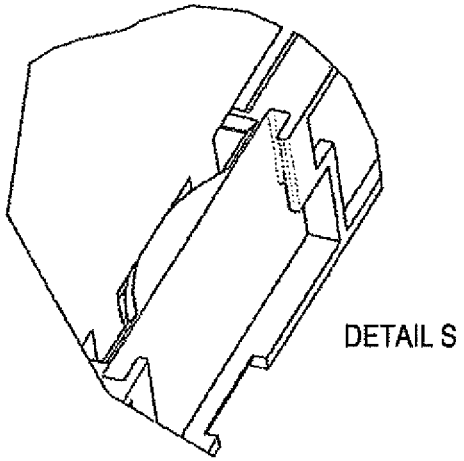
Figure 42:
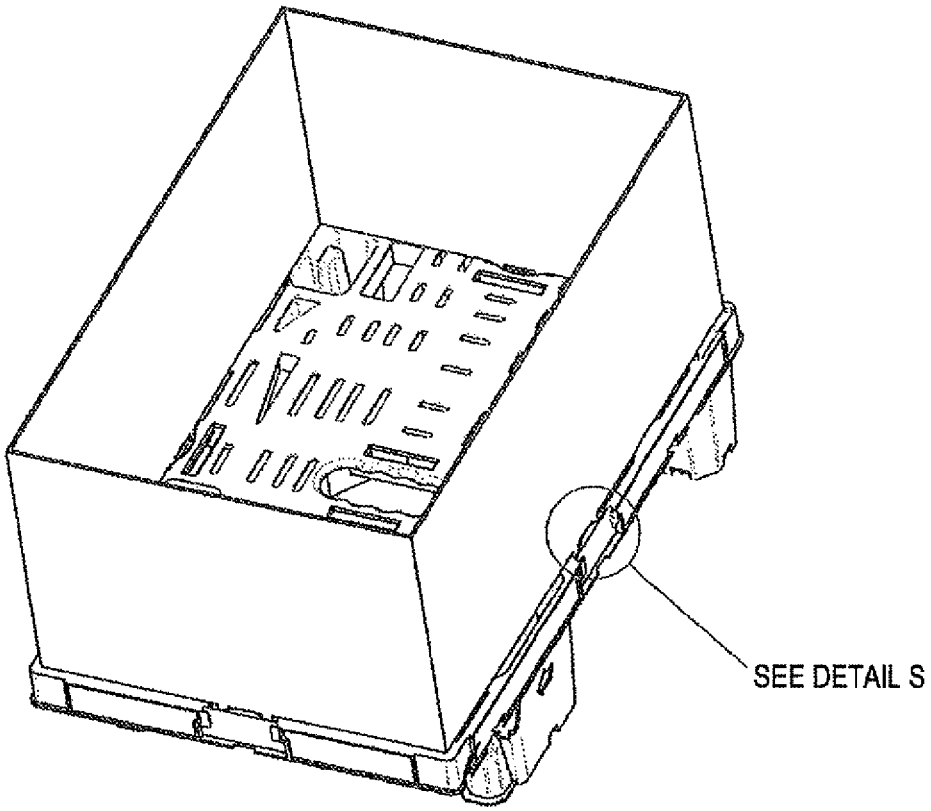

As shown in FIG. 37, there are four of these new slots 70 and thus four tongues 80. The tongues 80 lock four tabs 76 on a conventional quarter size display, i.e. a display size to fit over the full extent or substantially the full extent of the pallet 10, by extending into slots 82 provided in the tabs 76. Another arrangement using this feature is shown in FIGS. 41 and 42, where the product is a tubular structure into which goods are later loaded.

The present invention therefore has the novel features to allow a secure attachment of one eighth displays on the pallet and further provides a more secure locking mechanism, for example for quarter displays, by means of the tongues 80 fitting into the slots 82 provided in the tabs 76.

Preferably the tabs 76 are pushed out from an inside portion of the base of the display, as shown in FIG. 37, whereby the actual display extends outwardly beyond the new slots 70. This thus allows the quarter display to extend closer to, if not all the way to, the edge, or perhaps even beyond that edge, of the pallet 10. This thus provides a wider stand on the pallet 10.

The pushing of the tabs into these slots can be a quick one step installation process resulting in an automated locking of the tabs due to the resilience of the material of the tab snapping back over the tongue as had to be initially bent around it.

Next, referring back to FIG. 8, it can be seen that the ribbing on the underside of the top 42 of the pallet 10 is a fairly irregular arrangement. This is to allow the accommodation of the above mentioned plurality of slots. Each slot is located within a cell of the ribbing, and additionally most of the cells of the ribbing feature a further aperture or hole which serves to improve the lightness of the pallet, and also to allow drainage when the pallet is stored upside down. It is preferred that 90% or more of the cells formed by the ribbing feature a hole or aperture, although preferably each hole or aperture is no closer than 3 mm from the wall of the ribbing so as to ensure the rigidity of the pallet is maintained. Yet further, preferably each hole or aperture without an intended tab retaining function is provided with rounded ends so as to avoid excessive stress concentrations. The roundings are preferably at least of a 3 mm radius.

Figure 43:
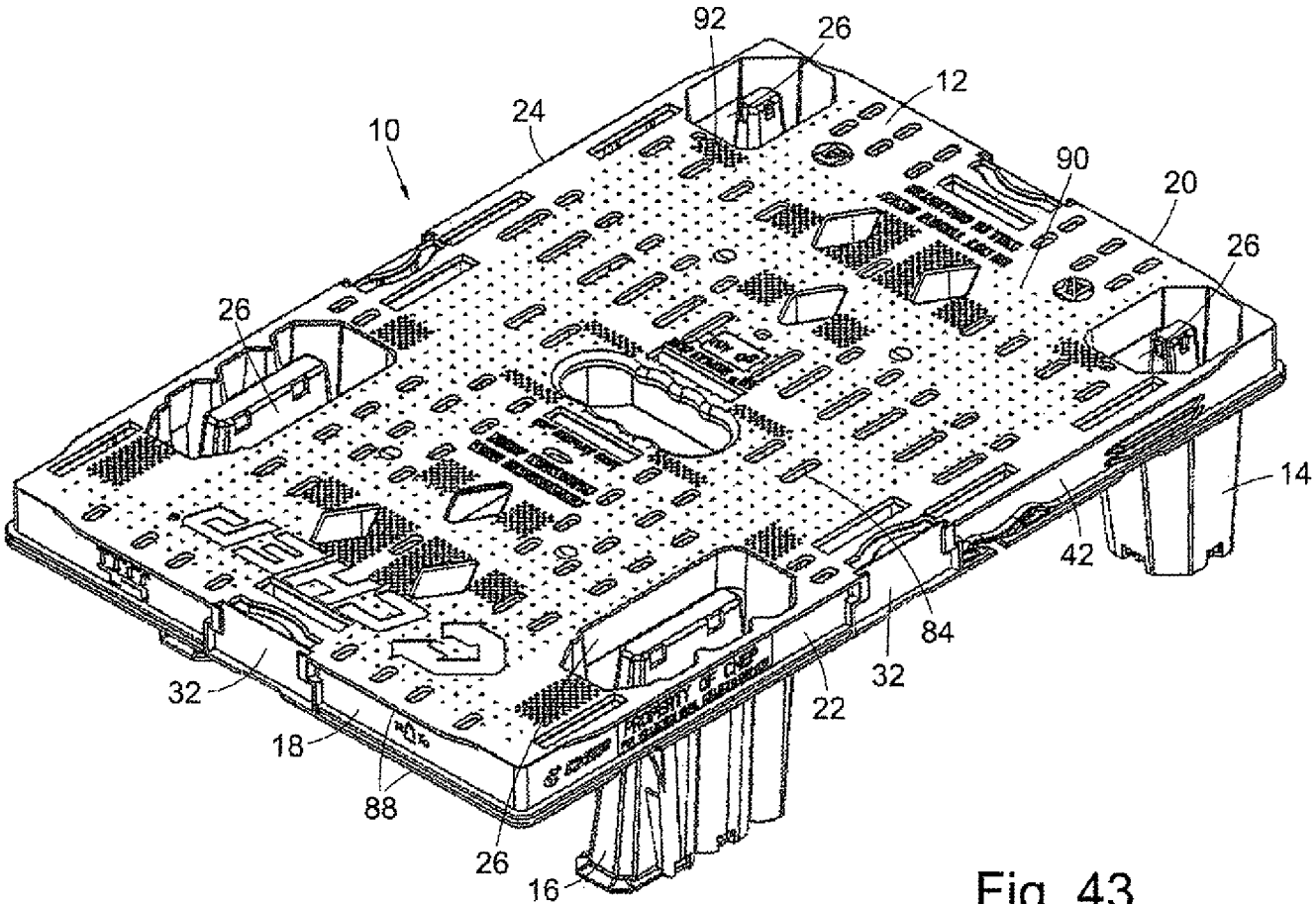
FIGS. 43 to 49 show an alternative embodiment of quarter pallet of the present invention, with FIGS. 44 to 49 being scalable with respect to a standardized quarter pallet having 399×599×140 mm overall dimensions.

Referring now to FIGS. 43 onwards, a further embodiment of the present invention will be described. This embodiment has many corresponding features to those of the embodiment of FIGS. 5 to 9, and also corresponding to the details discussed in relation to FIGS. 10-42, although various dimensions and configurations thereof may have been altered slightly. For the most part in the following further description the similarities will not be described since they are already apparent from the drawings, and for the most part the corresponding or like features are given corresponding or identical reference signs. However, a brief description of some of the common features is provided here, although typically also with an indication of differences where beneficial. Otherwise it is possible mostly to ascertain the details or properties or advantages of this second embodiment largely from the description of the corresponding features of the first embodiment.

It is also the case that a number of the features of this further embodiment can likewise be incorporated into the earlier embodiment, if preferred over corresponding the earlier, or simply if desired in addition thereto, and vice versa.

This further embodiment, like the previous embodiment, has a pair of front feet 16, a pair of rear feet 14, and a support surface 12 defined by an upper surface of a top 42. The pairs of feet are illustrated to be symmetrical about the longitudinal axis of the pallet, as is the top, save for various minor details such as logos and warning messages.

The top 42 also again has a front edge 18, a rear edge 20 and two sides 22, 24. The two sides are elongated relative to the front and back and are of the same length—extending parallel to the longitudinal axis. The front and back are likewise of the same length and extend transverse to the longitudinal axis. The front and back are shorter than the sides, with the lengths typically being about 400 mm and 600 mm, respectively.

Figure 44:
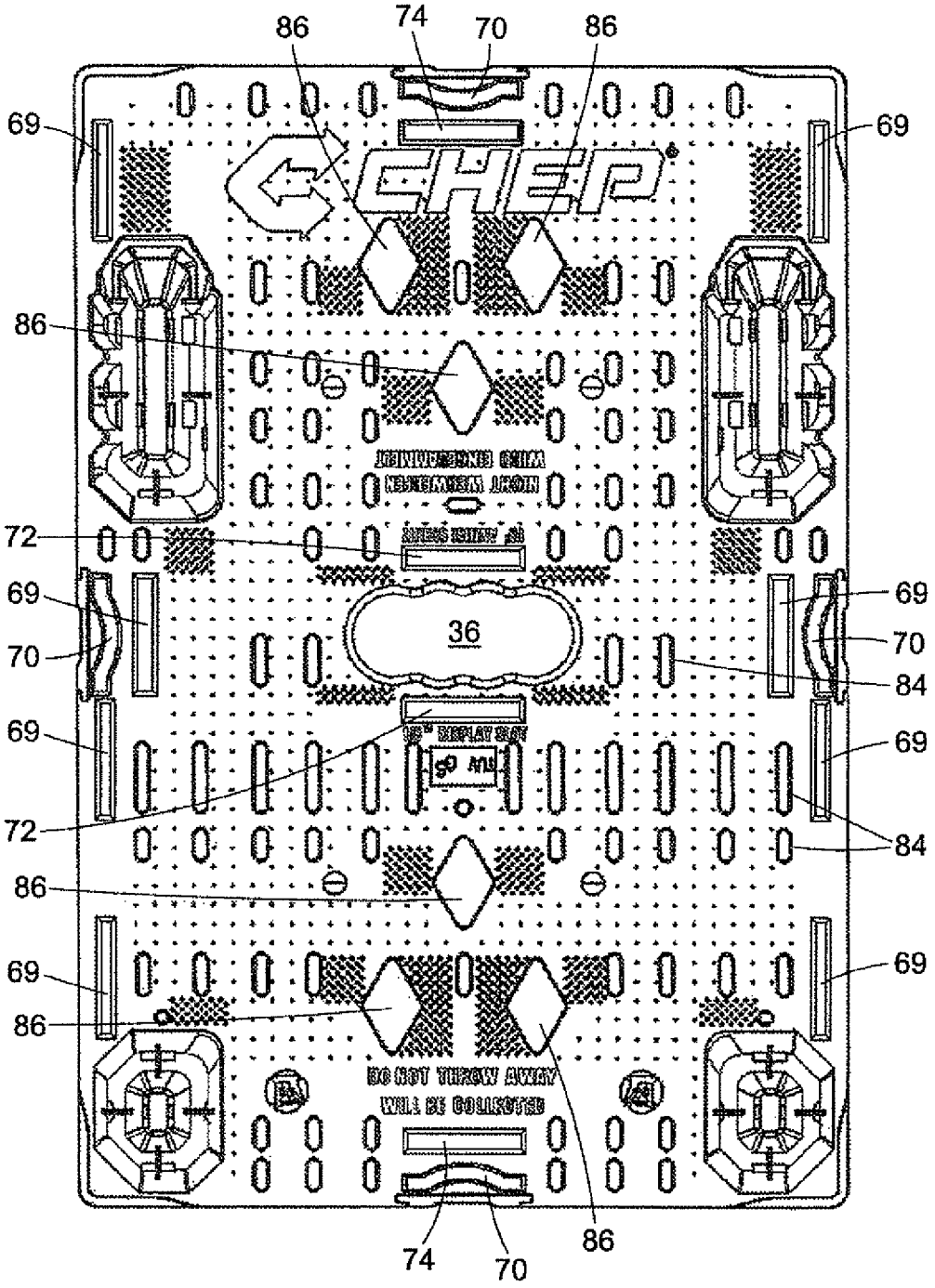
Figure 45:
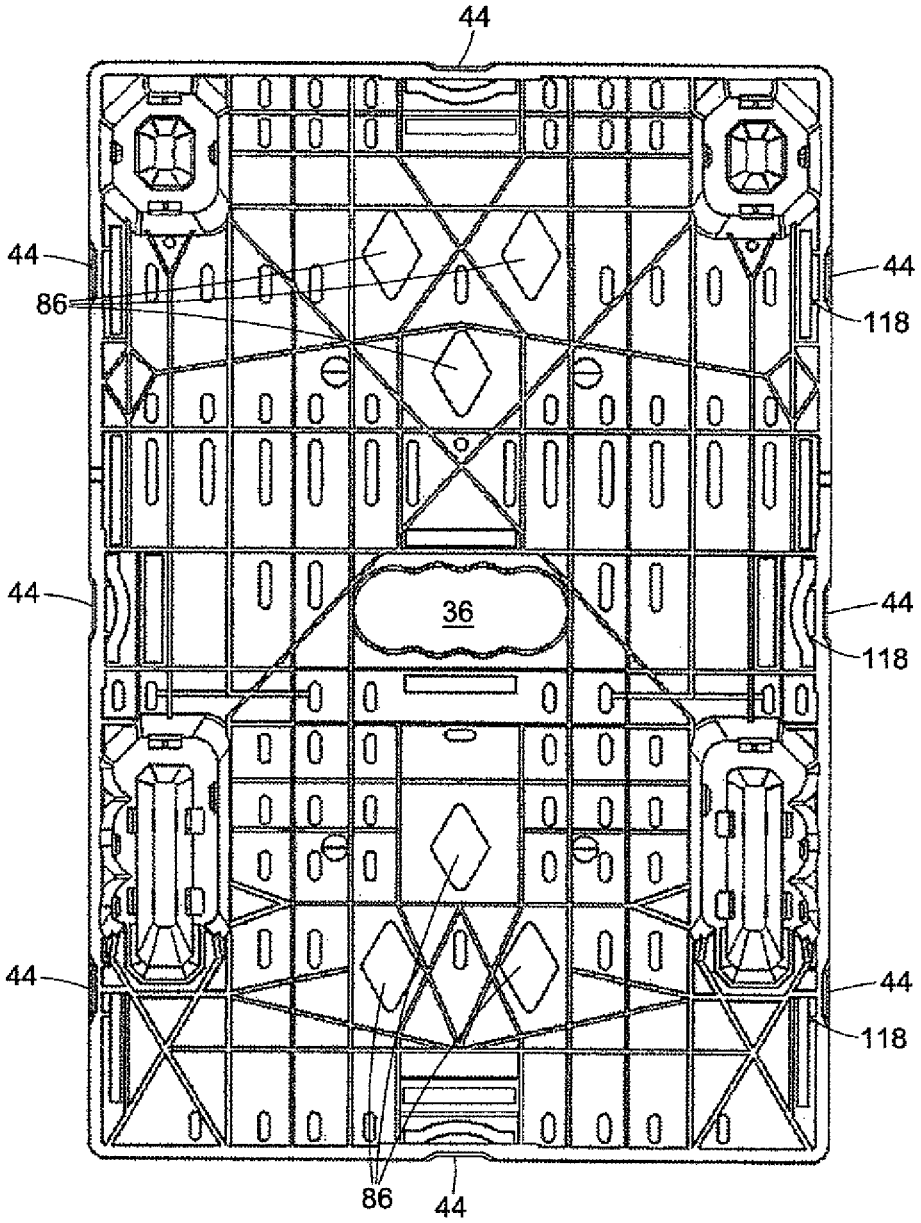

There is also again a hand access hole 36 in the middle of the top 42, along with various display slots 72, opposing slots 74, old slots 69, new slots 70 and weight saving slots 84 that are similar to those of the earlier embodiment, although the arrangement for the locations of the weight saving slots is different due to all these holes or apertures being aligned with openings in a stiffening grid arrangement provided for the underside of the top 42—see FIGS. 44 and 45.

Additional holes, however, are provided, and these include two arrays of three diamond shaped holes 86, one array in each half of the pallet, and they are of a larger diametrical size than the majority of, if not all, of the weight saving slots 84. These diamond holes are similar to or correspond with similar or identical holes to those found in the prior art of FIGS. 1 through 4. They are provided to ensure compatibility with third-party product or package raising and lowering devices that have been developed, which devices typically feature fingers that are been used to extend through those holes to raise or lower a product or package onto the pallet.

The lower edge of the top 42 is provided with various grooves for receiving banding straps, like the previous embodiment. These grooves 44, however, are now made wider than in the previous embodiment so as to more readily accommodate a banding strap. The grooves are preferably significantly wider than the typical banding strap to allow a small misalignment of the banding strap during its application not to cause an improper alignment of the banding strip within the grooves 44 upon being tightened. For further assisting with this, the sides of the grooves 44 are additionally rounded or chamfered so as to assist with the locating of the banding strap within the grooves 44 upon that tightening step.

The grooves 44 are provided in this embodiment as follows: three in each side 22, 24 and one in each of the front and back edges 18, 20. Further, as before, the central ones of those grooves are each located in a respective edge recess 32, which recesses are provided for capturing descending tabs on the underside of packages, such as the previously described T shaped tabs.

The reinforcement ribs or ribbing on the underside of the top is provided with a different design as well, as previously mentioned. This changed design features both criss-crossing ribbing extending in the longitudinal and transverse directions of the top of the pallet, but also some diagonal ribbing to increase the stiffness of the top 42, for example to ensure sufficient rigidity to carry the target loads (e.g. 250 kg) even when torque or twisting loads are applied thereto.

To yet further increase the stiffness of the top 42, stiffening ribs 88 are provided around the sides 22, 24 and front and rear edges 18, 20 of the top 42. These ribs 88 preferably occupy a substantial length of the perimeter of the upper extreme of the top so as to expand the size of the support surface 12. Further they also preferably extend substantially around the entirety of the lower extreme of the top, and as shown that lower rib is a double rib. Sections along that perimeter length can be omitted, e.g. due to other elements or attachments being present, such as wrap gripping members 48, or the aforementioned edge recesses 32. The ribs, however, nevertheless provide improved walls stiffness for the top 42. As shown, it is preferred that the bottom ribs are a double rib with the upper of the two being spaced from the lower of the two by about 5 mm, or between 4 and 10 mm. FIG. 43 shows this double rib, and FIG. 50 and others show it in closer detail. The double rib yet further improves the stiffness of the walls of the top 42.

In this illustrated embodiment, and as shown in FIG. 43, the support surface 12 of the top 42 has a plurality of dimples 90 provided on it. For the most part these dimples 90 are provided in a spaced array across a substantial proportion of the support surface 12—e.g. 10 to 20 mm centers. Certain areas of that support surface 12, however, are provided with higher density portions of dimples 92, e.g. at 3 to 5 mm centers. These dimples 90 and higher density portions of dimples 92 together cooperate with the support surface from which they extend such that packaging to be placed thereon is gripped on the support surface, e.g. due to indentation of the material of the packaging.

The dimples 90, 92 are relatively short—typically about 1 or 2 mm, whereby the packaging material, which is typically cardboard or corrugated cardboard, can deform to engage positively with the dimples 90 and higher density portions of dimples 92.

There may be a lesser degree of deformation in the areas of the higher density portions of dimples 92, although those areas may be located at points where expected point loadings will be present—e.g. corners of standardized packaging sizes, thus compensating for the greater resistance to deformation due to the higher density of dimples. Nevertheless, the higher density portions of dimples anyway create a rougher overall surface, whereby grip is maintained even without the higher degree of deformation.

Figure 46:
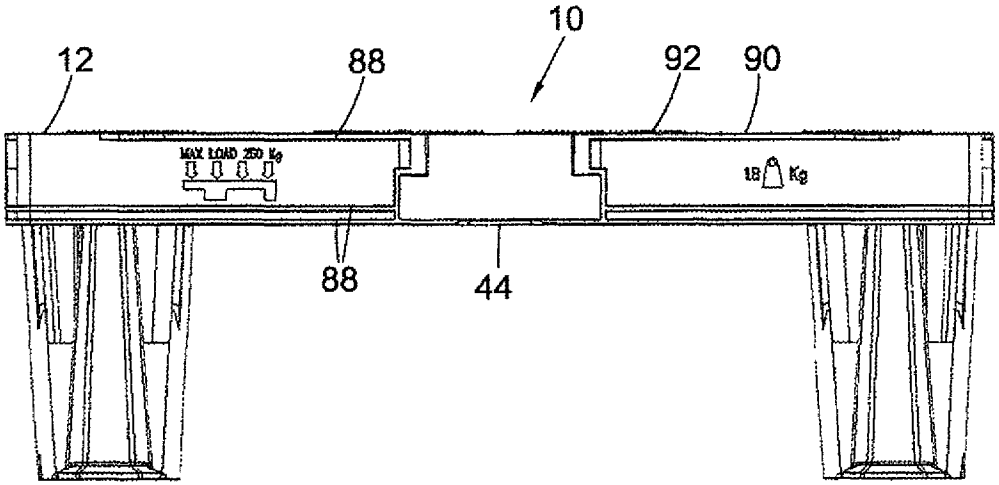
Figure 47:
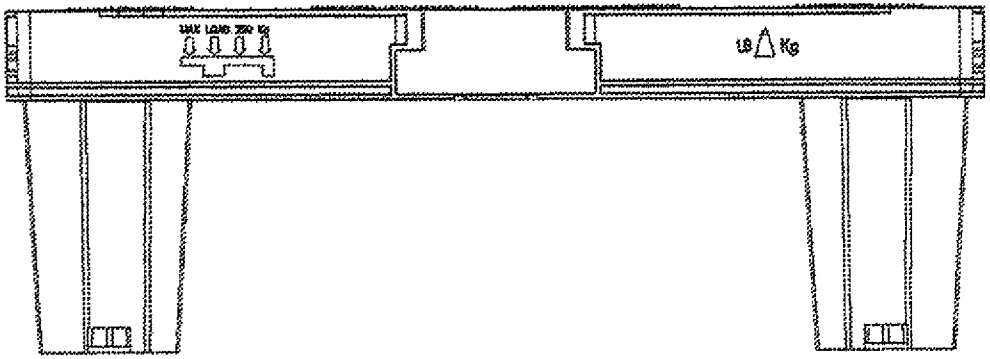

As can be seen in FIG. 46 the dimples 90 and higher density portions of dimples 92 extend above the support surface 12. FIG. 46 also shows the ribs 88 extending forwardly of the front edge 18 of the pallet 10.

Figure 48:
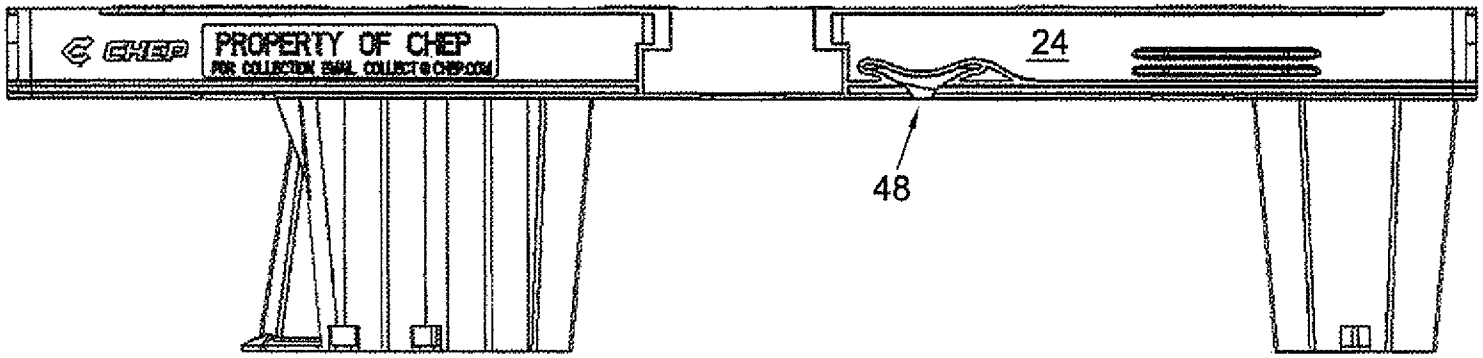
Figure 49:
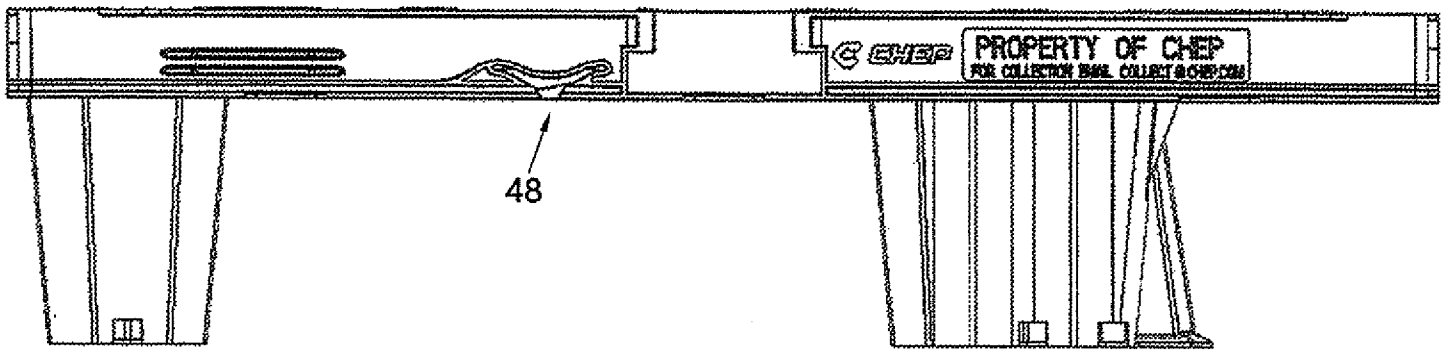
Figure 52:
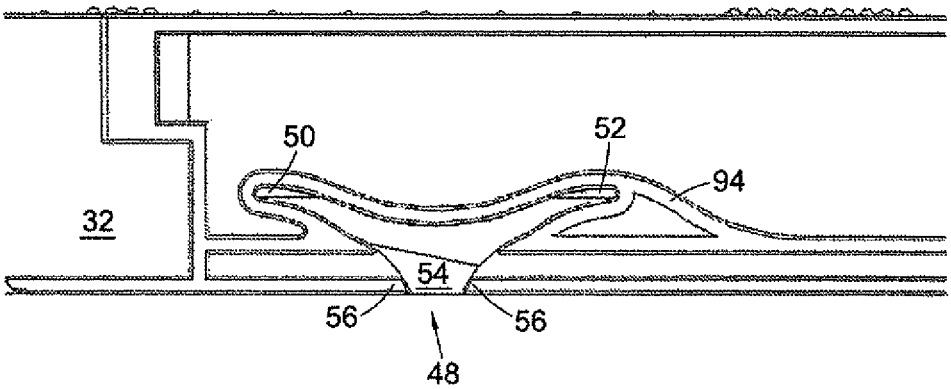
Figure 53:
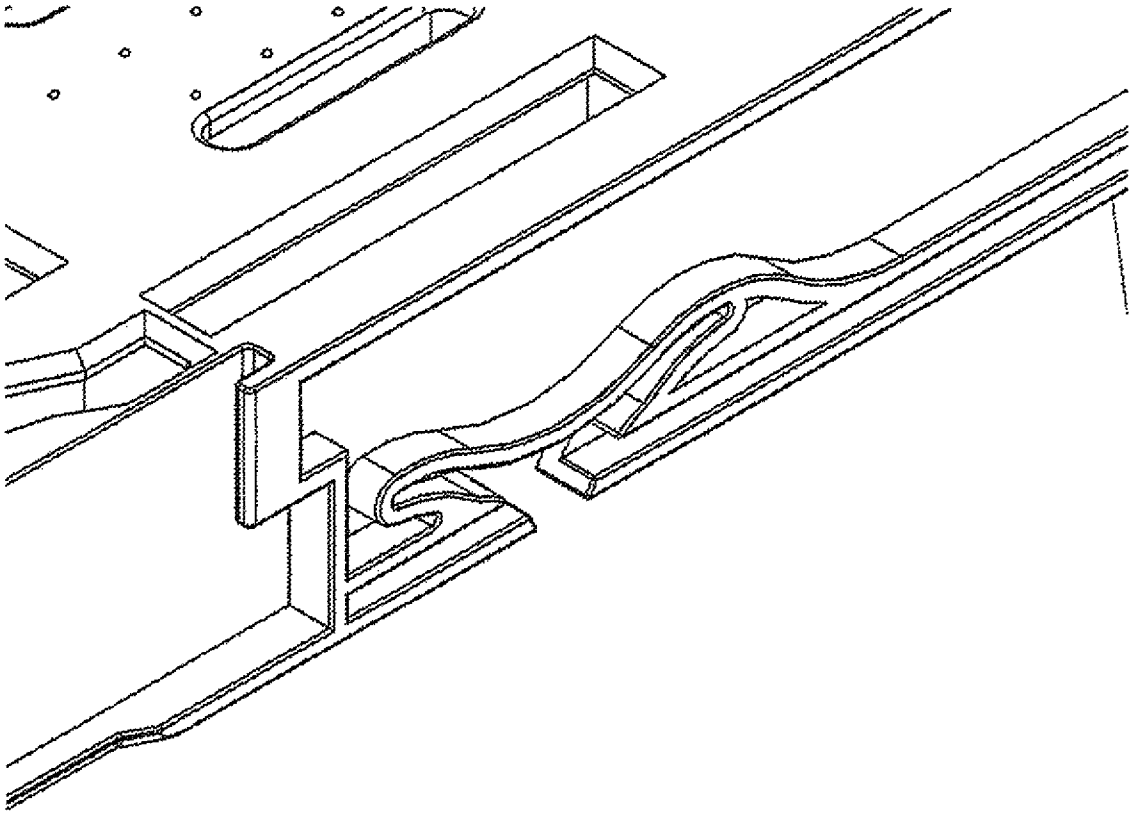

Referring next to FIGS. 48 and 52 and 53, a detail of a preferred gripping member 48 of this second embodiment is shown. This gripping member 48 is similar to the gripping member 48 of FIG. 24 in that it has a narrowed opening 54, a pair of cantilevered portions 56 either side thereof, and front and rear recesses 50, 52. However, it additionally is now made to be wider such that the front and rear recesses 50, 52 extend to a greater extent along the side 22, 24 of the pallet 10. A corresponding gripping member 48 is provided on each side 24, 22 of the top 42, preferably in registration with the other—i.e. symmetrically arranged relative to the longitudinal axis of the pallet. Nevertheless, they may be located in positions different to that shown, and they may likewise be provided in the front and rear edges as well or instead, or just in one edge/side. However, in preferred arrangements, they are provides just in the sides 22, 24.

Around the edge of the slot formed by the gripping member 48, the ribs 88 are extended so as to provide additional reinforcement to the cantilevered portions 56. These additional reinforcements are formed as a flange extending from the side 22, 24 and in this preferred arrangement there is additionally an additional flange 94 extending from the rear recess. This is to increase the rigidity of the more rearward cantilevered portion 56.

Due to a ribbing around the edge recess 32, a corresponding additional flange is not provided for the forward-most cantilevered portion 56, i.e. from the front recess, although it is possible so to provide one.

In this preferred new gripping member the curvature of the front and the rear recesses 50, 52 are preferably designed so as to extend their relevant axes to an included angle of approximately 170°, and if necessary 180°. This provides an improved or steeper angle of locking of a wrap into either the front or rear recesses 50, 52.

Figure 50:
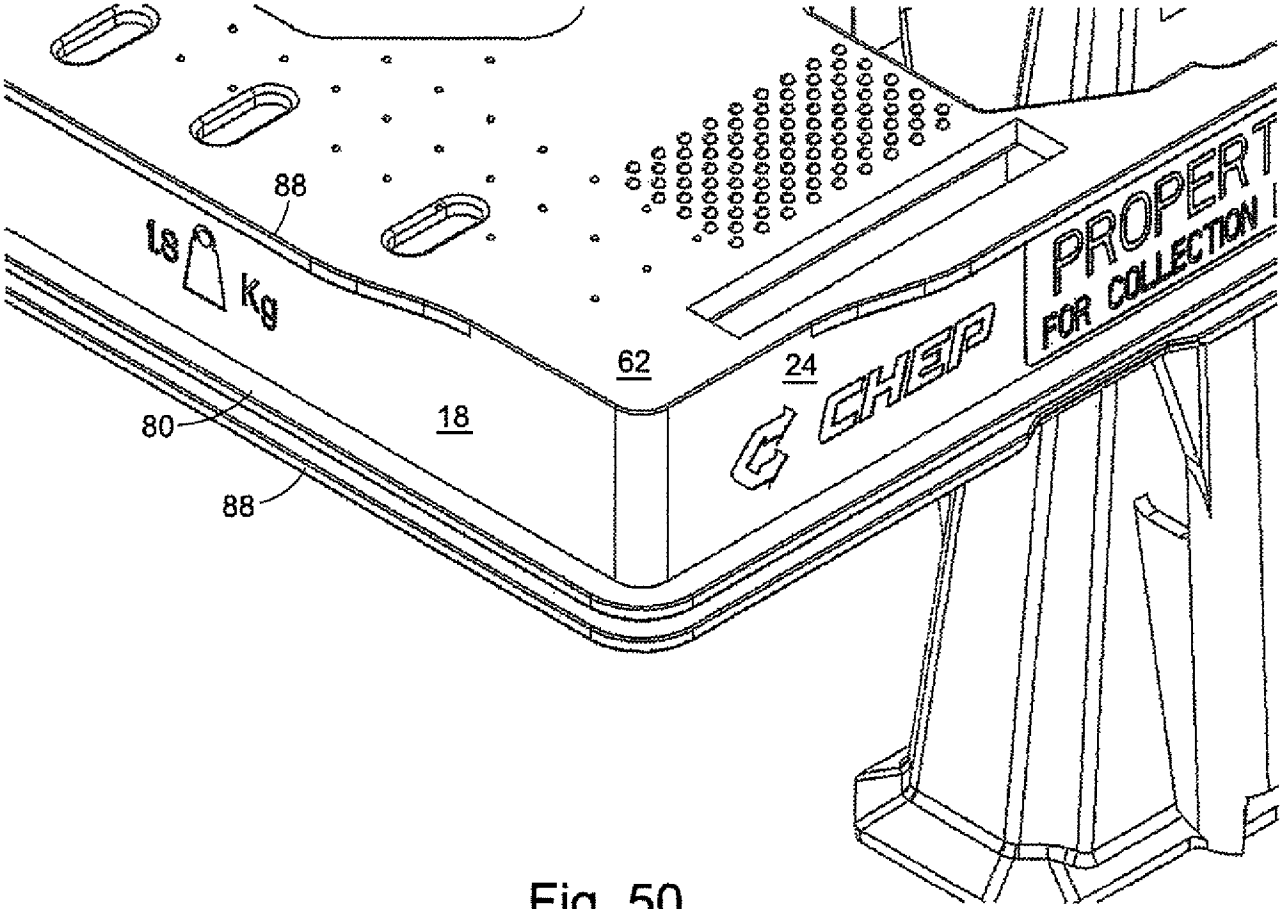
FIGS. 50 to 64 show various details and features of that alternative embodiment of pallet.
Figure 51:
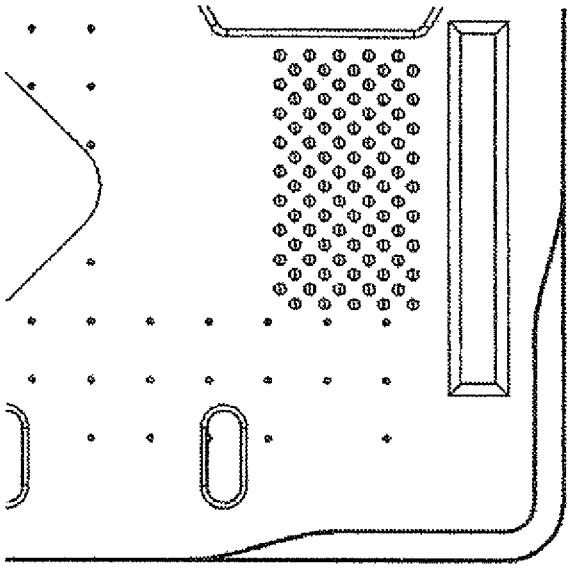

The corners 62 of the pallet of this further embodiment are also altered compared to that of the previous embodiment in that now, rather than recessing the plane of the front edge, rear edge and sides, it is the ribs 88 in the top of those front edge, rear edge and sides that are recessed. There is still the rounding of the corner, however, as shown in FIG. 50.

The top rib 88 is recessed with a tapering or contoured profile so as not to be extending outwardly of the side 24 and front edge 18 of the top 42 of the pallet in the area of the corner 62.

The ribbing around the bottom of the top 42 still is present at the corners so as to provide a lower surface onto which upstands of packaging can stand in the corners. However, this is optional, yet preferred.

It is possible, for example, additionally to cut away the upper of the two lower ribs 88 in the corner region.

Figure 54:
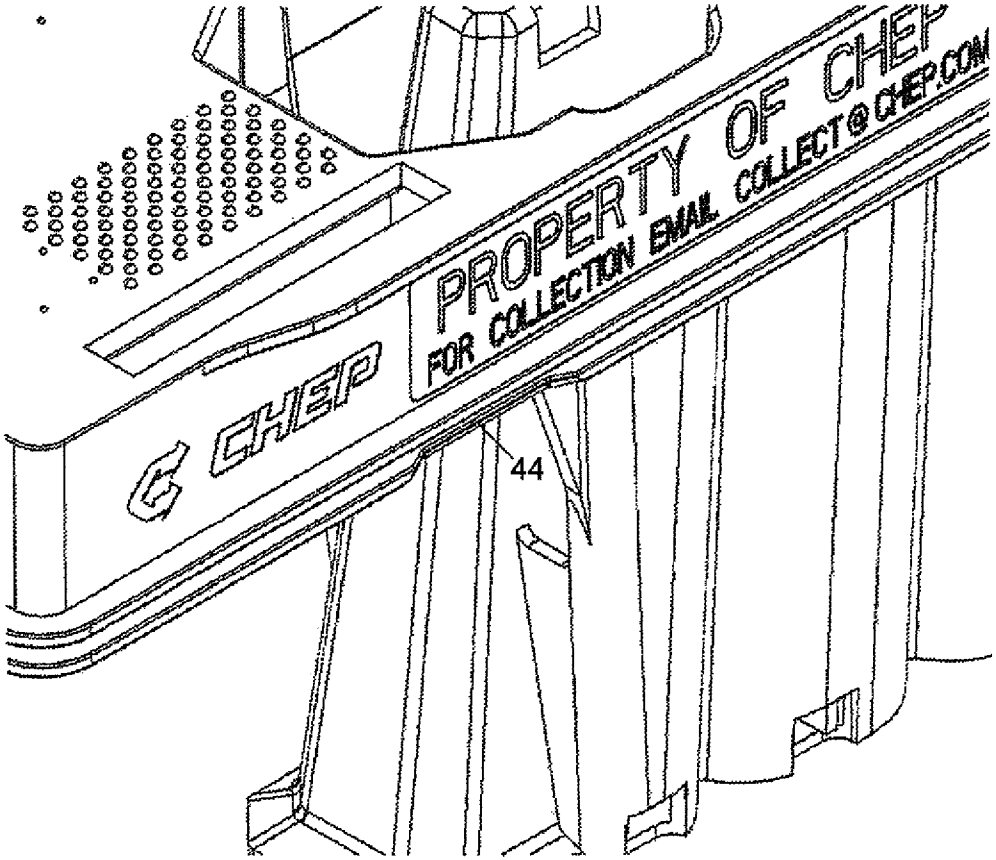
Figure 55:
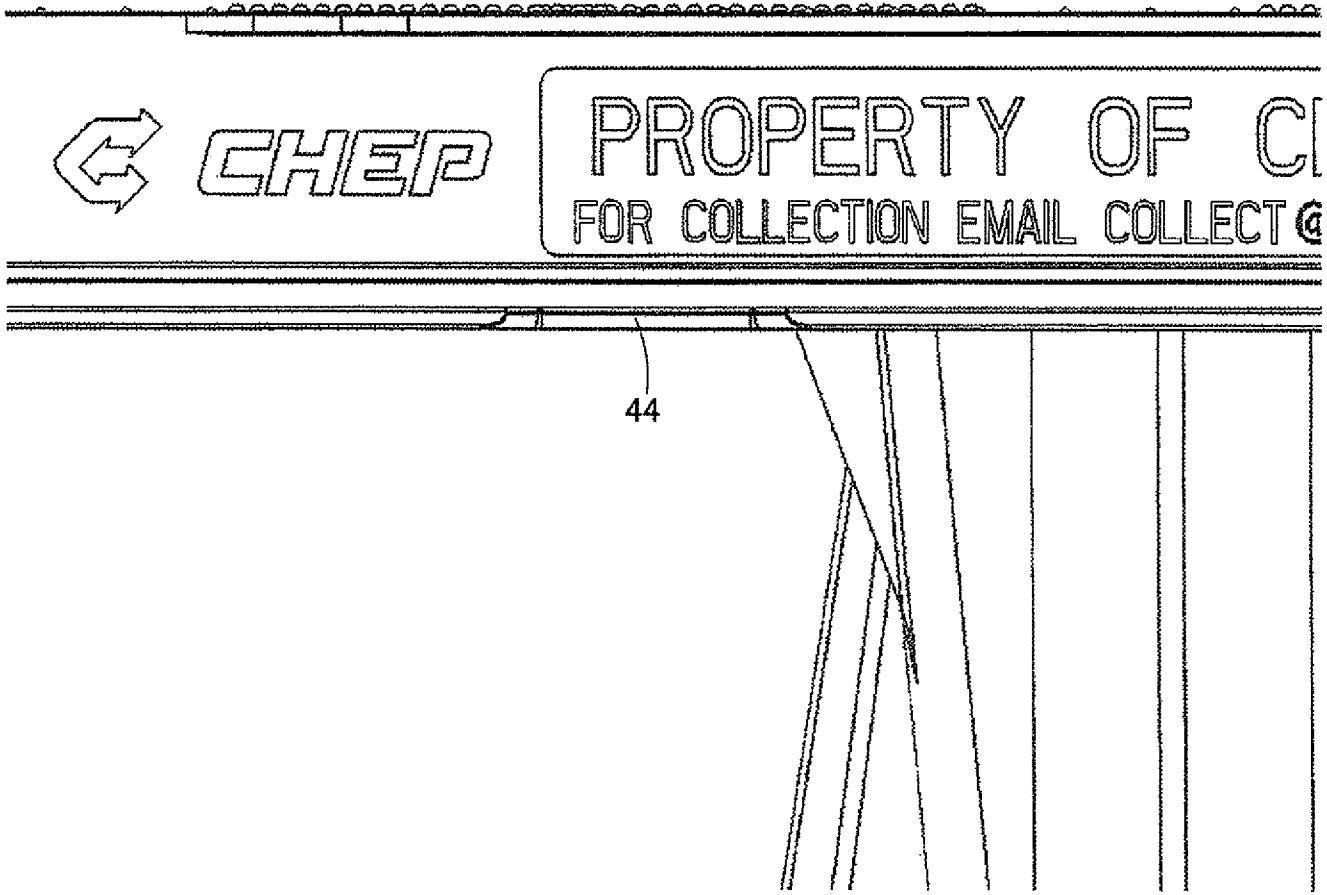

FIGS. 54 and 55 show banding strap grooves 44 as provided in front of the front feet. This location, while close to where those feet descend from the underside of the top 42, allow the feet not to foul the strap wrapping process, and they offer a secure retention of packages, including one eighth packages, on the pallet due to their adequate distance from the front of the pallet.

Figure 56:
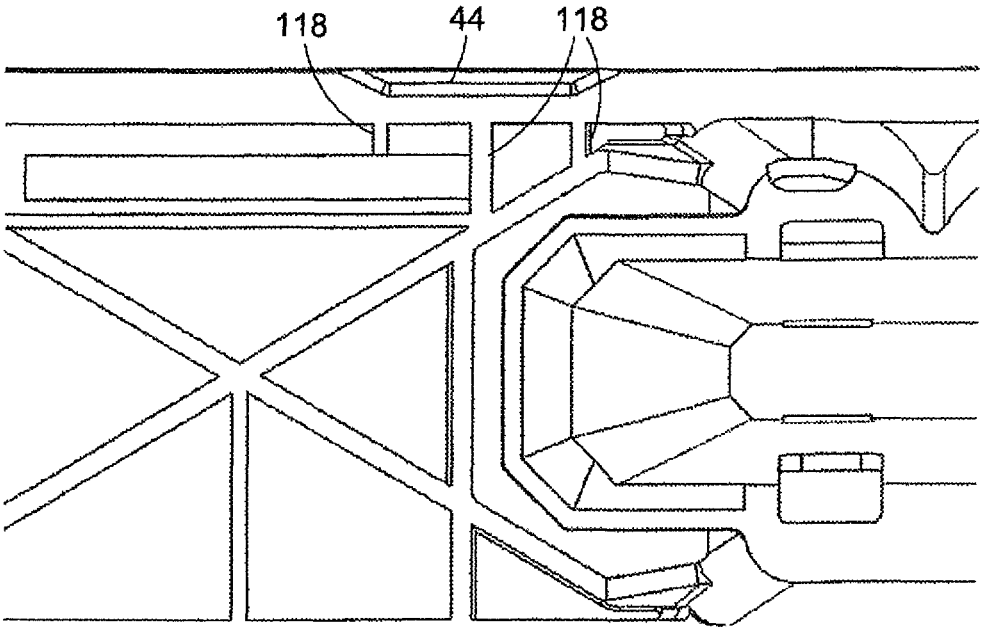

FIG. 56 shows these grooves 44 have a rounded profile, and their angled sides.

Figure 57:
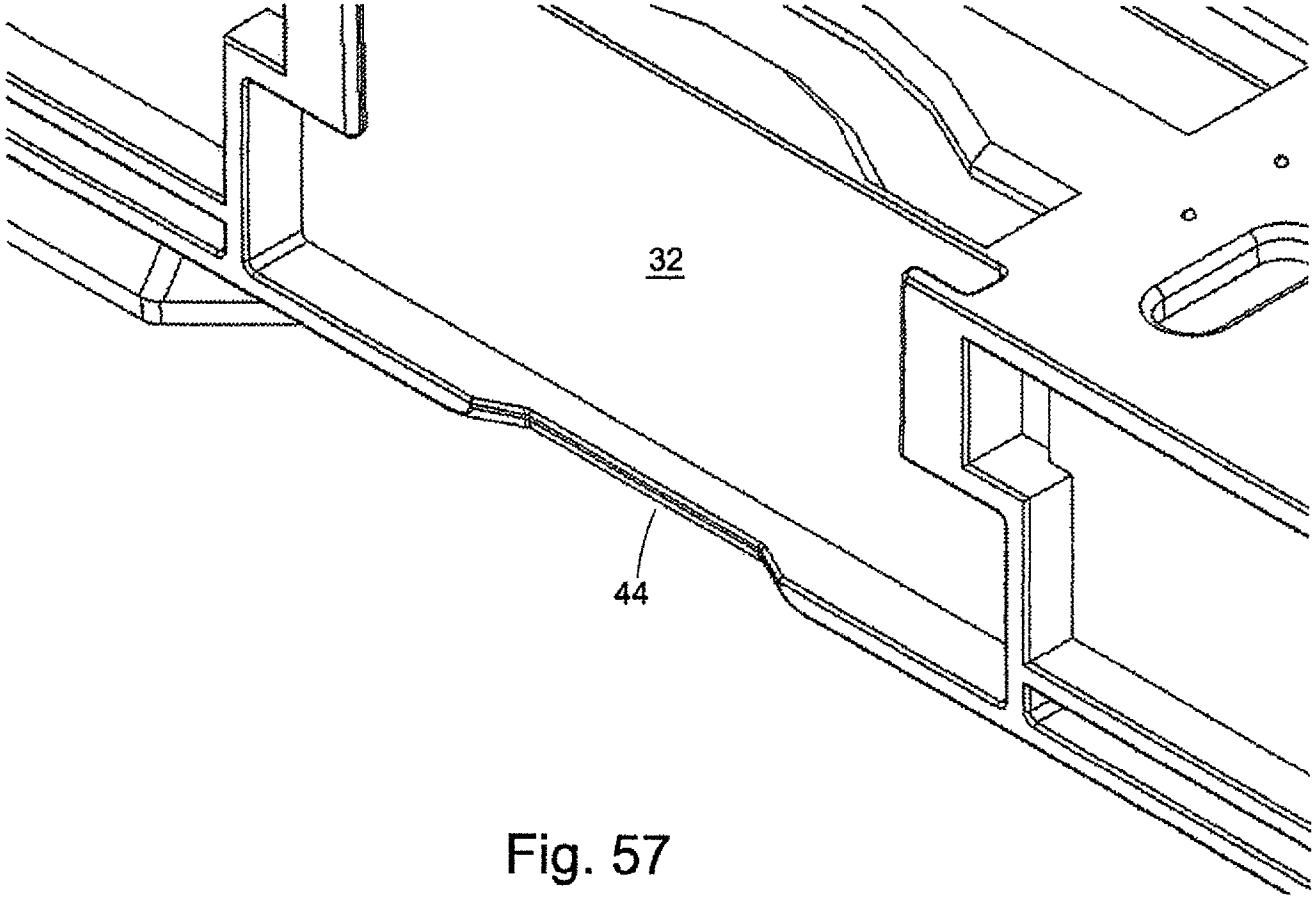
Figure 58:
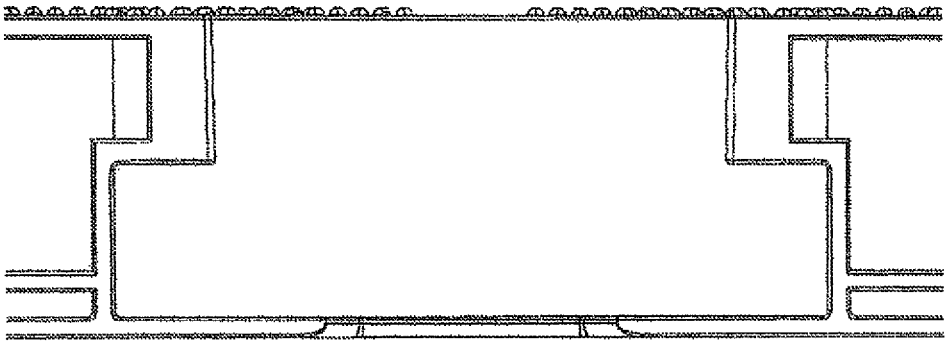

FIG. 57 shows the corresponding groove 44 in an edge recess 32.

Figure 59:
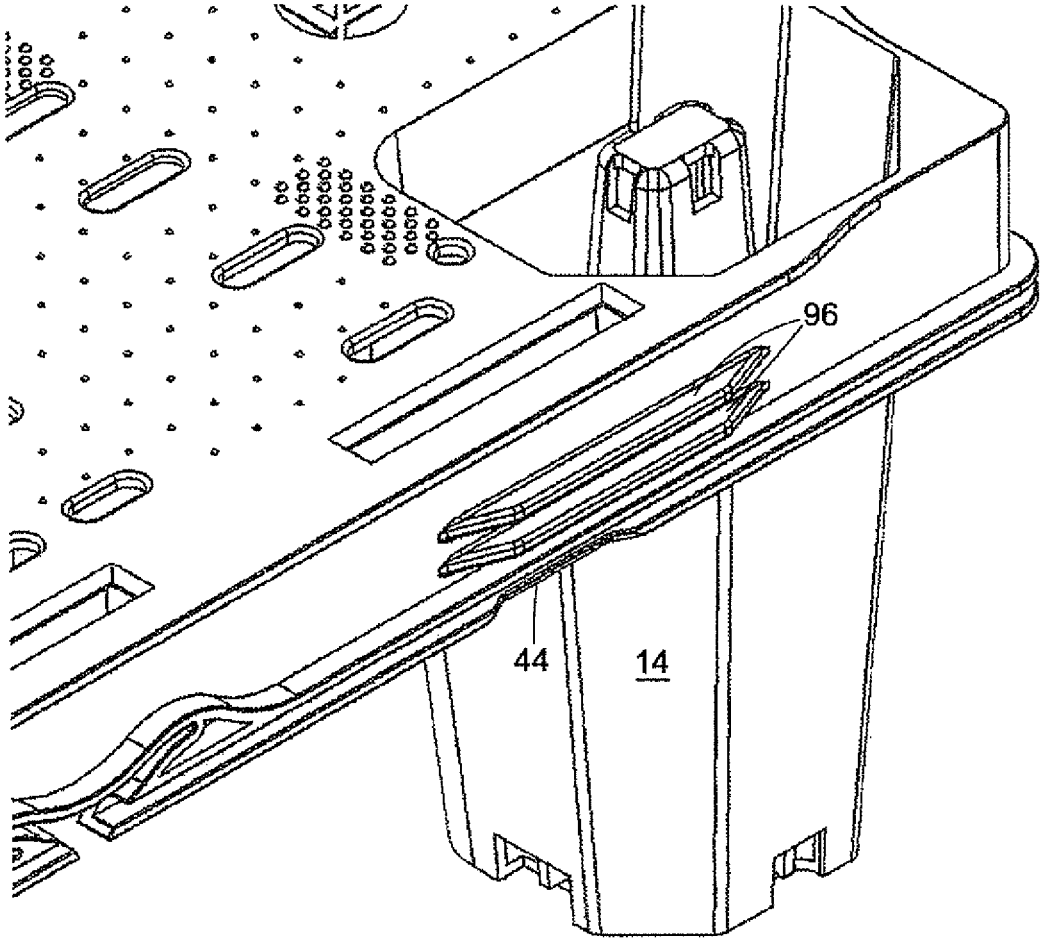
Figure 60:
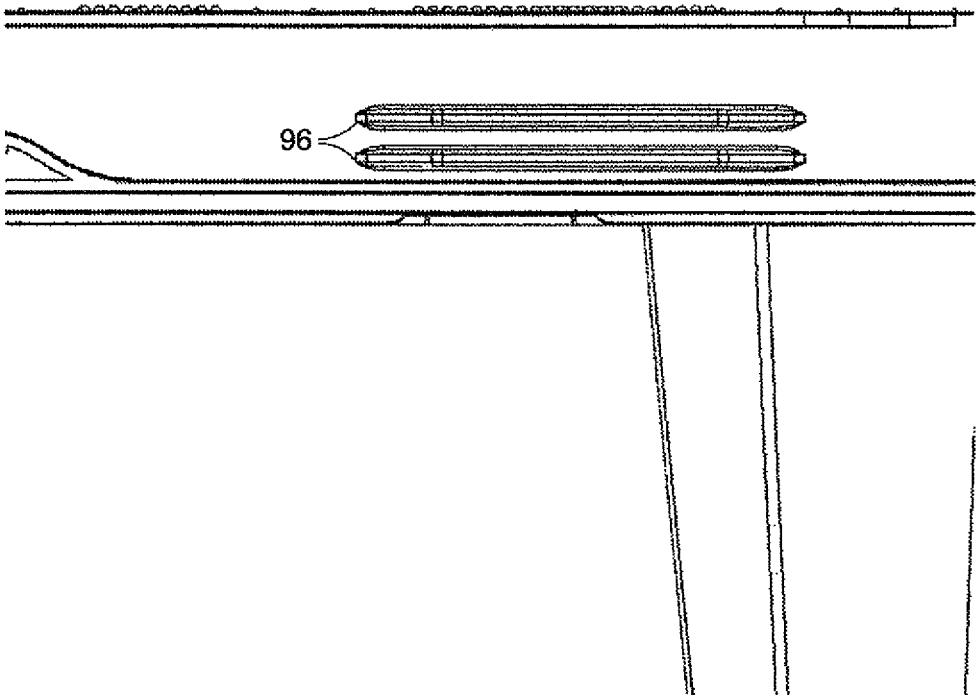

FIGS. 59 and 60 show the corresponding groove in front of the rear legs.

Figure 64:
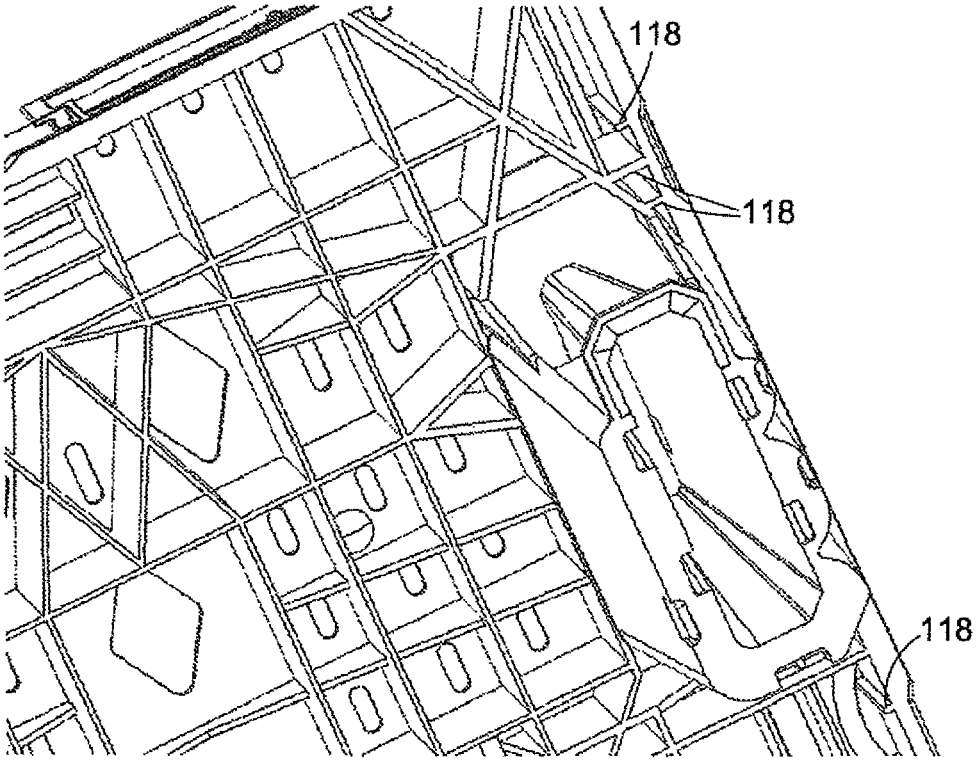
Figure 65:
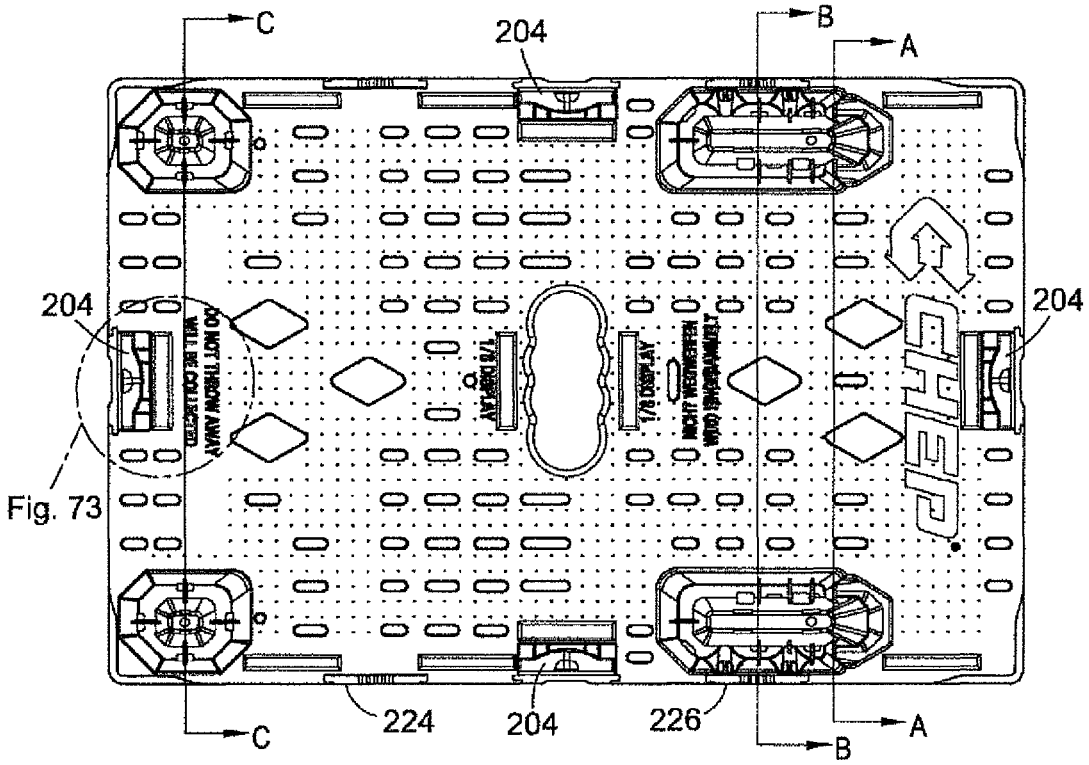
FIGS. 65 to 71 show a further alternative embodiment of quarter pallet of the present invention, with FIGS. 65 to 69 being scalable with respect to a standardized quarter pallet having 399×599×140 mm overall dimensions.
Figure 66:
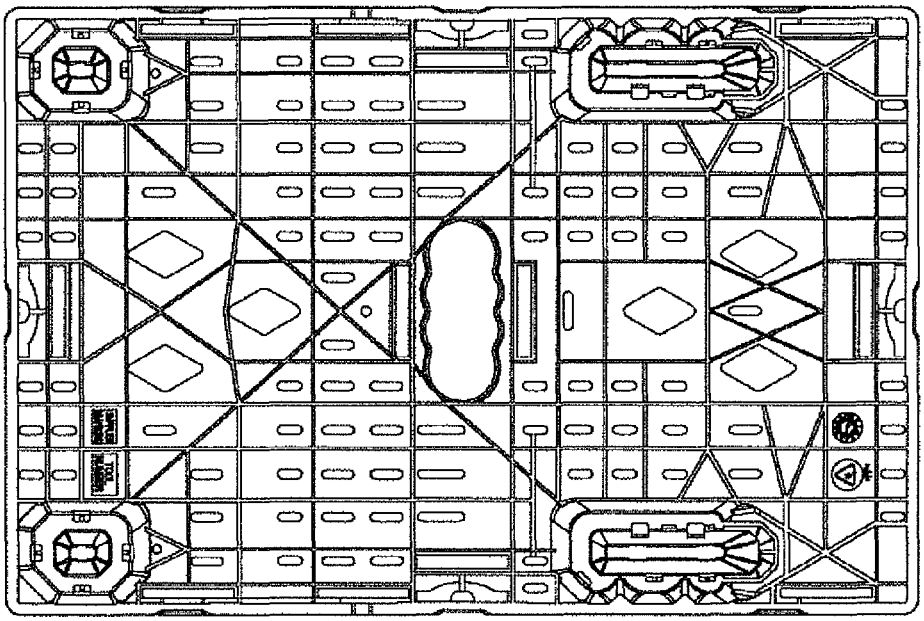
Figure 67:
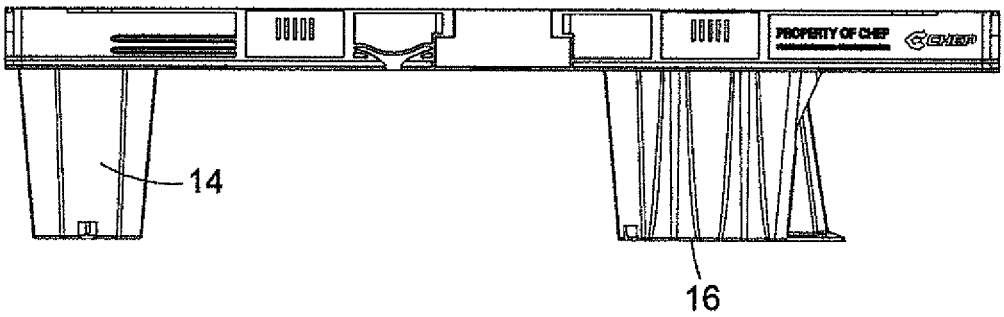
Figure 68:
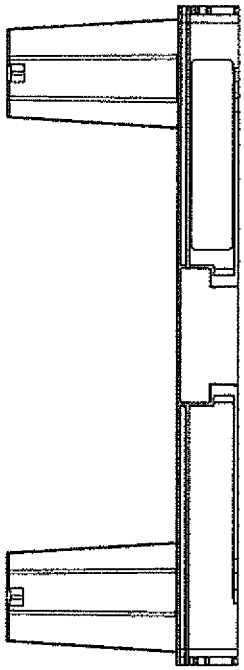
Figure 69:
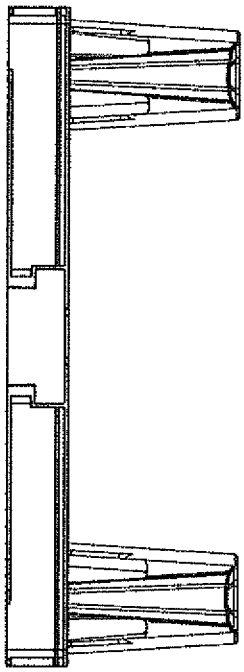
Figure 70:
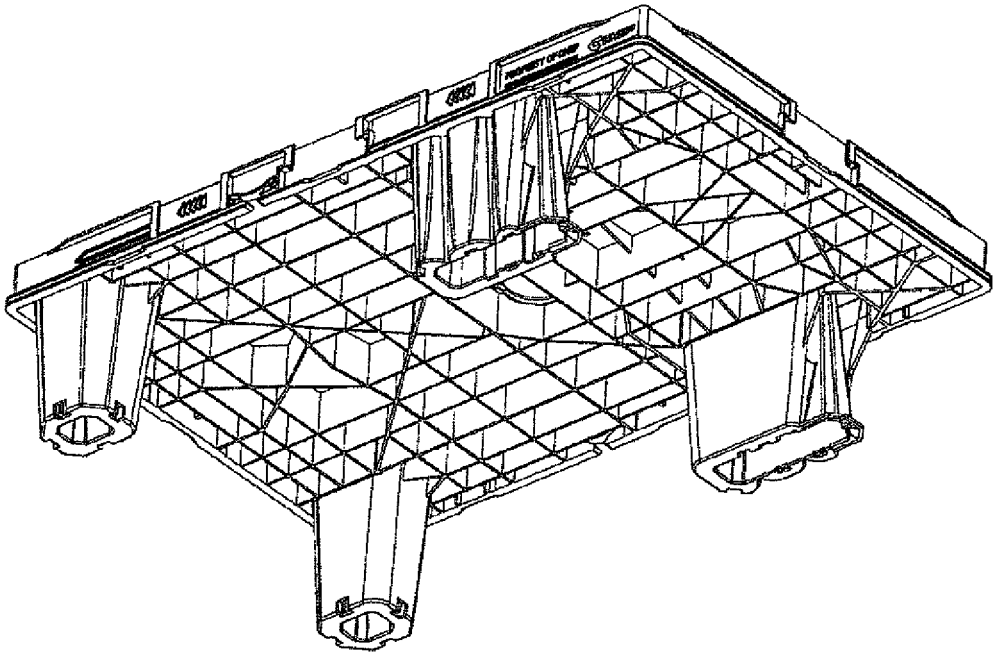
Figure 71:
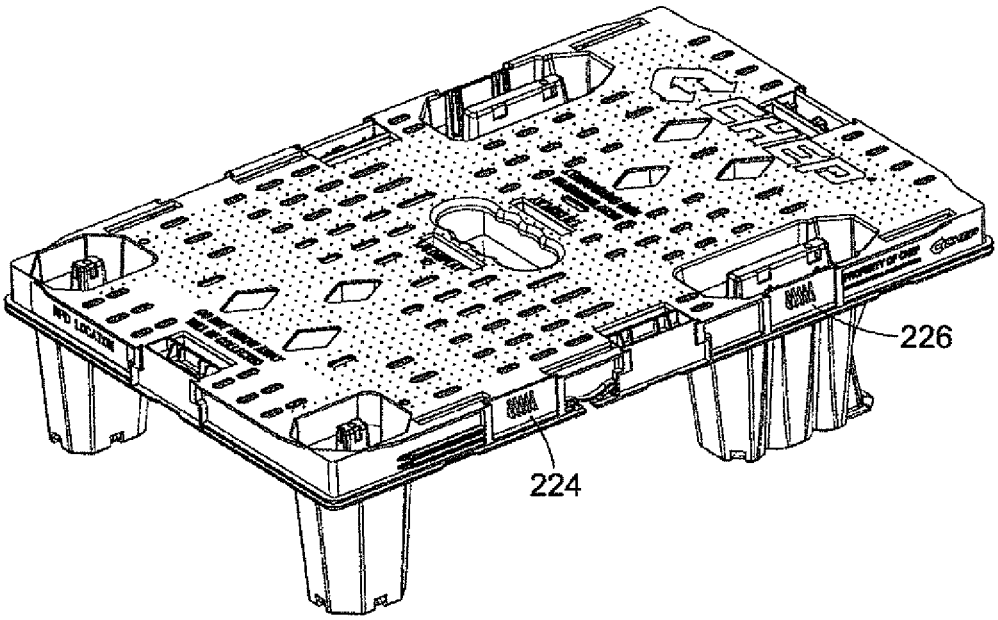
Figure 72:
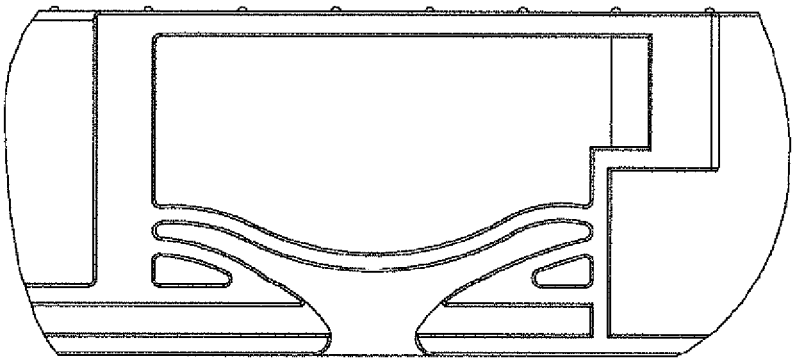

The underside of the pallet, in the areas of these grooves, is typically reinforced with additional flanges 118, as can be seen in FIGS. 45, 56 and 64. This is optional but preferred.

The groove in front of the rear feet is also so positioned to avoid the legs from hindering the strap wrapping process.

In the area of those grooves 44 in front of the rear feet, additional reinforcements 96 are provided for the sides 22, 24, which reinforcements 96 provide added stiffness to the sides 22, 24 so as to assist with supporting loading on the top 42 that might cause flexure of the top 42 in the area of the rear or back feet 14. As shown this is a double bar of reinforcements, although other reinforcements are possible.

Figure 61:
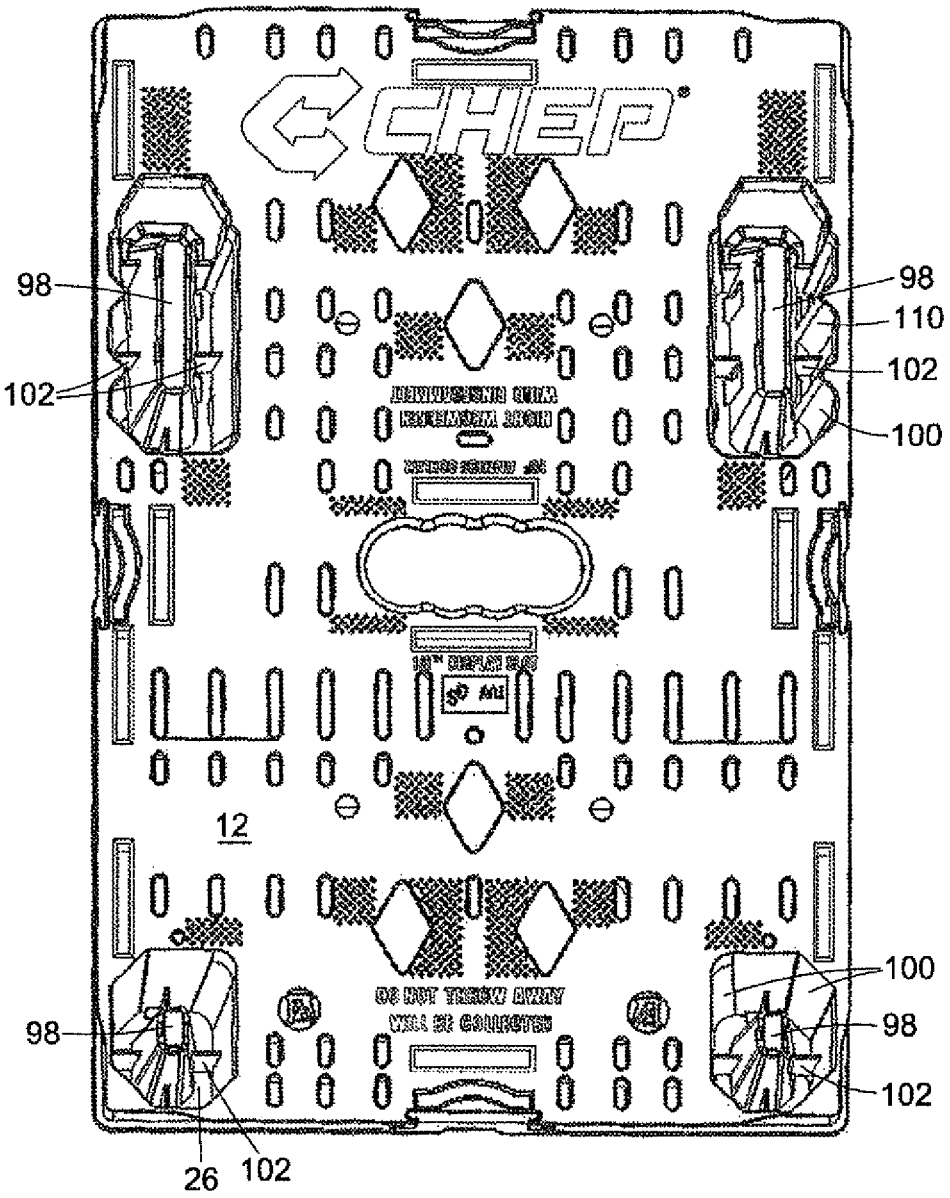

FIG. 61 is a slightly angled perspective view of the top 42 allowing the detailing within the apertures 26 formed by the feet 14, 16 to be seen. As can be seen, these feet 14, 16, define apertures through which the feet of an upper pallet can be slotted. The apertures are defined by a central column 98 extending from the base of the feet up to the support surface 12 so as to define a top that provides an additional support area for the support surface 12. Additionally, between those central columns 98 and the side walls 100 of the feet 14, 16, support flanges 102 are provided. These support flanges 102 extend upwardly from the base of the feet to a position that defines the stacking height of pallets. The base of an upper pallet will push down through the apertures 26 of the lower pallet when stacked thereon until they engage against those support flanges 102. The flanges 102 therefore provide a positive definition of the stacking height of the pallets, whereby excessive loading of pallets on top of one another cannot cause adjacent legs to jam together. This additionally allows the stacking height discussed in respect of FIG. 17, for example, also to be easily determined without necessitating specific loading weights.

Figure 62:
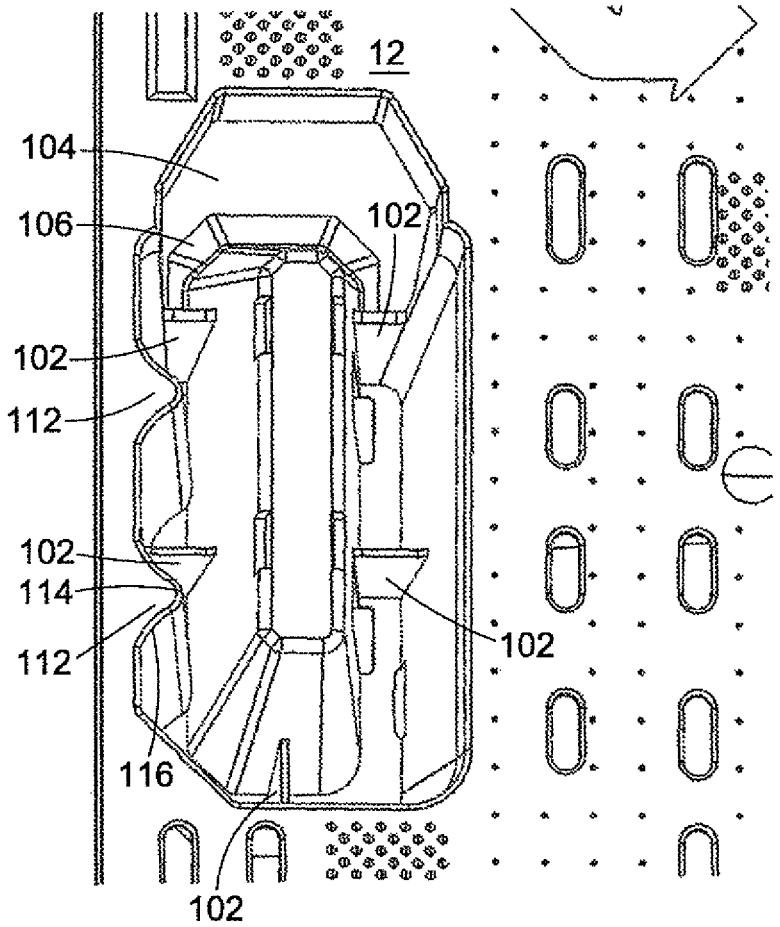

The support flanges for front feet are better shown in FIG. 62—an enlargement of FIG. 61. As can be seen, there are five of them in the front feet, whereas there are only four in the rear feet in this embodiment. Other numbers are possible instead. There are only five in the front feet, rather than six, since a forward-most support flange is absent. Instead, the front region of the leg is open 104 since the toe 106 of an upper pallet would need to extend through that opening 104 in order for the pallets to be stackable. This is due to the recessing of the front of the front legs relative to the toes, as previously described with regard to the first embodiment. In this second embodiment, that recessing is not radiused, however, but is instead a linear tapering.

Figure 63:
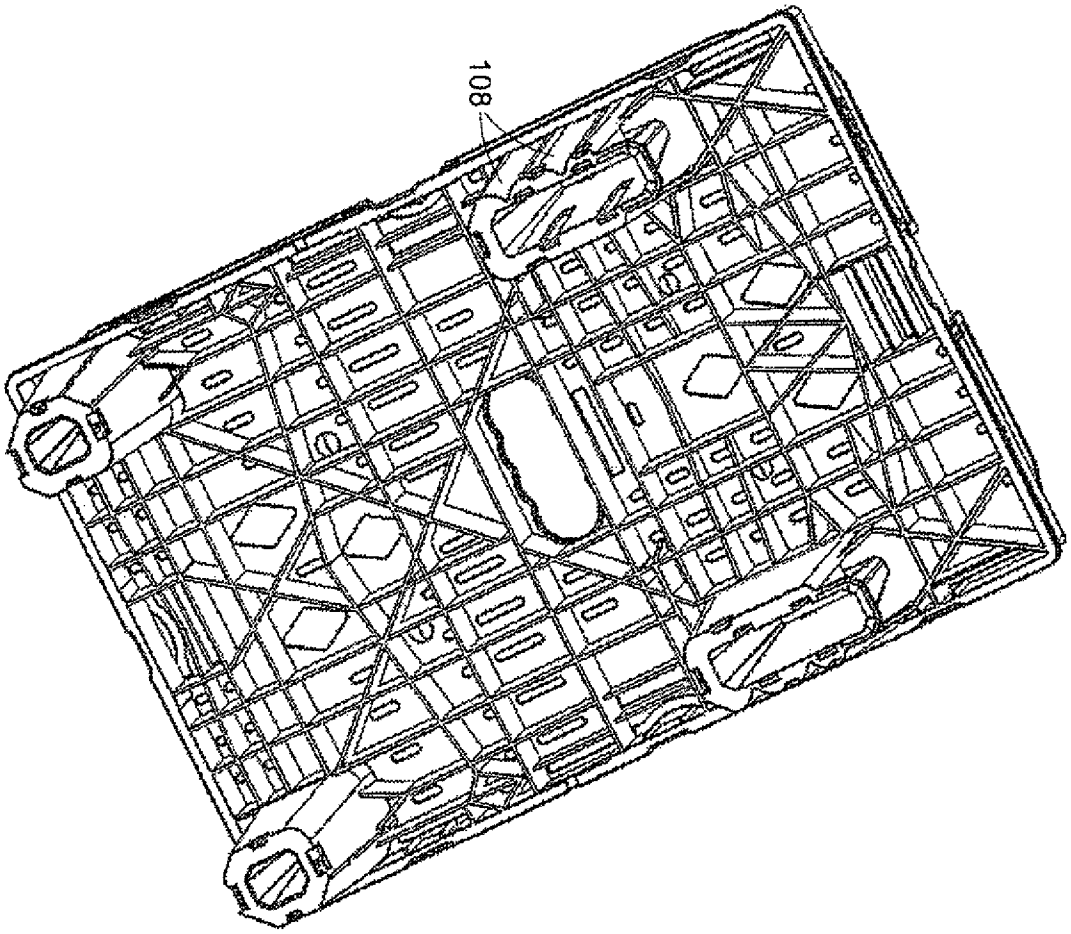

This opening 104, can also be seen in FIGS. 63 and 64.

In this second embodiment, as also visible from FIGS. 61 and 64, the front legs are provided with grooves in their outer side walls. These grooves 108 are best shown in FIG. 63 as a pair of grooves in the outer side wall of the front legs. These grooves 108 define an inwardly extending wall 110 as shown in FIG. 61 that has an upper surface 112 as best seen in FIG. 62. This upper wall defines an inwardly extending additional area for the support surface 12 of the pallet 10. That additional area is advantageous (in addition to the increased stiffness of the foot) since it additionally reduces the length of any unsupported wall portion of a package located on the pallet 10; pallets typically are loaded to their edges, rather than just in the middle areas or in the areas adjacent those edges—i.e. in spaces further than 20 mm from those edges.

As such, with these additional areas for the support surface 12, the packaging located on the pallets will be better supported with the present invention.

In this embodiment, the upper surface 112 is generally triangular. Other shapes, however, are possible.

In this embodiment the triangles are rounded both at the point 114 and in their sides 116. See FIG. 62.

Referring finally to FIGS. 65 to 82, a further embodiment of the present invention is disclosed. This is largely similar to the previous embodiment and as such only some of the more important changes will be discussed in detail in the following passages, but changes have included the following:

a) altering some of the branding and marking details;

b) modifying the curved display attachment holes in the top surface—they have now been recessed and the locking feature has been changed to a ball shape. These changes are discussed in greater detail below.

c) adding a new display attachment feature—two on each long side. These have been added to increase product versatility, and are also discussed below.

d) modifying item 112—the rib feature on the inside of the large foot. This has been done to improve versatility.

e) modifying item 118—the ribbing structure for the band retention grooves. This has been done to help make the tooling more straightforward (for the manufacture of these items).

f) changing the position of the stretch wrap retention feature—it is now positioned closer to the T-slots.

g) changing the layouts of the ribbing on the underside of the top, and the location/arrangement of some of the weight saving holes in the top. This has been to maintain or provide a good balance of properties for the pallet, including an acceptable overall weight and suitable stiffness and strength characteristics.

h) changing the layout of the dimples on the product receiving surface of the pallet such that only one dimple density is provided. This improves the appearance of the product and a small weight saving.

Figure 73:
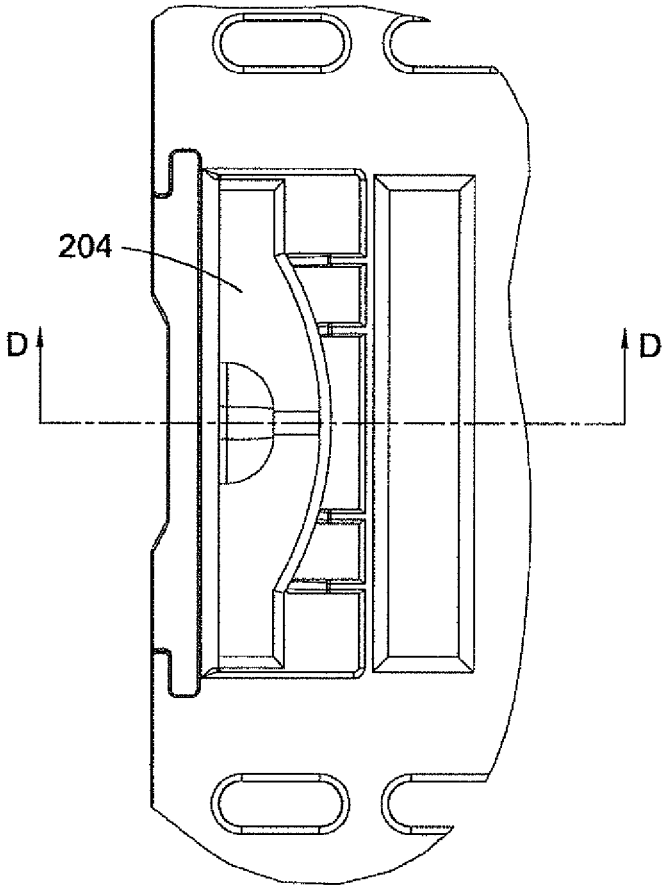
Figure 74:
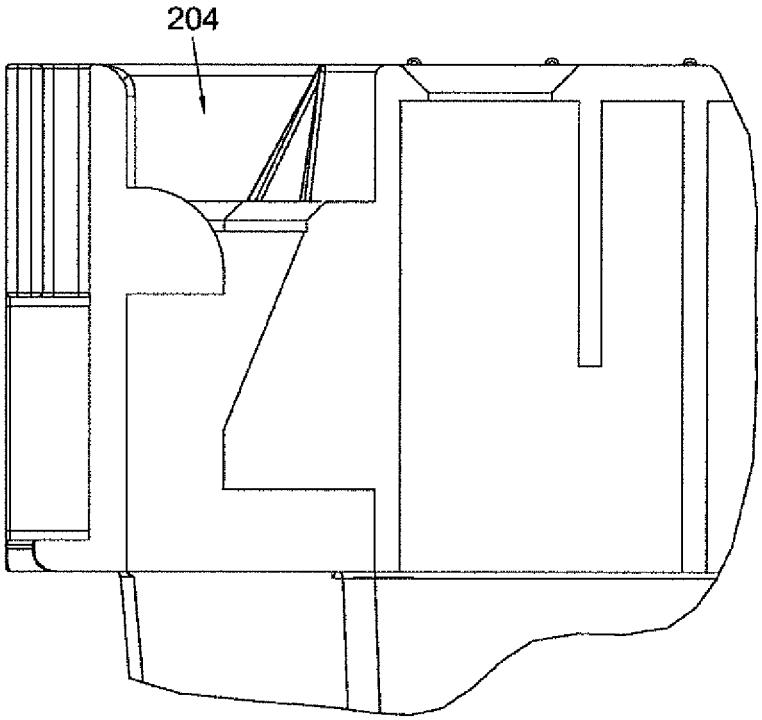
Figure 75:
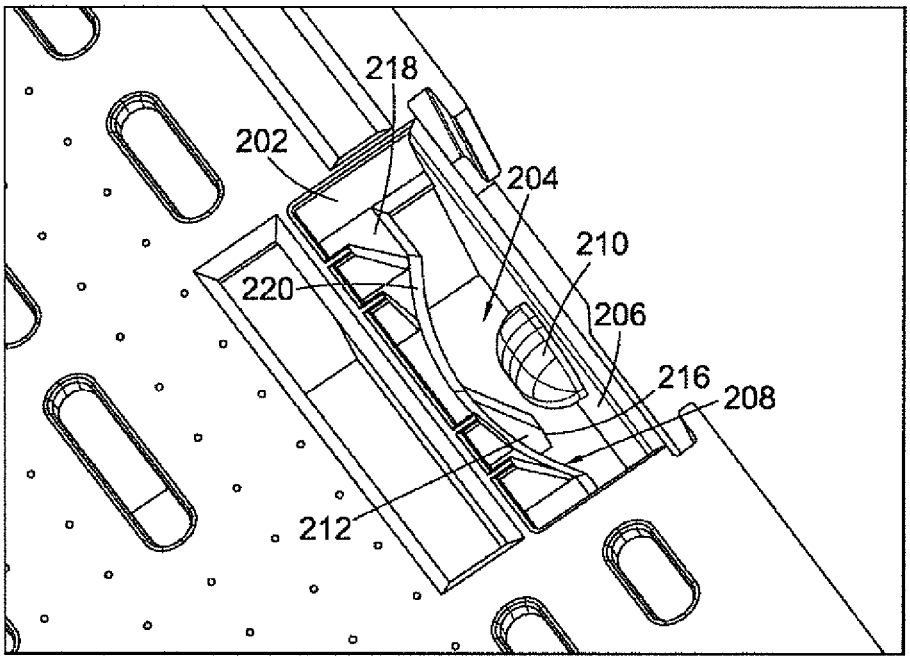
Figure 76:
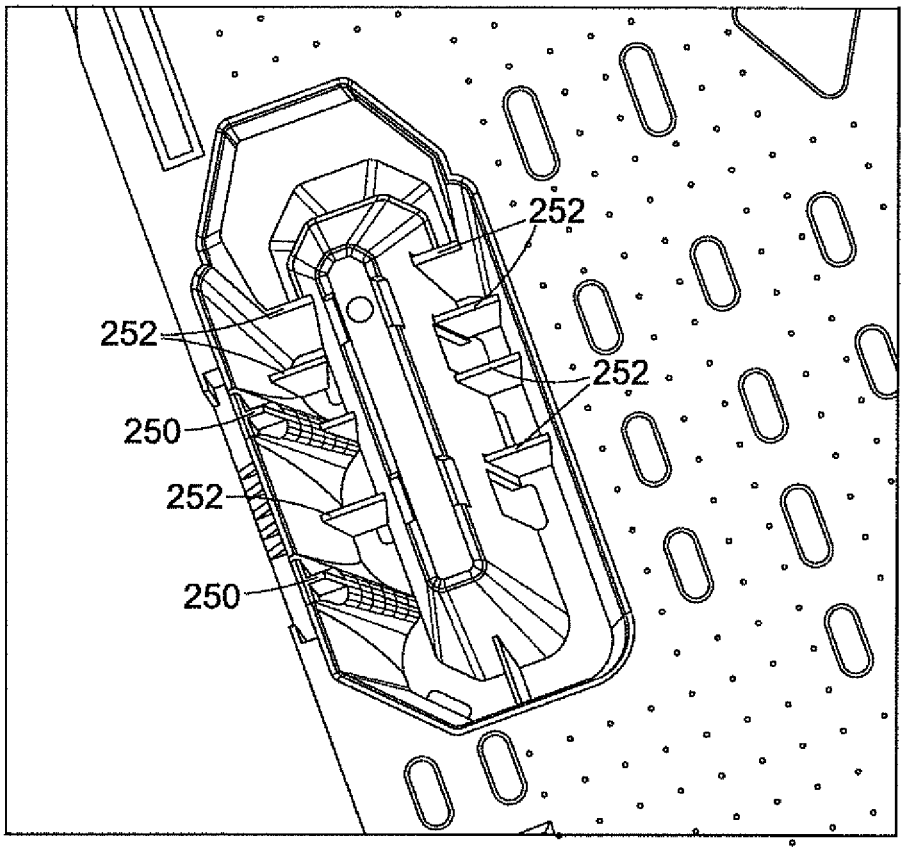

Regarding modification b), as shown in FIGS. 65, 66, 71, 73, 74 and 75, the pallet now comprises a set of four curved slots 204, one adjacent to each edge or side of the top. FIGS. 73 to 75 show additional details of these slots, each of which may be identical in form despite the details of the product receiving surface being different in neighboring parts.

As with the similar slots in the earlier embodiment, these slots are still spaced about 8.2 mm from the respective edge of the pallet and are centrally located relative to those sides or edges. These slots 204 (or holes or apertures) are also still provided to accommodate tabs descending from the base of a product, and are adapted such that they lock or hold such tabs within the slots by having projecting members. However, now they are significantly recessed (rather than being recessed simply by virtue of a chamfer or rounding of the top, and the shape is modified.

The significant recess is greater than 5 mm. Here it is about 9 mm.

Each of the four slots 204 is contained within a parent slot with a depth of about 9 mm (the recessed depth) and a generally rectangular shape, in that there is a rectangular set of surrounding walls 202, see FIG. 75. However, within the surrounding walls 202, recessed relative to the product receiving surface of the pallet, there is the recessed slot 204.

The recessed slot 204 has a flat bottom 206 and a humped top 208 when looking in plan. It also has projections associated therewith for interacting with a tab once one is inserted in the slot.

Whereas the previous embodiment had a tongue portion in a long side thereof for interacting with a tab, this modified recessed version has replaced the tongue with an alternative projection. Here a recessed projection 210 is recessed about 9 mm below the product receiving surface of the pallet.

The recessed projection may be a similarly shaped tongue, but here it takes another shape—a rounded or part-spherical member (specifically approximately a quarter sphere—here it is longitudinally extended (along the slot axis). It is arranged with its rounded surface pointing generally upwards and having a flat bottom facing downwards. The recessed projection is preferably recessed below the product receiving surface of the pallet by at least 5 mm, and as illustrated it is more preferably recessed by about 9 mm.

In this illustrated embodiment the projection has an outermost tip and an underside surface (i.e. the flat bottom) that is located more than 15 mm, and as shown about 17 mm, below the product receiving surface of the pallet.

The quarter sphere has its other flat face faces formed integrally with or into the sidewall of the pallet.

The nose of the projection is associated with a further member 212 formed in the opposite wall 214 of the slot 204. In the illustrated embodiment, the further member 212 is a tapered or angled leg. The further member 212 is shown to have a free end 216 that extends to a plane that is in a vertical alignment with the nose of the projection or tongue, but which is located at a level lying below that nose.

With this additional or curved slot, a tab on an underside of a box—a box for stacking onto the pallet—can be encouraged to extend into this slot such that it will flex both around the projection or tongue, and against the further member, thus being held in place therein.

If the tab has an appropriately positioned hole, that hole can engage and lock onto the projection or tongue, or the further member.

As shown, the further member 212 has a downwards taper that draws closer to the adjacent sidewall of the pallet as the further member 212 descends from the product receiving surface of the pallet towards the underside of that top.

The further member also has a flat underside arranged in the horizontal plane, i.e. parallel to that product receiving surface of the top of the pallet. Then, if the tab's hole is longer than that of the above option (the one for engaging the recessed projection 210), it might instead engage under that flat underside. Two different tab hole arrangements are thus supported. Bear in mind though that just one of these projecting members might instead be provided, thus offering dedicated support for just one of the tab designs, although either design of tab would fit into the slot, and thus provide a degree of support for a box on the pallet.

The underside of the further member is spaced from the plane of the underside of the top of the pallet. Preferably it is spaced upwardly therefrom by about 5 mm.

The free end 216 at the end of the tapering surface is shown to be flat in the vertical plane. It is spaced from the inside of the sidewall of the pallet in this embodiment by about 7 mm. This might give it a spacing of no more than about 1 mm from the vertical plane that is incidental with the tip of the projection, but in the illustration it lies in that plane, rather than being spaced therefrom. Offering a spacing could allow for a more significant thickness of tab to be accommodated without an excessive amount of compression of the structure (e.g. corrugation) of that tab. This is preferred to maintain a reasonable amount of resilience in the tab, which resilience can provide a more positive retention of the tab in the slot.

The recessed projection 210 has an upper surface that is radiused in the vertical transverse (relative to the slot) direction. Preferably the radius is about 6 mm.

The top of the recessed projection is shown to be in general alignment with a recessed shelf 218 of the slot, which shelf is preferably recessed by about 9 mm relative to the product receiving surface of the pallet.

That shelf has a thickness below it, which thickness is integral with the further member 212 and it is arranged such that the further member extends perpendicular to a leading edge 220 of the shelf—towards, yet downwards relative to, the recessed projection 210.

As shown, the leading edge is curved, so as to define the curved shape of the slot.

The shelf is supported by four reinforcement flanges, all of which are tapered such that the free space within the parent rectangular slot is wider at the product receiving surface of the pallet than at the plane of the top surface of the shelf.

The plurality of flanges take the form of vanes and they each extend perpendicularly from a vertical long-side wall of an adjacent slot. The adjacent slot has four vertical walls surrounding the perimeter of it, so as to form a generally rectangular shape. In the illustrated embodiment these vertical walls each have chamfered tops, which tops are preferably angularly chamfered at a 45° angle.

The curved slots 204 are each located in the middle of the respective closest side of the top of the pallet, such that there are two pairs of them, each pair on different opposing sides of the pallet, and they are each associated with other parallel slots—in this embodiment two different designs of slots. including T shaped slots and the additional slots previously defined.

The shapes or number of vanes can be modified, or replaced with solid walls.

Regarding modification c), details of that are shown in FIGS. 70, 71, 78 and 79. As can be see, the modified pallet's top has an additional pair of display or box attachment features on both of its long sides, although fewer or more might instead be provided, and they might instead or additionally be provided on the front and back (short) sides. These features comprise a vertically arranged, inwardly recessed, sidewall slot. Each slot has an open top for receiving a descending tab from a display package for locating on the pallet. The sidewall slot further has a set of engagement teeth or members extending laterally across the short width of the slot, i.e. perpendicular to the respective sidewall of the top of the pallet. These teeth are shown to have a tapered side (the face that faces away from the sidewall of the top) and a flat bottom (the face that faces downwardly during normal use of the pallet), and thus they resemble a saw-tooth in vertical plan, when seen parallel to the longitudinal length of the slot.

In this example, the set of teeth comprises 5 identical teeth. However, fewer or more teeth may be provided. Even a single tooth can be provided.

In place of sawteeth, other shapes, including rounded members may be provided, e.g., similar to that of the curved slot described above with reference to FIG. 75. The flat bottom is also non essential (for both forms of slot), although flat bottoms (or a lowermost outward point) does assist with providing a positive location for gripping a tab, especially where that tab has a hole for receiving that tooth, member, element, point or projection. After all, it is preferred that the tooth, member, element, point or projection will grip the descending tab, or engage in a hole thereof if such a hole is provided, to make the package more secure on the pallet.

The sidewall slot is shown to be open sideways, i.e. relative to the sidewall of the pallet, other than for its edges. These edges form recessed ends. The recessed ends allow the tabs to locate and be gripped or held both laterally as well as longitudinally in the slots. The tooth, member, element, point or projection then also hold it vertically, thus providing a reliable securement of the tab once inserted in the slot, but yet one that can easily have the tab removed if needed, e.g., through a sidewards ejection.

Figure 78:
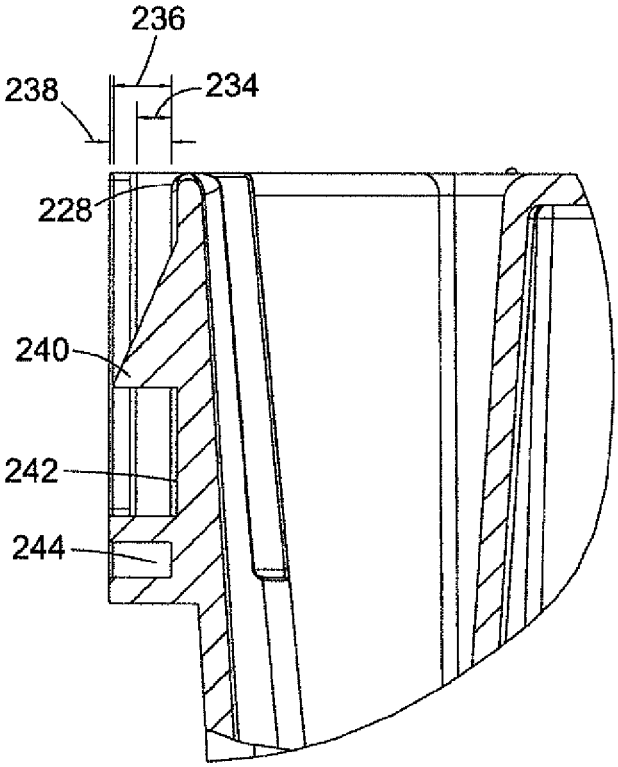
Figure 79:
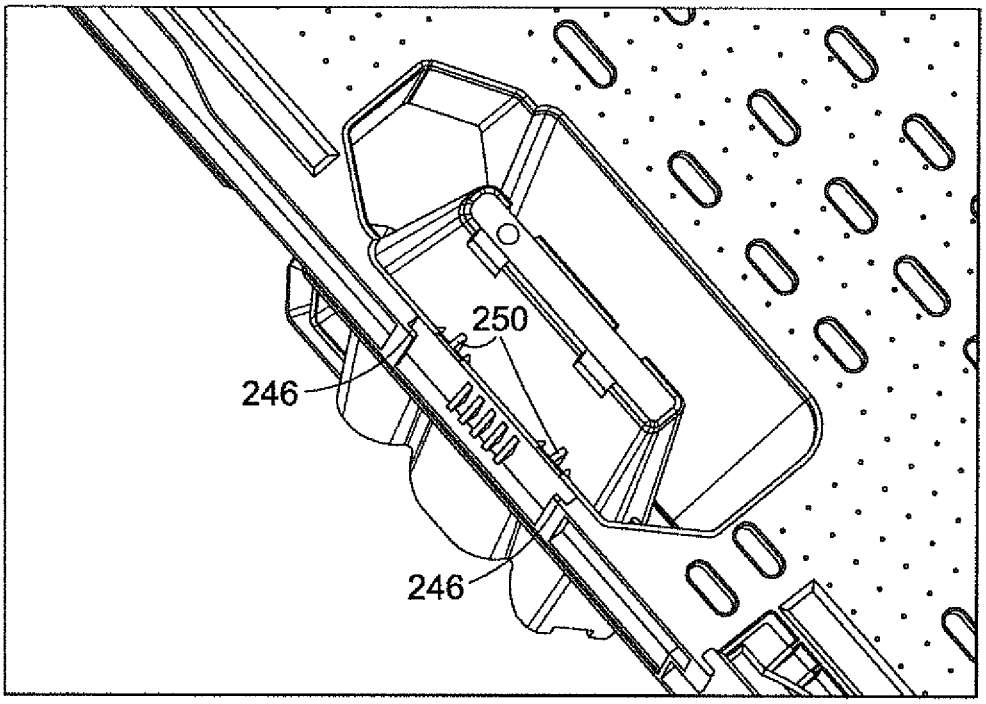
Figure 80:
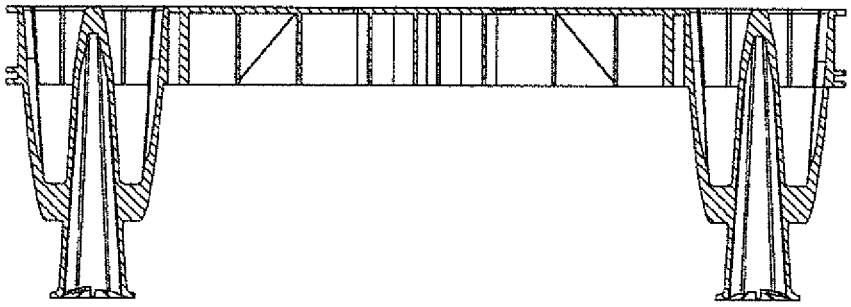
Figure 81:
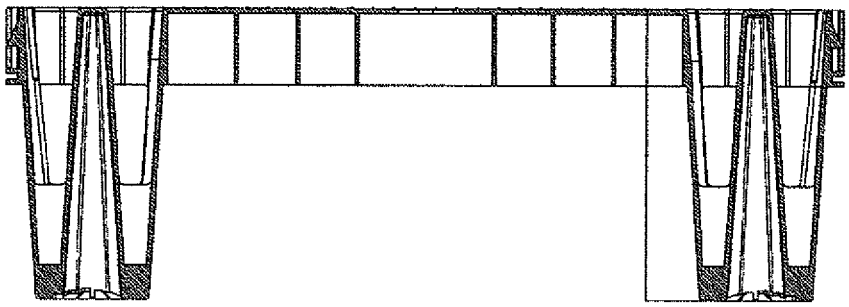
Figure 82:
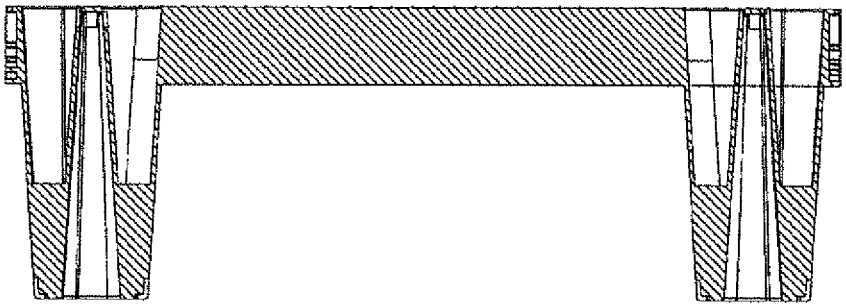

As mentioned above, in this example, there is a pair of these sidewall slots in each long side of the top of the pallet. Further, it is to be observed that each of those individual slots are paired with a matching one of the slots in the opposite long sidewall. These opposing pairs are mirror images of each other, yet the front and back pairs differ slightly at their top walls. Both top walls are chamfered 228 (here with a rounded effect as seen in FIG. 78) to allow an easier insertion of the tab into the slots, bearing in mind that the tabs may descend from the base of a box with a fixed size that will not overlie the opposing edges of the pallet.

Figure 77:
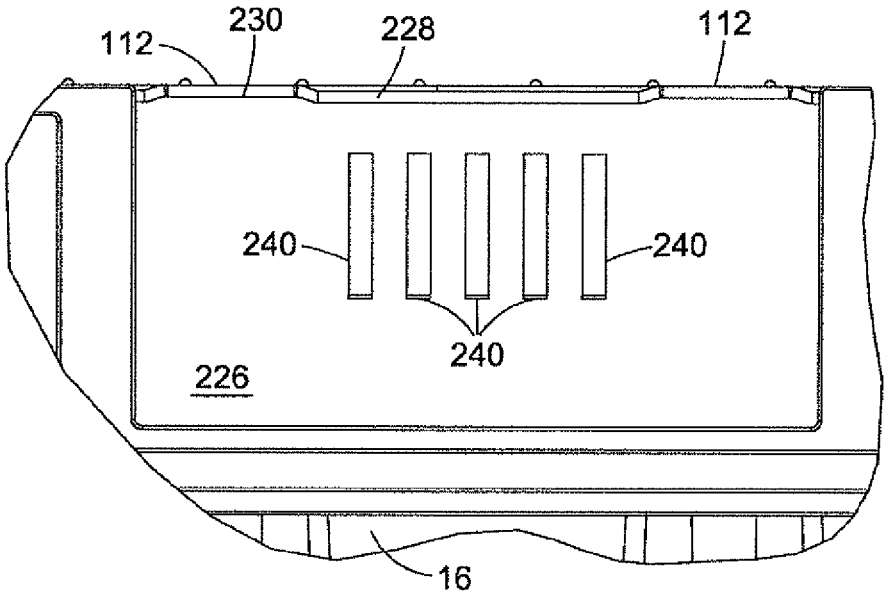

However, whereas the rear slots 224 have a straight top when viewed in side elevation, the front slots 226 have a slightly curved top 230, as shown in FIG. 77. This is since this slot 226 is aligned with the front feet, and in this specific illustration, the front feet have elements 112 that project upwardly slightly from that top edge, albeit only into line with the pallet receiving surface of the pallet. These elements 112 will be described further below.

Each sidewall slot in this example is closed at its bottom by an upper one 232 of the pallet's two bottom reinforcement ribs.

The recessed sides of the sidewall slots have a width 234 of about 4 mm, thus accommodating a tab made from a sheet material (e.g. corrugated cardboard) having a thickness of up to 4 mm without crushing the corrugations in those edge portions. Thicker boards can also be accommodated, but they will be crushed as necessary. A wider width may be preferred for certain applications, although 4 mm is preferred for most applications.

Preferably, the plurality of engagement teeth or members are arranged in a regular array. Here there are five of them, and they each extend 236 from the sidewall of the pallet by further than the width 234 of the recessed sides of the sidewall slots, e.g., about 5.2 mm or more than 5 mm. As shown, however, it is preferred that they extend less far than the extension 238 of the reinforcement ribs. The reinforcement ribs preferably extend at least 5.8 mm from that sidewall. This ensures that the points of the teeth 240 do not extend proud of those reinforcement ribs, whereby the reinforcement ribs are the outermost part of the tops of the pallets. This improves automated handling of the pallets—there are fewer snagging parts for catching on handling equipment.

The back face of the slots are shown to be recessed relative to the surface 244 between the two reinforcement ribs. This is optional, and the lengths of the teeth are adapted accordingly. This recessing may make that back face internally displaced relative to the sidewall proper of the top of the pallet, to allow for a wider width 234 without making the closing return members 246 (see FIG. 79) of the recessed edges too thin to be robust, bearing in mind that these pallets are for multiple reuses. This recessing thus also causes the top edge 230 of the backwall to be needed to be curved, as described above, due to the chamfering of the tops 230 of the back wall. See again FIGS. 77 and 79.

Finally, regarding the details of the feet, and particularly details of the uppermost elements 112, they have been modified such that the tops have a T-structure 250. See FIGS. 76 and 79. The T-structure 250 stands up from the chamfered top edges 230 of the front slots 226, and the leg of the T extends inwards to form a ledge. This ledge provided a support surface for the underside of a product, if needed.

The T-structures extend downwardly towards tapered elements that form the grooves in the sidewalls of the legs, as previously described relative to the earlier embodiment. See FIG. 76.

At the base of the feet, stiffening flanges 252 are again provided. See again FIG. 76.

Various features of the present invention have therefore been described above, although purely by way of example. Each of the various features may be taken in isolation or in combination with other elements disclosed herein.

Modifications in detail may be made to the invention within the scope of the claims appended hereto.

That which is claimed is:

1. A pallet for transporting products thereon, the pallet comprising:

a top comprising a product support surface and an opposing underside, and with outer sides extending between the product support surface and the opposing underside; and at least one product tab receiving area adjacent an edge of the top and having a parent slot within the top and having a partially closed bottom forming a shelf and an opening adjacent the shelf, and an inner slot extending through the opening adjacent the shelf so as to be recessed below the parent slot, the inner slot having a pair of spaced apart sidewalls, a closed bottom, and with one of the sidewalls comprising a projection extending towards the other sidewall.

2. The pallet according to claim 1 wherein the other sidewall of the inner slot comprises a tapered member extending outwards therefrom, with the tapered member having a downwards taper toward the closed bottom.

3. The pallet according to claim 1 wherein the other sidewall of the inner slot is curved.

4. The pallet according to claim 1 wherein the projection longitudinally extends lengthwise within the inner slot, and has a rounded upper surface pointing upwards and a flat bottom facing downwards toward the closed bottom of the inner slot.

5. The pallet according to claim 1 wherein the projection is integrally formed with one of the outer sides of the top.

6. The pallet according to claim 1 wherein the parent slot and the inner slot each have a rectangular shape.

7. The pallet of claim 1 wherein the sides of the top are vertical and comprise a flanged edge extending outwardly from a planar member of the sides of the top, the flanged edge extending around an outer perimeter of the top at an interface adjacent the underside of the top; and wherein each corner of the top is configured as a recessed corner arrangement flush with the planar member of the sides of the top but recessed relative to the flanged edge.

8. A pallet for transporting products thereon, the pallet comprising:

a top comprising a product support surface and an opposing underside, and with outer sides extending between the product support surface and the opposing underside;

four feet each extending away from the underside of the top, each foot having a first opening facing out through the product supporting surface, the feet thus allowing stacking of a plurality of such pallets with the feet of a first such pallet extending into the first openings of a second such pallet, with the four feet being arranged to define a short side window at a short side of the top, the short side window for receiving tines of a fork lift for lifting the pallet;

with two of the legs having a front face directed towards an adjacent short side window that is to receive the tines of the forklift, each front face including an upper portion adjacent the underside and a lower portion for contacting the ground; and at least one product tab receiving area adjacent an edge of the top and having a parent slot within the top and having a partially closed bottom forming a shelf and an opening adjacent the shelf, and an inner slot extending through the opening adjacent the shelf so as to be recessed below the parent slot, the inner slot having a pair of spaced apart sidewalls, a closed bottom, and with one of the sidewalls comprising a projection extending towards the other sidewall.

9. The pallet according to claim 8 wherein the other sidewall of the inner slot comprises a tapered member extending outwards therefrom, with the tapered member having a downwards taper toward the closed bottom.

10. The pallet according to claim 9 wherein the tapered member includes an outermost surface that is perpendicular to the closed bottom of the inner slot.

11. The pallet according to claim 10 wherein the outermost surface of the tapered member is vertically aligned with an outermost surface of the projection.

12. The pallet according to claim 9 wherein the tapered member is aligned with a center of the projection.

13. The pallet according to claim 9 wherein the tapered member has a flat underside that is parallel to the closed bottom of the inner slot, and with there being a gap between the flat underside and the closed bottom.

14. The pallet according to claim 8 wherein the other sidewall of the inner slot is curved.

15. The pallet according to claim 8 wherein the projection longitudinally extends lengthwise within the inner slot, and has a rounded upper surface pointing upwards and a flat bottom facing downwards toward the closed bottom of the inner slot.

16. The pallet according to claim 15 wherein the projection has a quarter-spherical shape.

17. The pallet according to claim 8 wherein the projection is integrally formed with one of the outer sides of the top.

18. The pallet according to claim 8 wherein the parent slot and the inner slot each have a rectangular shape.

19. The pallet of claim 8 wherein the upper portion of each front face of the two legs has a cut out so as to allow for a longer forward surface area on the underside of the top for contacting the tines of the forklift.

20. The pallet of claim 8 wherein the sides of the top are vertical and comprise a flanged edge extending outwardly from a planar member of the sides of the top, the flanged edge extending around an outer perimeter of the top at an interface adjacent the underside of the top; and wherein each corner of the top is configured as a recessed corner arrangement flush with the planar member of the sides of the top but recessed relative to the flanged edge.

21. A pallet for transporting products thereon, the pallet comprising:

a top comprising a product support surface and an opposing underside, and with outer sides extending between the product support surface and the opposing underside;

four feet each extending away from the underside of the top, each foot having a first opening facing out through the product supporting surface, the feet thus allowing stacking of a plurality of such pallets with the feet of a first such pallet extending into the first openings of a second such pallet, with the four feet being arranged to define a short side window at a short side of the top, the short side window for receiving tines of a fork lift for lifting the pallet;

with two of the legs having a front face directed towards an adjacent short side window that is to receive the tines of the forklift, each front face including an upper portion adjacent the underside and a lower portion for contacting the ground; and at least one product tab receiving area adjacent an edge of the top and having a parent slot within the top and having a partially closed bottom forming a shelf and an opening adjacent the shelf, and an inner slot extending through the opening adjacent the shelf so as to be recessed below the parent slot, the inner slot having a pair of spaced apart sidewalls, a closed bottom, and with one of the sidewalls comprising a projection extending towards the other sidewall, the other sidewall comprising a tapered member extending outwards therefrom, with the tapered member having a downwards taper toward the closed bottom, the tapered member including an outermost surface that is vertically aligned with an outermost surface of the projection.

22. The pallet according to claim 21 wherein the outermost member of the tapered member is perpendicular to the closed bottom of the inner slot.

23. The pallet according to claim 21 wherein the tapered member is aligned with a center of the projection.

24. The pallet according to claim 21 wherein the tapered member has a flat underside that is parallel to the closed bottom of the inner slot, and with there being a gap between the flat underside and the closed bottom.

25. The pallet according to claim 21 wherein the other sidewall of the inner slot is curved.

26. The pallet according to claim 21 wherein the projection longitudinally extends lengthwise within the inner slot, and has a rounded upper surface pointing upwards and a flat bottom facing downwards toward the closed bottom of the inner slot.

27. The pallet of claim 21 wherein the upper portion of each front face of the two legs has a cut out so as to allow for a longer forward surface area on the underside of the top for contacting the tines of the forklift.

28. The pallet of claim 21 wherein the sides of the top are vertical and comprise a flanged edge extending outwardly from a planar member of the sides of the top, the flanged edge extending around an outer perimeter of the top at an interface adjacent the underside of the top; and wherein each corner of the top is configured as a recessed corner arrangement flush with the planar member of the sides of the top but recessed relative to the flanged edge.

29. A method for making a pallet for transporting products thereon, the method comprising:

forming a top comprising a product support surface and an opposing underside, and with outer sides extending between the product support surface and the opposing underside;

forming four feet each extending away from the underside of the top, each foot having a first opening facing out through the product supporting surface, the feet thus allowing stacking of a plurality of such pallets with the feet of a first such pallet extending into the first openings of a second such pallet, with the four feet being arranged to define a short side window at a short side of the top, the short side window for receiving tines of a fork lift for lifting the pallet;

with two of the legs having a front face directed towards an adjacent short side window that is to receive the tines of the forklift, each front face including an upper portion adjacent the underside and a lower portion for contacting the ground; and forming at least one product tab receiving area adjacent an edge of the top and having a parent slot within the top and having a partially closed bottom forming a shelf and an opening adjacent the shelf, and an inner slot extending through the opening adjacent the shelf so as to be recessed below the parent slot, the inner slot having a pair of spaced apart sidewalls, a closed bottom, and with one of the sidewalls comprising a projection extending towards the other sidewall.

30. The method according to claim 29 wherein the other sidewall of the inner slot comprises a tapered member extending outwards therefrom, with the tapered member having a downwards taper toward the closed bottom.

31. The method according to claim 30 wherein the tapered member includes an outermost surface that is perpendicular to the closed bottom of the inner slot.

32. The method according to claim 30 wherein the outermost surface of the tapered member is vertically aligned with an outermost surface of the projection.

33. The method according to claim 30 wherein the tapered member has a flat underside that is parallel to the closed bottom of the inner slot, and with there being a gap between the flat underside and the closed bottom.

34. The method according to claim 29 wherein the other sidewall of the inner slot is curved.

35. The method of claim 29 wherein the upper portion of each front face of the two legs has a cut out so as to allow for a longer forward surface area on the underside of the top for contacting the tines of the forklift.

* * * * *